US007250249B2

(12) United States Patent
Yoshioka

(10) Patent No.: US 7,250,249 B2
(45) Date of Patent: Jul. 31, 2007

(54) BLACK AND WHITE PHOTOTHERMOGRAPHIC MATERIAL

(75) Inventor: Yasuhiro Yoshioka, Kanagawa (JP)

(73) Assignee: FujiFilm Corporation, Tokyo (JP)

( * ) Notice: Subject to any disclaimer, the term of this patent is extended or adjusted under 35 U.S.C. 154(b) by 0 days.

(21) Appl. No.: 11/375,240

(22) Filed: Mar. 15, 2006

(65) Prior Publication Data

US 2006/0210934 A1 Sep. 21, 2006

(30) Foreign Application Priority Data

Mar. 18, 2005 (JP) ..... 2005-080356

(51) Int. Cl.
*G03C 1/498* (2006.01)
*G03C 7/32* (2006.01)

(52) U.S. Cl. ..... 430/619; 430/531; 430/543; 430/552; 430/554; 430/556; 430/558; 430/559; 430/611

(58) Field of Classification Search ..... 430/619, 430/567, 611, 966, 543, 552, 554, 556, 558, 430/559, 531
See application file for complete search history.

(56) References Cited

U.S. PATENT DOCUMENTS 4,126,461 A * 11/1978 Pupo et al. ..... 430/402
2002/0110763 A1* 8/2002 Matsumoto et al. ..... 430/350
2004/0131983 A1* 7/2004 Ohzeki et al. ..... 430/619

FOREIGN PATENT DOCUMENTS

EP 1467248 A 10/2004

* cited by examiner

*Primary Examiner*—Thorl Chea
(74) *Attorney, Agent, or Firm*—Margaret A. Burke; Sheldon J. Moss

(57) ABSTRACT

A black and white photothermographic material including, on at least one side of a support, an image forming layer including at least a photosensitive silver halide, a silver salt of a fatty acid, a reducing agent for silver ions, and a binder, wherein the black and white photothermographic material includes a compound represented by the following formula (I) as the reducing agent and a compound represented by the following formula (BC-1) as a coupler:

Formula (I)

Formula (BC-1)

A black and white photothermographic material which exhibits low fog, high image density, excellent image tone, and excellent raw stock storability is provided.

22 Claims, No Drawings

BLACK AND WHITE PHOTOTHERMOGRAPHIC MATERIAL

CROSS-REFERENCE TO RELATED APPLICATION

This application claims priority under 35 USC 119 from Japanese Patent Application No. 2005-080356, the disclosure of which is incorporated by reference herein.

BACKGROUND OF THE INVENTION

1. Field of the Invention

The present invention relates to a black and white photothermographic material. More particularly, the invention relates to a black and white photothermographic material which exhibits low fog, high image density, excellent image tone, and excellent raw stock storability.

2. Description of the Related Art

In recent years, in the field of films for medical diagnosis and in the field of films for graphic arts, there has been a strong desire for decreasing the amount of processing liquid waste from the viewpoints of protecting the environment and economy of space. For this reason, technology regarding thermal developing image recording materials for medical diagnosis and for graphic arts, which can be exposed effectively by laser image setters or laser imagers and thermally developed to obtain clear black-toned images of high resolution and sharpness, is required. The thermal developing image recording materials do not require liquid processing chemicals and can therefore be supplied to customers as a simpler and environmentally friendly thermal processing system.

Thermal image forming systems utilizing organic silver salts are described, for example, in the specifications of U.S. Pat. Nos. 3,152,904 and 3,457,075 and in "Thermally Processed Silver Systems" by D. H. Klosterboer, appearing in "Imaging Processes and Materials", Neblette, 8th edition, edited by J. Sturge, V. Warlworth, and A. Shepp, Chapter 9, pages 279 to 291, 1989. All patents, patent publications, and non-patent literature cited in this specification are hereby expressly incorporated by reference herein. In particular, photothermographic materials generally have an image forming layer in which a catalytically active amount of a photocatalyst (for example, silver halide), a reducing agent, a reducible silver salt (for example, an organic silver salt), and if necessary, a toner for controlling the color tone of developed silver images are dispersed in a binder. Photothermographic materials form black silver images by being heated to a high temperature (for example, 80° C. or higher) after imagewise exposure to cause an oxidation-reduction reaction between a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region.

The photothermographic materials utilizing an organic silver salt have a great characteristic of containing all components necessary for image formation in the film in advance and being capable of forming images only by heating. However, on the other hand, the photothermographic material has a problem in that it is difficult to attain high sensitivity due to generation of fog. In addition, the photothermographic material has a problem relating to storage stability in which, for example, sensitivity changes or fog increases during storage thereof. Moreover, because photosensitive silver halide grains remain in the material after image formation, there are serious problems in that film turbidity becomes high due to light absorption and light scattering, and fog increases during placement of the images under light conditions, which is called print-out.

On the other hand, photothermographic materials containing a color developer and a coupler are disclosed in Japanese Patent Application Laid-Open (JP-A) Nos. 2001-312026, 2003-215767, and 2003-215764 and U.S. Pat. No. 6,242,166. These materials use photosensitive silver halides such as silver chloride, silver bromide, silver chlorobromide, silver iodobromide, or silver iodochlorobromide. Because light scattering and light absorption due to the silver halide increase turbidity and opacity of the film, fogging becomes extremely high and is as high as 0.58 to 1.2 as described in the Examples of the above specifications. Accordingly, the obtained image is a primary image and is not an image for being directly viewed, and accordingly, the image is digitalized, and image processing is performed to reduce fogging and adjust gradation and color tone, whereby it is attempted to form a reprocessed image which can be provided for viewing.

Attempts have also been made at applying the photothermographic material as photosensitive material for photographing. The term "photosensitive material for photographing" used herein means a photosensitive material on which images are recorded by a one shot exposure by a camera, rather than by writing the image information by a scanning exposure with a laser beam or the like. Conventionally, photosensitive materials for photographing are generally known in the field of wet developing photosensitive materials, and include films for medical use such as direct or indirect radiography films, mammography films and the like, various kinds of photomechanical films used in printing, industrial recording films, films for photographing with general-purpose cameras, and the like. For example, an X-ray photothermographic material coated on both sides using a blue fluorescent intensifying screen, a photothermographic material containing tabular silver iodobromide grains (for example, see JP-A No. 59-142539), and a photosensitive material for medical use containing tabular grains that have a high content of silver chloride and have a (100) major face, and that are coated on both sides of a support (for example, see JP-A No. 10-282602) are known. Further, photothermographic materials coated on both sides are also disclosed in JP-A Nos. 2000-227642, 2001-22027, 2001-109101, and 2002-90941.

However, even higher sensitivity is especially required for recording X-ray images so as to reduce an amount of radioactive radiation exposure with respect to the human body. In the conventional technologies described above, there are limits to the prevention of the increase in fog and the degradation of storage stability that accompany higher sensitization thereof.

SUMMARY OF THE INVENTION

The present invention has been made in view of the above circumstances and provides a black and white photothermographic material comprising, on at least one side of a support, an image forming layer comprising at least a photosensitive silver halide, a silver salt of a fatty acid, a reducing agent for silver ions, and a binder, wherein the black and white photothermographic material comprises a compound represented by the following formula (I) as the reducing agent, and further comprises a coupler which is represented by the following formula (BC-1) and performs a coupling reaction with an oxidation product of the compound represented by formula (I) to form a dye.

Formula (I)

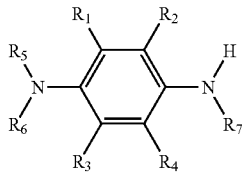

In formula (I), $R_1$, $R_2$, $R_3$, and $R_4$ each independently represent a hydrogen atom or a substituent. $R_5$ and $R_6$ each independently represent an alkyl group, an aryl group, a heterocyclic group, an acyl group, or a sulfonyl group, wherein members in at least one combination of $R_1$ and $R_2$, $R_3$ and $R_4$, $R_5$ and $R_6$, $R_2$ and $R_5$, and $R_4$ and $R_6$ may bond to each other to form a 5-, 6-, or 7-membered ring. $R_7$ represents $R_{11}$—O—CO—, $R_{12}$—CO—CO—, $R_{13}$—NH—CO—, $R_{14}$—$SO_2$—, $R_{15}$—W—C($R_{16}$)($R_{17}$)—, $R_{19}$—$SO_2$NHCO—, $R_{20}$—CONHCO—, $R_{21}$—$SO_2$NH$SO_2$—, $R_{22}$—CONH$SO_2$—, or $(M)_{1/n}OSO_2$—, wherein $R_{11}$, $R_{12}$, $R_{13}$, $R_{14}$, $R_{19}$, $R_{20}$, $R_{21}$, and $R_{22}$ each independently represent an alkyl group, an aryl group, or a heterocyclic group. $R_{15}$ represents a hydrogen atom or a block group. W represents an oxygen atom, a sulfur atom, or —N($R_{18}$)—. $R_{16}$, $R_{17}$, and $R_{18}$ each independently represent a hydrogen atom or an alkyl group, and M represents a cation having a valency of n.

Formula (BC-1)

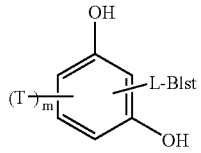

In formula (BC-1), L represents a divalent linking group, and B1st represents a ballast group which causes a coupler molecule to have diffusion resistance. T represents a substituent which leaves upon coupling reaction, and m represents an integer of from 0 to 3.

DETAILED DESCRIPTION OF THE INVENTION

An object of the present invention is to provide a black and white photothermographic material which exhibits low fog, high image density, excellent image tone, and excellent raw stock storability.

The black and white photothermographic material of the present invention is characterized by having, on at least one side of a support, an image forming layer including at least a photosensitive silver halide, a silver salt of a fatty acid, a reducing agent for silver ions, and a binder, wherein the black and white photothermographic material comprises a compound represented by the above formula (I) as the reducing agent, and a coupler which is represented by the above formula (BC-1) and reacts with an oxidation product of the compound represented by formula (I) to form a dye.

The black and white photothermographic material of the present invention produces a black and white image formed by a combined image comprising a silver image and a dye image by means of an imagewise exposure step and a thermal development step.

The inventors found that a black and white photothermographic material, in which a black and white image is formed by a combined image comprising a silver image and a dye image, can provide advantages such as high image density while keeping high sensitivity, reduction of coating amounts of a silver salt of a fatty acid and a silver halide, and obtaining a favorable image with less film turbidity. However, as another problem, it was found that the color tones of an image obtained in a low density area, a middle density area, and a high density area are not uniform. For example, in the case where a high image density is obtained in the middle density area to the high density area, the color tone in the low density area results in a color tone that is deviated from neutral color. Inversely, when the color tone in the low density area is maintained as a preferable neutral color, the image density in the high density area becomes insufficient. As noted above, in the case where a black and white image is formed by a combined image comprising a silver image and a dye image, it is a very important task to keep the "color tone balance" of the overall image density area at a favorable level. In addition, it presents another problem that after coating the black and white photothermographic material, a long storage period until use for image formation causes breaking down of the color tone balance further and generation of color fogging.

As the result of investigation for solving the problems described above, the inventors found that the combined use of a compound represented by formula (I) described above as the reducing agent and a coupler represented by formula (BC-1) is effective in solving the problems, and thereby arrived at the present invention. The coupler represented by formula (BC-1) or (BC-2) is characterized in that a black dye is formed by a coupling reaction with an oxidation product of the reducing agent represented by formula (I).

WO No. 2004/090632 discloses a conventional wet processed silver halide photosensitive material in which color reproduction and light fastness of images are improved by using a coupler forming a black color. However, the conventional wet processed silver halide photosensitive material does not involve issues such as the color tone of an image and achievement of high image density and low film turbidity which are inherent in the black and white photothermographic material. Therefore there are no descriptions suggesting effective means to improve these problems in the above patent references.

The present invention is explained below in detail.

The reducing agent incorporated in the black and white photothermographic material of the present invention is a compound which hardly has absorption in the visible light region. When the black and white photothermographic material is subjected to thermal development, the compound itself functions as a reducing agent or releases a reducing agent to form a silver image, and an oxidation product of the compound itself or an oxidation product of the released reducing agent is produced. The oxidation product reacts with a coupler compound to form a dye and thereby yield an imagewise dye image corresponding to the silver image.

(Reducing Agent: Compound Represented by Formula (I))

The compound represented by formula (I) of the present invention is explained below in detail.

Formula (I)

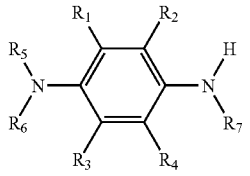

In formula (I), $R_1$, $R_2$, $R_3$, and $R_4$ each independently represent a hydrogen atom or a substituent. $R_5$ and $R_6$ each independently represent one selected from an alkyl group, an aryl group, a heterocyclic group, an acyl group, or a sulfonyl group. Members in at least one combination of $R_1$ and $R_2$, $R_3$ and $R_4$, $R_5$ and $R_6$, $R_2$ and $R_5$, and $R_4$ and $R_6$ may bond to each other to form a 5-, 6-, or 7-membered ring. $R_7$ represents $R_{11}$—O—CO—, $R_{12}$—CO—CO—, $R_{13}$—NH—CO—, $R_{14}$—$SO_2$—, $R_{15}$—W—C($R_{16}$)($R_{17}$)—, $R_{19}$—$SO_2$NHCO—, $R_{20}$—CONHCO—, $R_{21}$—$SO_2$NH$SO_2$—, $R_{22}$—CONH$SO_2$—, or $(M)_{1/n}OSO_2$—, wherein $R_{11}$, $R_{12}$, $R_{13}$, $R_{14}$, $R_{19}$, $R_{20}$, $R_{21}$, and $R_{22}$ each independently represent one selected from an alkyl group, an aryl group, or a heterocyclic group. $R_{15}$ represents a hydrogen atom or a block group. W represents an oxygen atom, a sulfur atom, or —N($R_{18}$)—. $R_{16}$, $R_{17}$, and $R_{18}$ each independently represent one selected from a hydrogen atom or an alkyl group, and M represents a cation having a valency of n.

$R_1$, $R_2$, $R_3$, and $R_4$ each independently represent a hydrogen atom or a substituent. Examples of the substituent represented by $R_1$, $R_2$, $R_3$, and $R_4$ include a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxy group, a nitro group, a carboxy group, an alkoxy group, an aryloxy group, silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imide group, a phosphino group, a phosphinyl group, a phosphinyloxy group, a phosphinylamino group, and a silyl group.

Further in detail, a halogen atom (for example, a chlorine atom, a bromine atom, or an iodine atom), an alkyl group [which represents a substituted or unsubstituted, linear, branched, or cyclic alkyl group; an alkyl group (preferably, an alkyl group having 1 to 30 carbon atoms; for example, methyl, ethyl, n-propyl, isopropyl, t-butyl, n-octyl, eicosyl, 2-chloroethyl, 2-cyanoethyl, and 2-ethylhexyl), a cycloalkyl group (preferably, a substituted or unsubstituted cycloalkyl group having 3 to 30 carbon atoms; for example, cyclohexyl, cyclopentyl, and 4-n-dodecylcyclohexyl), a bicycloalkyl group (preferably, a substituted or unsubstituted bicycloalkyl group having 5 to 30 carbon atoms, namely, it means a monovalent group obtained by removing one hydrogen atom from bicycloalkane having 5 to 30 carbon atoms; for example, bicyclo[1,2,2]heptan-2-yl, bicyclo[2,2,2]octan-3-yl), and further a tricyclo structure having many cyclic structures, and the like are included; an alkyl group included in a substituent described below (for example, an alkyl group in an alkylthio group) also represents the alkyl group of this concept], an alkenyl group [which represents a substituted or unsubstituted, linear, branched, or cyclic alkenyl group; an alkenyl group (preferably, an alkenyl group having 2 to 30 carbon atoms; for example, vinyl, allyl, prenyl, gelanyl, and oleyl), a cycloalkenyl group (preferably, a substituted or unsubstituted cycloalkenyl group having 3 to 30 carbon atoms, namely, it means a monovalent group obtained by removing one hydrogen atom from cycloalkene having 3 to 30 carbon atoms; for example, 2-cyclopenten-1-yl and 2-cyclohexen-1-yl), a bicycloalkenyl group (a substituted or unsubstituted bicycloalkenyl group, and preferably, a substituted or unsubstituted bicycloalkenyl group having 5 to 30 carbon atoms, namely, it means a monovalent group obtained by removing one hydrogen atom from bicycloalkene having one double bond; for example, bicyclo[2,2,1]hepto-2-en-1-yl, bicyclo[2,2,2]octo-2-en-4-yl) are described], an alkynyl group (preferably, a substituted or unsubstituted alkynyl group having 2 to 30 carbon atoms; for example, ethynyl, propargyl, and a trimethylsilylethynyl group), an aryl group (preferably, a substituted or unsubstituted aryl group having 6 to 30 carbon atoms; for example, phenyl, p-tolyl, naphthyl, m-chlorophenyl, and o-hexadecanoylaminophenyl), a heterocyclic group (preferably, a monovalent group obtained by removing one hydrogen atom from 5- or 6-membered, substituted or unsubstituted, aromatic or non-aromatic heterocyclic compound, more preferably, a 5- or 6-membered heterocyclic group having 3 to 30 carbon atoms; for example, 2-furyl, 2-ethynyl, 2-pyrimidinyl, and 2-benzothiazolyl), a cyano group, a hydroxy group, a nitro group, a carboxy group, an alkoxy group (preferably, a substituted or unsubstituted alkoxy group having 1 to 30 carbon atoms; for example, methoxy, ethoxy, isopropoxy, t-butoxy, n-octyloxy, and 2-methoxyethoxy), an aryloxy group (preferably, a substituted or unsubstituted aryloxy group having 6 to 30 carbon atoms; for example, phenoxy, 2-methylphenoxy, 4-t-butylphenoxy, 3-nitrophenoxy, and 2-tetradecanoylaminophenoxy), a silyloxy group (preferably, a silyloxy group having 3 to 20 carbon atoms; for example, trimethylsilyloxy and t-butyldimethylsilyloxy), a heterocyclic oxy group (preferably, a substituted or unsubstituted heterocyclic oxy group having 2 to 30 carbon atoms; for example, 1-phenyltetrazole-5-oxy and 2-tetrahydropyranyloxy), an acyloxy group (preferably, a formyloxy group, a substituted or unsubstituted alkylcarbonyloxy group having 2 to 30 carbon atoms, or a substituted or unsubstituted arylcarbonyloxy group having 6 to 30 carbon atoms; for example, formyloxy, acetyloxy, pivaloyloxy, stearoyloxy, benzoyloxy, and p-methoxyphenylcarbonyloxy), a carbamoyloxy group (preferably, a substituted or unsubstituted carbamoyloxy group having 1 to 30 carbon atoms; for example, N,N-dimethylcarbamoyloxy, N,N-diethylcarbamoyloxy, morpholinocarbonyloxy, N,N-di-n-octylaminocarbonyloxy, and N-n-octylcarbamoyloxy), an alkoxycarbonyloxy group (preferably, a substituted or unsubstituted alkoxycarbonyloxy group having 2 to 30 carbon atoms; for example, methoxycarbonyloxy, ethoxycarbonyloxy, t-butoxycarbonyloxy, and n-octylcarbonyloxy), an aryloxycarbonyloxy group (preferably, a substituted or unsubstituted aryloxycarbonyloxy group having 7 to 30 carbon atoms; for example, phenoxycarbonyloxy, p-methoxyphenoxycarbonyloxy, and p-n-hexadecyloxyphenoxycarbonyloxy), an amino group (preferably, an amino group, a substituted or unsubstituted alkylamino group having 1 to 30 carbon atoms, or a substituted or unsubstituted anilino group having 6 to 30 carbon atoms; for example, amino, methylamino, dimethylamino, anilino, N-methyl-anilino, and diphenylamino), an acylamino group (preferably, a formylamino group, a substituted or unsubstituted alkylcarbonylamino group having 1 to 30 carbon atoms, or a substituted or unsubstituted arylcarbonylamino group having 6 to 30 carbon atoms; for example, formylamino, acetylamino, pivaloylamino, lauroylamino, benzoylamino, and 3,4,5-tri-n-octyloxyphenylcarbonylamino), an aminocarbonylamino group (preferably, a substituted or unsubstituted aminocarbonylamino group having 1 to 30 carbon atoms; for example, carbamoylamino, N,N-dimethylaminocarbonylamino, N,N-diethylaminocarbonylamino, and morpholinocarbonylamino), an alkyloxycarbonylamino group (preferably, a substituted or unsubstituted alkoxycarbonylamino group having 2 to 30 carbon atoms; for example, methoxycarbonylamino, ethoxycarbonylamino, t-butoxycarbonylamino, n-octadecyloxycarbonylamino, and N-methyl-methoxycarbonylamino), an aryloxycarbonylamino group (preferably, a substituted or unsubstituted aryloxycarbonylamino group having 7 to 30 carbon atoms; for example, phenoxycarbonylamino, p-chlorophenoxycarbonylamino, and m-n-octyloxyphenoxycarbonylamino), a sulfamoylamino group (preferably, a substituted or unsubstituted sulfamoylamino group having 0 to 30 carbon atoms; for example, sulfamoylamino, N,N-dimethylaminosulfonylamino, and N-n-octylaminosulfonylamino), an alkylsulfonylamino group and an arylsulfonylamino group (preferably, a substituted or unsubstituted alkylsulfonylamino group having 1 to 30 carbon atoms and a substituted or unsubstituted arylsulfonylamino group having 6 to 30 carbon atoms; for example, methylsulfonylamino, butylsulfonylamino, phenylsulfonylamino, 2,3,5-trichlorophenylsulfonylamino, and p-methylphenylsulfonylamino), a mercapto group, an alkylthio group (preferably, a substituted or unsubstituted alkylthio group having 1 to 30 carbon atoms; for example, methylthio, ethylthio, and n-hexadecylthio), an arylthio group (preferably, a substituted or unsubstituted arylthio group having 6 to 30 carbon atoms; for example, phenylthio, p-chlorophenylthio, and m-methoxyphenylthio), a heterocyclic thio group (preferably, a substituted or unsubstituted heterocyclic thio group having 2 to 30 carbon atoms; for example, 2-benzothiazolylthio and 1-phenyltetrazol-5-ylthio), a sulfamoyl group (preferably, a substituted or unsubstituted sulfamoyl group having 0 to 30 carbon atoms; for example, N-ethylsulfamoyl, N-(3-dodecyloxypropyl)sulfamoyl, N,N-dimethylsulfamoyl, N-acetylsulfamoyl, N-benzoylsulfamoyl, and N—(N'-phenylcarbamoyl)sulfamoyl), a sulfo group, an alkylsulfinyl group and an arylsulfinyl group (preferably, a substituted or unsubstituted alkylsulfinyl group having 1 to 30 carbon atoms and a substituted or unsubstituted arylsulfinyl group having 6 to 30 carbon atoms; for example, methylsulfinyl, ethylsulfinyl, phenylsulfinyl, and p-methylphenylsulfinyl), an alkylsulfonyl group and an arylsulfonyl group (preferably, a substituted or unsubstituted alkylsulfonyl group having 1 to 30 carbon atoms and a substituted or unsubstituted arylsulfonyl group having 6 to 30 carbon atoms; for example, methylsulfonyl, ethylsulfonyl, phenylsulfonyl, and p-methylphenylsulfonyl), an acyl group (preferably, a formyl group, a substituted or unsubstituted alkylcarbonyl group having 2 to 30 carbon atoms, and a substituted or unsubstituted arylcarbonyl group having 7 to 30 carbon atoms; for example, acetyl, pivaloyl, 2-chloroacetyl, stearoyl, benzoyl, and p-n-octyloxyphenylcarbonyl), an aryloxycarbonyl group (preferably, a substituted or unsubstituted aryloxycarbonyl group having 7 to 30 carbon atoms; for example, phenoxycarbonyl, o-chlorophenoxycarbonyl, m-nitrophenoxycarbonyl, and p-t-butylphenoxycarbonyl), an alkoxycarbonyl group (preferably, a substituted or unsubstituted alkoxycarbonyl group having 2 to 30 carbon atoms; for example, methoxycarbonyl, ethoxycarbonyl, t-butoxycarbonyl, and n-octadecyloxycarbonyl), a carbamoyl group (preferably, a substituted or unsubstituted carbamoyl group having 1 to 30 carbon atoms; for example, carbamoyl, N-methylcarbamoyl, N,N-dimethylcarbamoyl, N,N-di-n-octylcarbamoyl, and N-(methylsulfonyl)carbamoyl), an arylazo group and a heterocyclic azo group (preferably, a substituted or unsubstituted arylazo group having 6 to 30 carbon atoms and a substituted or unsubstituted heterocyclic azo group having 3 to 30 carbon atoms; for example, phenylazo, p-chlorophenylazo, and 5-ethylthio-1,3,4-thiadiazol-2-ylazo), an imide group (for example, N-succinimide and N-phthalimide), a phosphino group (preferably, a substituted or unsubstituted phosphino group having 2 to 30 carbon atoms; for example, dimethylphosphino, diphenylphosphino, and methylphenoxyphosphino), a phosphinyl group (preferably, a substituted or unsubstituted phosphinyl group having 2 to 30 carbon atoms; for example, phosphinyl, dioctyloxyphosphinyl, and diethoxyphosphinyl), a phosphinyloxy group (preferably, a substituted or unsubstituted phosphinyloxy group having 2 to 30 carbon atoms; for example, diphenoxyphosphinyloxy and dioctyloxyphosphinyloxy), a phosphinylamino group (preferably, a substituted or unsubstituted phosphinylamino group having 2 to 30 carbon atoms; for example, dimethoxyphosphinylamino and dimethylaminophosphinylamino), a silyl group (preferably, a substituted or unsubstituted silyl group having 3 to 30 carbon atoms; for example, trimethylsilyl, t-butyldimethylsilyl, and phenyldimethylsilyl) are described.

When the group represented by $R_1$ to $R_4$ is a group capable of being further substituted, the group represented by $R_1$ to $R_4$ may further have a substituent, and in that case, preferable substituent is the group having the same meaning as the substituent described in the explanation of $R_1$ to $R_4$. When the group represented by $R_1$ to $R_4$ is substituted by two or more substituents, those substituents may be the same or different.

$R_5$ and $R_6$ each independently represent one selected from an alkyl group, aryl group, a heterocyclic group, an acyl group, an alkylsulfonyl group, or an arylsulfonyl group. Preferable ranges of the alkyl group, aryl group, heterocyclic group, acyl group, alkylsulfonyl group, or arylsulfonyl group represents the groups having the same meaning as the alkyl group, aryl group, heterocyclic group, acyl group, alkylsulfonyl group, or arylsulfonyl group which are explained in the group represented by $R_1$ to $R_4$. When the group represented by $R_5$ or $R_6$ is a group capable of being further substituted, the group represented by $R_5$ or $R_6$ may further have a substituent, and in that case, preferable substituent represents the group having the same meaning as the substituent described in the explanation of $R_1$ to $R_4$. When the group represented by $R_5$ or $R_6$ is substituted by two or more substituents, those substituents may be the same or different.

Members in at least one combination of $R_1$ and $R_2$, $R_3$ and $R_4$, $R_5$ and $R_6$, $R_2$ and $R_5$, and $R_4$ and $R_6$ may bond to each other to form a 5-, 6-, or 7-membered ring.

$R_7$ in formula (I) represents $R_{11}$—O—CO—, $R_{12}$—CO—CO—, $R_{13}$—NH—CO—, $R_{14}$—$SO_2$—, $R_{15}$—W—C($R_{16}$)($R_{17}$)—, $R_{19}$—$SO_2$NHCO—, $R_{20}$—CONHCO—, $R_{21}$—$SO_2NHSO_2$—, $R_{22}$—$CONHSO_2$—, or $(M)_{1/n}OSO_2$—, wherein $R_{11}$, $R_{12}$, $R_{13}$, $R_{14}$, $R_{19}$, $R_{20}$, $R_{21}$, and $R_{22}$ each independently represent one selected from an alkyl group, an aryl group, or a heterocyclic group. $R_{15}$ represents a hydrogen atom or a block group, W represents an oxygen atom, a sulfur atom, or —N($R_{18}$)—, and $R_{16}$, $R_{17}$ and $R_{18}$ represent one selected from a hydrogen atom or an alkyl group. The alkyl group, aryl group and heterocyclic group represented by $R_{11}$, $R_{12}$, $R_{13}$, $R_{14}$, $R_{18}$, $R_{20}$, $R_{21}$, or $R_{22}$ represent the group having the same meaning as the alkyl group, aryl group and heterocyclic group described in the explanation of the above $R_1$ to $R_4$. M represents a cation having a valency of n. When the group represented by $R_{11}$, $R_{12}$, $R_{13}$, $R_{14}$, $R_{19}$, $R_{20}$, $R_{21}$, or $R_{22}$ is a group capable of being further substituted, the group represented by $R_{11}$, $R_{12}$, $R_{13}$, $R_{14}$, $R_{19}$, $R_{20}$, $R_{21}$, or $R_{22}$ may further have a substituent, and in that case, preferable substituent represents the group having the same meaning as the substituent described in the explanation of $R_1$ to $R_4$. When the group represented by $R_{11}$, $R_{12}$, $R_{13}$, $R_{14}$, $R_{19}$, $R_{20}$, $R_{21}$, or $R_{22}$ is substituted by two or more substituents, those substituents may be the same or different.

When $R_{16}$, $R_{17}$ and $R_{18}$ represent an alkyl group, those represent the group having the same meaning as the alkyl group explained in the substituent represented by $R_1$ to $R_4$. In the case of where $R_{15}$ represents a block group, the block group has the same meaning as the block group represented by BLK, which is described below.

Preferable range of the compound represented by formula (I) is explained below. $R_1$, $R_2$, $R_3$, or $R_4$ is preferably a hydrogen atom, a halogen atom, an alkyl group, an aryl group, an acylamino group, an alkylsulfonylamino group, an arylsulfonylamino group, an alkoxy group, an aryloxy group, an alkylthio group, an arylthio group, an acyl group, an alkoxycarbonyl group, an aryloxycarbonyl group, a carbamoyl group, a cyano group, a hydroxy group, a carboxy group, a sulfo group, a nitro group, a sulfamoyl group, an alkylsulfonyl group, an arylsulfonyl group, or an acyloxy group, and more preferably a hydrogen atom, a halogen atom, an alkyl group, an acylamino group, an alkylsulfonylamino group, an arylsulfonylamino group, an alkoxy group, an alkylthio group, an arylthio group, an alkoxycarbonyl group, a carbamoyl group, a cyano group, a hydroxy group, a carboxy group, a sulfo group, a nitro group, a sulfamoyl group, an alkylsulfonyl group, or an arylsulfonyl group. It is particularly preferable that one of $R_1$ or $R_3$ is a hydrogen atom among $R_1$ to $R_4$.

$R_5$ and $R_6$ are preferably an alkyl group, an aryl group, or a heterocyclic group, and most preferably an alkyl group.

It is preferred from the viewpoint of being compatible in color forming property and storability that the oxidization potential of p-phenylenediamine derivative, in which $R_7$ of the compound represented by formula (I) is a hydrogen atom, is 5 mV or less (with respect to SCE) in an aqueous solution having the pH of 10.

$R_7$ is preferably $R_{11}$—O—CO—, $R_{14}$—$SO_2$—, $R_{19}$—$SO_2$—NH—CO—, or $R_{15}$—W—C($R_{16}$)($R_{17}$)—, more preferably $R_{11}$—O—CO— or $R_{19}$—$SO_2$—NH—CO—, and most preferably $R_{19}$—$SO_2$—NH—CO—. $R_{11}$ is preferably an alkyl group, and $R_{11}$ is preferably a group containing a timing group which causes a cleavage reaction using an electron transfer reaction described in U.S. Pat. Nos. 4,409,323 and 4,421,845, and $R_{11}$ is preferably a group represented by the following formula (T-1), in which the terminal which causes the electron transfer reaction of the timing group is blocked.

$$\text{BLK—W—(X=Y)}_j\text{—C(R}_{21}\text{)R}_{22}\text{—**} \qquad \text{Formula (T-1)}$$

In the formula, BLK represents a block group, ** denotes a bond with —O—CO— at this position, W represents an oxygen atom, a sulfur atom, or —N($R_{23}$)—, X and Y each represent a methine or a nitrogen atom, j represents 0, 1, or 2, and $R_{21}$, $R_{22}$ and $R_{23}$ each represent a hydrogen atom or the group having the same meaning as the substituent explained in $R_1$ to $R_4$. Here, when X and Y represent a substituted methine, it may be any of the case in which the substituent and two arbitrary substituents of $R_{21}$, $R_{22}$, and $R_{23}$ bond together to form a cyclic structure (for example, a benzene ring or a pyrazole ring) and the case in which a cyclic structure is not formed.

As a block group represented by BLK, known compounds can be used. Namely, a block group such as an acyl group, a sulfonyl group, and the like described in Japanese Patent Application Publication (JP-B) No. 48-9968, JP-A Nos. 52-8828, 57-82834, U.S. Pat. No. 3,311,476, JP-B No. 47-44805 (U.S. Pat. No. 3,615,617), and the like, a block group utilizing the reverse Michael reaction described in JP-B Nos. 55-17369 (U.S. Pat. No. 3,888,677), 55-9696 (U.S. Pat. No. 3,791,830), 55-34927 (U.S. Pat. No. 4,009,029), JP-A Nos. 56-77842 (U.S. Pat. No. 4,307,175), 59-105640, 59-105641, and 59-105642, and the like, a block group utilizing formation of quinonemethide or quinonemethide-like compound by an intramolecular electron transfer described in JP-B No. 54-39727, U.S. Pat. Nos. 3,674,478, 3,932,480, 3,993,661, JP-A Nos. 57-135944, 57-135945 (U.S. Pat. No. 4,420,554), 57-136640, 61-196239, 61-196240 (U.S. Pat. No. 4,702,999), 61-185743, 61-124941 (U.S. Pat. No. 4,639,408), JP-A No. 2-280140 and the like, a blocking group utilizing an intramolecular nucleophilic substitution reaction described in U.S. Pat. Nos. 4,358,525 and 4,330,617, JP-A Nos. 55-53330 (U.S. Pat. No. 4,310,612), 59-121328, 59-218439, and 63-318555 (European Patent Application Laid-Open (EP-A) No. 0295729), and the like, a block group utilizing a ring cleavage reaction of 5- or 6-membered ring described in JP-A Nos. 57-76541 (U.S. Pat. No. 4,335,200), 57-135949 (U.S. Pat. No. 4,350,752), 57-179842, 59-137945, 59-140445, 59-219741, 59-202459, 60-41034 (U.S. Pat. No. 4,618,563), 62-59945 (U.S. Pat. No. 4,888,268), 62-65039 (U.S. Pat. No. 4,772,537), 62-80647, 3-236047, and 3-238445 and the like, a block group utilizing an addition reaction of a nucleophile to a conjugated unsaturated bond described in JP-A Nos. 59-201057 (U.S. Pat. No. 4,518,685), 61-43739 (U.S. Pat. No. 4,659,651), 61-95346 (U.S. Pat. No. 4,690,885), 61-95347 (U.S. Pat. No. 4,892,811), 64-7035, 4-42650 (U.S. Pat. No. 5,066,573), 1-245255, 2-207249, 2-235055 (U.S. Pat. No. 5,118,596), and 4-186344 and the like, a block group utilizing a β-elimination reaction described in JP-A Nos. 59-93442, 61-32839, and 62-163051, JP-B No. 5-37299, and the like, a block group utilizing a nucleophilic substitution reaction of diarylmethanes described in JP-A No. 61-188540, a block group utilizing the Rossen's transition reaction described in JP-A No. 62-187850, a block group utilizing the reaction of N-acyl compound of thiazolidine-2-thione and amines described in JP-A Nos. 62-80646, 62-144163, and 62-147457 and the like, a block group, which has two electrophilic groups and reacts with a dinucleophilic agent, described in JP-A Nos. 2-296240 (U.S. Pat. No. 5,019,492), 4-177243, 4-177244, 4-177245, 4-177246, 4-177247 4-177248, 4-177249, 4-179948, 4-184337, and 4-184338, WO No. 92/21064, JP-A No. 4-330438, WO No. 93/03419, JP-A No. 5-45816, and the like, and a block group described in JP-A Nos. 3-236047, 3-238445 can be described. Among these block groups, the block group having two electrophilic groups which reacts with a dinucleophilic agent, described in JP-A Nos. 2-296240 (U.S. Pat. No. 5,019,492), 4-177243, 4-177244, 4-177245, 4-177246, 4-177247 4-177248, 4-177249, 4-179948, 4-184337, and 4-184338, WO No. 92/21064, JP-A No. 4-330438, WO No. 93/03419, JP-A No. 5-45816, and the like is particularly preferable.

Specific examples of the timing group part excluding BLK from the group represented by formula (T-1) are shown below. In the following, * denotes a bond with BLK at this position and ** denotes a bond with —O—CO— at this position.

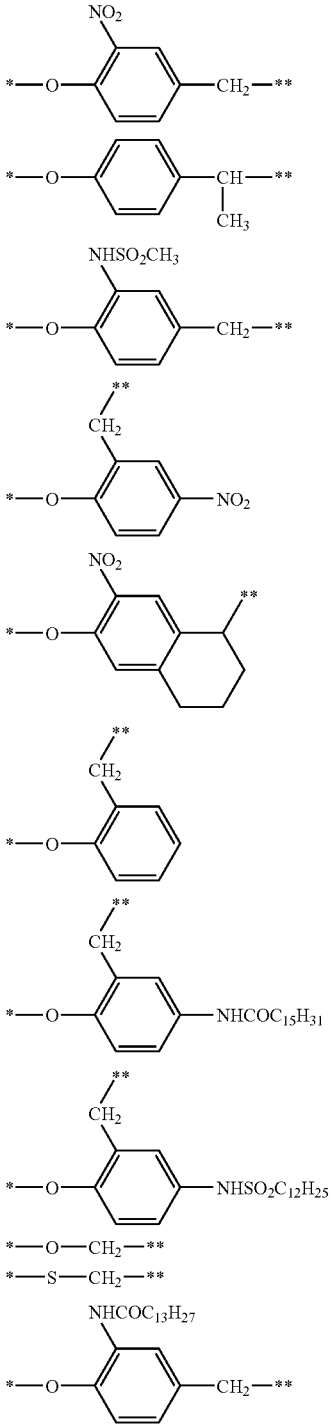

-continued

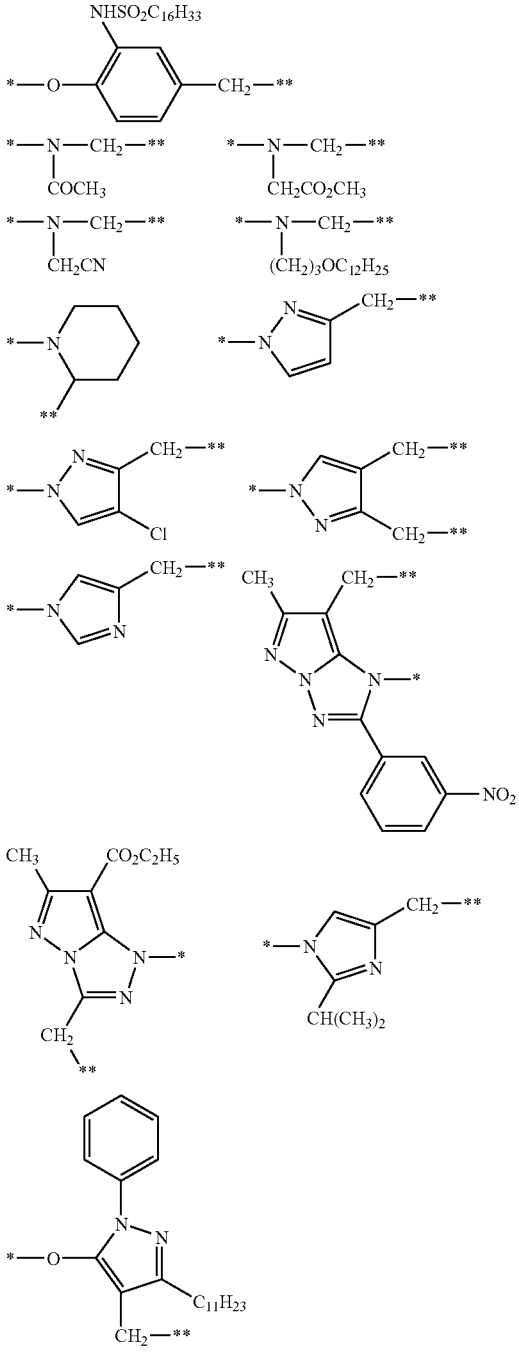

$R_{12}$ and $R_{13}$ are preferably an alkyl group or an aryl group, and $R_{14}$ is preferably an aryl group. $R_{15}$ is preferably a block group and preferable block groups are the same as those of preferable BLK among the groups represented by the above-mentioned formula (T-1). $R_{16}$, $R_{17}$, and $R_{18}$ are preferably a hydrogen atom.

As the compound represented by formula (I) used in the present invention, the compounds described in U.S. Pat. Nos. 5,242,783 and 4,426,441, and JP-A Nos. 62-227141, 5-257225, 5-249602, 6-43607, and 7-333780 are also preferable.

(Reducing Agent: Compound Represented by Formula (II))

Formula (II)

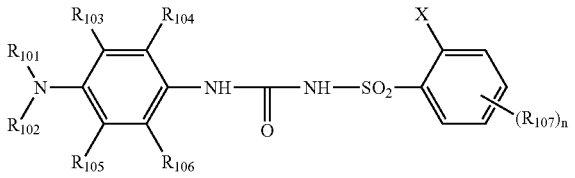

In formula (II), $R_{101}$ and $R_{102}$ each independently represent a substituted or unsubstituted alkyl group, aryl group, heterocyclic group, acyl group, alkylsulfonyl group, or arylsulfonyl group. $R_{103}$, $R_{104}$, $R_{105}$, $R_{106}$, and $R_{107}$ each independently represent a hydrogen atom or a substituent. Members in at least one combination of $R_{101}$ and $R_{102}$, $R_{103}$ and $R_{104}$, $R_{105}$ and $R_{106}$, and $R_{107}$ and X may bond to each other to form a 5-, 6-, or 7-membered ring. X represents a halogen atom or a substituent having a heteroatom through which the substituent bonds to the benzene ring. n represents an integer of from 0 to 4, and when n represents 2 or more, a plurality of $R_{107}$ may be the same or different from one another and may bond to each other to form a 5-, 6-, or 7-membered ring.

In formula (II), $R_{103}$, $R_{104}$, $R_{105}$, $R_{106}$, and $R_{107}$ each independently represent a hydrogen atom or a substituent. Preferable substituents represented by $R_{103}$, $R_{104}$, $R_{105}$, $R_{106}$, and $R_{107}$ are described below.

(1) Halogen Atom

For example, a chlorine atom, a bromine atom, an iodine atom, and the like.

(2) Alkyl Group

Substituted or unsubstituted, linear, branched, and cyclic alkyl groups.

<Substituted or Unsubstituted, Linear or Branched Alkyl Group>

Preferably, having 1 to 30 carbon atoms, for example, a methyl group, an ethyl group, a n-propyl group, an isopropyl group, a t-butyl group, a n-octyl group, an eicosyl group, a 2-chloroethyl group, a 2-cyanoethyl group, a 2-ethylhexyl group, and the like.

<Substituted or Unsubstituted Cyclic Alkyl Group>

A cycloalkyl group (preferably, a substituted or unsubstituted cycloalkyl group having 3 to 30 carbon atoms; for example, a cyclohexyl group, a cyclopentyl group, a 4-n-dodecylcyclohexyl group, and the like), a bicycloalkyl group (preferably, a substituted or unsubstituted bicycloalkyl group having 5 to 30 carbon atoms, namely, a monovalent group obtained by removing one hydrogen atom from bicycloalkane having 5 to 30 carbon atoms; for example, a bicyclo[1,2,2]heptan-2-yl group, a bicyclo[2,2,2]octan-3-yl group, and the like), furthermore including a tricyclo structure and the alkyl group included in the substituents explained below (for example, the alkyl group of an alkylthio group and the like).

(3) Alkenyl Group

Substituted or unsubstituted linear, branched, and cyclic alkenyl groups.

<Linear, or Branched Alkenyl Group>

Preferably, a substituted or unsubstituted alkenyl group having 2 to 30 carbon atoms, for example, a vinyl group, an allyl group, a prenyl group, a gelanyl group, an oleyl group, and the like.

<Cycloalkenyl Group>

Preferably, a substituted or unsubstituted cycloalkenyl group having 3 to 30 carbon atoms, namely, a monovalent group obtained by removing one hydrogen atom from cycloalkene having 3 to 30 carbon atoms. For example, a 2-cyclopenten-1-yl group, a 2-cyclohexen-1-yl group, and the like.

<Bicycloalkenyl Group>

A substituted or unsubstituted bicycloalkenyl group, preferably, a substituted or unsubstituted bicycloalkenyl group having 5 to 30 carbon atoms, namely, a monovalent group obtained by removing one hydrogen atom from bicycloalkene having one double bond. For example, a bicyclo[2,2,1]hepto-2-en-1-yl group, a bicyclo[2,2,2]octo-2-en-4-yl group, and the like.

(4) Alkynyl Group

Preferably, a substituted or unsubstituted alkynyl group having 2 to 30 carbon atoms, for example, an ethynyl group, a propargyl group, a trimethylsilylethynyl group, and the like.

(5) Aryl Group

Preferably, a substituted or unsubstituted aryl group having 6 to 30 carbon atoms, for example, a phenyl group, a p-tolyl group, a naphthyl group, a m-chlorophenyl group, an o-hexadecanoylaminophenyl group, and the like.

(6) Heterocyclic Group

Preferably, a monovalent group obtained by removing one hydrogen atom from 5- or 6-membered and a substituted or unsubstituted, aromatic or non-aromatic heterocyclic compound, and more preferably, a 5- or 6-membered aromatic heterocyclic group having 3 to 30 carbon atoms. For example, a 2-furyl group, a 2-thienyl group, a 2-pyrimidinyl group, a 2-benzothiazolyl group, and the like.

(7) Cyano Group, Hydroxy Group, Nitro Group, and Carboxy Group (8) Alkoxy Group

Preferably, a substituted or unsubstituted alkoxy group having 1 to 30 carbon atoms, for example, a methoxy group, an ethoxy group, an isopropoxy group, a t-butoxy group, a n-octyloxy group, a 2-methoxyethoxy group, and the like.

(9) Aryloxy Group

Preferably, a substituted or unsubstituted aryloxy group having 6 to 30 carbon atoms, for example, a phenoxy group, a 2-methoxyphenoxy group, a 4-t-butylphenoxy group, a 3-nitrophenoxy group, a 2-tetradecanoylaminophenoxy group, and the like.

(10) Silyloxy Group

Preferably, a silyloxy having 2 to 20 carbon atoms, for example, a trimethylsilyloxy group, a t-butyldimethylsilyloxy group, and the like.

(11) Heterocyclic Oxy Group

Preferably, a substituted or unsubstituted heterocyclic oxy group having 2 to 30 carbon atoms, for example, a 1-phenyltetrazole-5-oxy group, a 2-tetrahydropyranyloxy group, and the like.

(12) Acyloxy Group

Preferably, a formyloxy group, a substituted or unsubstituted alkylcarbonyloxy group having 2 to 30 carbon atoms, a substituted or unsubstituted arylcarbonyloxy group, and the like. For example, an acetyloxy group, a pivaloyloxy group, a stearoyloxy group, a benzoyloxy group, a p-methoxyphenylcarbonyloxy group, and the like.

(13) Carbamoyloxy Group

Preferably, a substituted or unsubstituted carbamoyloxy group having 1 to 30 carbon atoms, for example, an N,N-dimethylcarbamoyloxy group, an N,N-diethylcarbamoyloxy group, a morpholinocarbonyloxy group, an N,N-di-n-octylaminocarbonyloxy group, an N-n-octylcarbamoyloxy group, and the like.

(14) Alkoxycarbonyloxy Group

Preferably, a substituted or unsubstituted alkoxycarbonyloxy group having 2 to 30 carbon atoms, for example, a methoxycarbonyloxy group, an ethoxycarbonyloxy group, a t-butoxycarbonyloxy group, a n-octylcarbonyloxy group, and the like.

(15) Aryloxycarbonyloxy Group

Preferably, a substituted or unsubstituted aryloxycarbonyloxy group having 7 to 30 carbon atoms, for example, a phenoxycarbonyloxy group, a p-methoxyphenoxycarbonyloxy group, a p-n-hexadecyloxyphenoxycarbonyloxy group, and the like.

(16) Amino Group

Preferably, an amino group, a substituted or unsubstituted alkylamino group having 1 to 30 carbon atoms, and a substituted or unsubstituted anilino group having 6 to 30 carbon atoms. For example, an amino group, a methylamino group, a dimethylamino group, an anilino group, an N-methyl-anilino group, a diphenylamino group, and the like.

(17) Acylamino Group

Preferably, a formylamino group, a substituted or unsubstituted alkylcarbonylamino group having 1 to 30 carbon atoms and a substituted or unsubstituted arylcarbonylamino group having 6 to 30 carbon atoms. For example, a formylamino group, an acetylamino group, a pivaloylamino group, a lauroylamino group, a benzoylamino group, a 3,4,5-tri-n-octyloxyphenylcarbonylamino group, and the like.

(18) Aminocarbonylamino Group

Preferably, a substituted or unsubstituted aminocarbonylamino group having 1 to 30 carbon atoms, for example, a carbamoylamino group, an N,N-dimethylaminocarbonylamino group, an N,N-diethylaminocarbonylamino group, a morpholinocarbonylamino group, and the like.

(19) Alkoxycarbonylamino Group

Preferably, a substituted or unsubstituted alkoxycarbonylamino group having 2 to 30 carbon atoms, for example, a methoxycarbonylamino group, an ethoxycarbonylamino group, a t-butoxycarbonylamino group, a n-octadecyloxycarbonylamino group, an N-methylmethoxycarbonylamino group, and the like.

(20) Aryloxycarbonylamino Group

Preferably, a substituted or unsubstituted aryloxycarbonylamino group having 7 to 30 carbon atoms, for example, a phenoxycarbonylamino group, a p-chlorophenoxycarbonylamino group, a m-n-octyloxyphenoxycarbonylamino group, and the like.

(21) Sulfamoylamino Group

Preferably, a substituted or unsubstituted sulfamoylamino group having 0 to 30 carbon atoms, for example, a sulfamoylamino group, an N,N-dimethylaminosulfonylamino group, an N-n-octylaminosulfonylamino group, and the like.

(22) Alkylsulfonylamino Group and Arylsulfonylamino Group

Preferably, a substituted or unsubstituted alkylsulfonylamino group having 1 to 30 carbon atoms and a substituted or unsubstituted arylsulfonylamino group having 6 to 30 carbon atoms. For example, a methylsulfonylamino group, a butylsulfonylamino group, a phenylsulfonylamino group, a 2,3,5-trichlorophenylsulfonylamino group, a p-methylphenylsulfonylamino group, and the like.

(23) Mercapto Group

(24) Alkylthio Group

Preferably, a substituted or unsubstituted alkylthio group having 1 to 30 carbon atoms, for example, a methylthio group, an ethylthio group, a n-hexadecylthio group, and the like.

(25) Arylthio Group

Preferably, a substituted or unsubstituted arylthio group having 6 to 30 carbon atoms, for example, a phenylthio group, a p-chlorophenylthio group, a m-methoxyphenylthio group, and the like.

(26) Heterocyclic Thio Group

Preferably, a substituted or unsubstituted heterocyclic thio group having 2 to 30 carbon atoms, for example, a 2-benzothiazolylthio group, a 1-phenyltetrazol-5-ylthio group, and the like.

(27) Sulfamoyl Group

Preferably, a substituted or unsubstituted sulfamoyl group having 0 to 30 carbon atoms, for example, an N-ethylsulfamoyl group, an N-(3-dodecyloxypropyl)sulfamoyl group, an N,N-dimethylsulfamoyl group, an N-acetylsulfamoyl group, an N-benzoylsulfamoyl group, an N—(N'-phenylcarbamoyl)sulfamoyl group, and the like.

(28) Sulfo Group

(29) Alkylsulfinyl Group and Arylsulfinyl Group

Preferably, a substituted or unsubstituted alkylsulfinyl group having 1 to 30 carbon atoms and a substituted or unsubstituted arylsufinyl group having 6 to 30 carbon atoms. For example, a methylsulfinyl group, an ethylsulfinyl group, a phenylsulfinyl group, a p-methylphenylsulfinyl group, and the like.

(30) Alkylsulfonyl Group and Arylsulfonyl Group

Preferably, a substituted or unsubstituted alkylsulfonyl group having 1 to 30 carbon atoms and a substituted or unsubstituted arylsufonyl group having 6 to 30 carbon atoms. For example, a methylsulfonyl group, an ethylsulfonyl group, a phenylsulfonyl group, a p-methylphenylsulfonyl group, and the like.

(31 ) Acyl Group

Preferably, a formyl group, a substituted or unsubstituted alkylcarbonyl group having 2 to 30 carbon atoms, a substituted or unsubstituted arylcarbonyl group having 7 to 30 carbon atoms, and the like. For example, an acetyl group, a pivaloyl group, a 2-chloroacetyl group, a stearoyl group, a benzoyl group, a p-n-octyloxyphenylcarbonyl group, and the like.

(32) Alkoxycarbonyl Group

Preferably, a substituted or unsubstituted alkoxycarbonyl group having 2 to 30 carbon atoms, for example, a methoxycarbonyl group, an ethoxycarbonyl group, a t-butoxycarbonyl group, a n-octadecyloxycarbonyl group, and the like.

(33) Aryloxycarbonyl Group

Preferably, a substituted or unsubstituted aryloxycarbonyl group having 7 to 30 carbon atoms, for example, a phenoxycarbonyl group, an o-chlorophenoxycarbonyl group, a m-nitrophenoxycarbonyl group, a p-t-butylphenoxycarbonyl group, and the like.

(34) Carbamoyl Group

Preferably, a substituted or unsubstituted carbamoyl group having 1 to 30 carbon atoms, for example, a carbamoyl group, an N-methylcarbamoyl group, an N,N-dimethylcarbamoyl group, an N,N-di-n-octylcarbamoyl group, an N-(methylsulfonyl)carbamoyl group, and the like.

(35) Arylazo Group and Heterocyclic Azo Group

Preferably, a substituted or unsubstituted arylazo group having 6 to 30 carbon atoms and a substituted or unsubstituted heterocyclic azo group having 3 to 30 carbon atoms. For example, a phenylazo group, a p-chlorophenylazo group, a 5-ethylthio-1,3,4-thiadiazol-2-ylazo group, and the like.

(36) Imide Group

For example, an N-succinimide, an N-phthalimide group, and the like.

(37) Phosphino Group

Preferably, a substituted or unsubstituted phosphino group having 2 to 30 carbon atoms, for example, a dimethylphosphino group, a diphenylphosphino group, a methylphenoxyphosphino group, and the like.

(38) Phosphinyl Group

Preferably, a substituted or unsubstituted phosphinyl group having 2 to 30 carbon atoms, for example, a phosphinyl group, a dioctyloxyphosphinyl group, a diethoxyphosphinyl group, and the like.

(39) Phosphinyloxy Group

Preferably, a substituted or unsubstituted phosphinyloxy group having 2 to 30 carbon atoms, for example, a diphenoxyphosphinyloxy group, a dioctyloxyphosphinyloxy group, and the like.

(40) Phosphinylamino Group

Preferably, a substituted or unsubstituted phosphinylamino group having 2 to 30 carbon atoms, for example, a dimethoxyphosphinylamino group, a dimethylaminophosphinylamino group, and the like.

(41) Silyl Group

Preferably, a substituted or unsubstituted silyl group having 3 to 30 carbon atoms, for example, a trimethylsilyl group, a t-butyldimethylsilyl group, a phenyldimethylsilyl group, and the like.

Among these, $R_{103}$, $R_{104}$, $R_{105}$, $R_{106}$, and $R_{107}$ are more preferably a hydrogen atom, a halogen atom, an alkyl group, an aryl group, a cyano group, a hydroxy group, a nitro group, a carboxy group, an alkoxy group, an aryloxy group, an acyloxy group, an acylamino group, an alkylsulfonylamino group, an arylsulfonylamino group, an alkylthio group, an arylthio group, a sulfamoyl group, a sulfo group, an alkoxycarbonyl group, an aryloxycarbonyl group, a carbamoyl group, an alkylsulfonyl group, or an arylsulfonyl group, and even more preferably a hydrogen atom, a halogen atom, an alkyl group, an alkoxy group, an acylamino group, an alkylsulfonylamino group, an arylsulfonylamino group, an alkylthio group, an arylthio group, a sulfamoyl group, a sulfo group, an alkoxycarbonyl group, a carbamoyl group, an alkylsulfonyl group, or an arylsulfonyl group. Particularly preferably, one of $R_{104}$ or $R_{106}$ from among $R_{103}$, $R_{104}$, $R_{105}$, $R_{106}$, and $R_{107}$ is a hydrogen atom.

When the group represented by $R_{103}$, $R_{104}$, $R_{105}$, $R_{106}$, or $R_{107}$ is a group capable of being further substituted, the group represented by $R_{103}$, $R_{104}$, $R_{105}$, $R_{106}$, or $R_{107}$ may further have a substituent and in that case, preferable substituents may be the same as the substituents explained in the column of $R_{103}$, $R_{104}$, $R_{105}$, $R_{106}$, and $R_{107}$ . When the group represented by $R_{103}$, $R_{104}$, $R_{105}$, $R_{106}$, or $R_{107}$ is substituted by two or more substituents, those substituents may be the same or different.

$R_{101}$ and $R_{102}$ each independently represent an alkyl group, an aryl group, a heterocyclic group, an acyl group, an alkylsulfonyl group, or an arylsulfonyl group. Preferable ranges of these groups are the same as the alkyl group, aryl group, heterocyclic group, acyl group, alkylsulfonyl group or arylsulfonyl group explained in the above explanation of the substituents represented by $R_{103}$, $R_{104}$, $R_{105}$, $R_{106}$ and $R_{107}$. $R_{101}$ and $R_{102}$ are preferably an alkyl group, an aryl group, or a heterocyclic group, and most preferably an alkyl group. When the group represented by $R_{101}$ or $R_{102}$ is capable of being further substituted, the group represented by $R_{101}$ and $R_{102}$ may further have a substituent and in that case, preferable substituent is similar to the substituents explained in $R_{103}$, $R_{104}$, $R_{105}$, $R_{106}$, and $R_{107}$. When the group represented by $R_{101}$ or $R_{102}$ is substituted by two or more substituents, those substituents may be the same or different.

Members in at least one combination of $R_{101}$ and $R_{102}$, $R_{103}$ and $R_{104}$, $R_{105}$ and $R_{106}$, and $R_{107}$ and X may bond to each other to form a 5-, 6-, or 7-membered ring.

X represents a halogen atom or a substituent having a heteroatom through which the substituent bonds to the benzene ring. Here, the heteroatom is an atom other than a carbon atom, for example, oxygen, nitrogen, sulfur, or the like. X is preferably a halogen atom, a hydroxy group, a nitro group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an arylazo group, a heterocyclic azo group, an imide group, a phosphino group, a phosphinyl group, a phosphinyloxy group, a phosphinylamino group, a silyl group, and the like. Preferable ranges of these groups are the same as those of the halogen atom, alkoxy group, aryloxy group, silyloxy group, heterocyclic oxy group. acyloxy group, carbamoyloxy group, alkoxycarbonyloxy group, aryloxycarbonyloxy group, acylamino group, aminocarbonylamino group, alkoxycarbonylamino group, aryloxycarbonylamino group, sulfamoylamino group, alkylsulfonylamino group, arylsulfonylamino group, alkylthio group, arylthio group, heterocyclic thio group, sulfamoyl group, alkylsulfinyl group, arylsulfinyl group, alkylsulfonyl group, arylsulfonyl group, arylazo group, heterocyclic azo group, imide group, phosphino group, phosphinyl group, phosphinyloxy group, phosphinylamino group, sily group, and the like explained in the column of the substituents represented by $R_{103}$, $R_{104}$, $R_{105}$, $R_{106}$, and $R_{107}$.

X is preferably a halogen atom, a hydroxy group, an alkoxy group, an aryloxy group, a silyloxy group, a heterocyclic oxy group, a carbamoyloxy group, an amino group, an acylamino group, an aminocarbonylamino group, an alkoxycarbonylamino group, an alkylsulfonylamino group, an arylsulfonylamino group, a mercapto group, an alkylthio group, a sulfamoyl group, an alkylsulfonyl group, an arylsulfonyl group, or a silyl group, and more preferably, a halogen atom, a hydroxy group, an alkoxy group, an acylamino group, an aminocarbonylamino group, an alkoxycarbonylamino group, an alkylsulfonylamino group and arylsulfonylamino group.

n represents an integer of from 0 to 4. When n is two or more, a plurality of $R_{107}$ may be the same or different and may bond to each other to form a 5-, 6-, or 7-membered ring.

(Reducing Agent: Compound Represented by Formula (III))

The compound represented by formula (III) of the present invention is explained below in detail.

Formula (III)

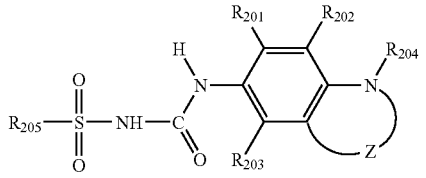

In formula (III), $R_{201}$, $R_{202}$, and $R_{203}$ each independently represent a hydrogen atom or a substituent. $R_{204}$ represents one selected from an alkyl group, an aryl group, or a heterocyclic group. Members in at least one combination of $R_{201}$ and $R_{202}$, and $R_{202}$ and $R_{204}$ may bond to each other to form a 5-, 6-, or 7-membered ring. Z represents a non-metallic atomic group for forming a 5-, 6-, or 7-membered ring together with a nitrogen atom and two carbon atoms in a benzene ring, and $R_{205}$ represents one selected from an alkyl group, an aryl group, or a heterocyclic group. However, no hydroxy group, carboxy group, or sulfo group is contained in any of $R_{201}$ to $R_{204}$.

$R_{201}$, $R_{202}$, and $R_{203}$ each independently represent a hydrogen atom or a substituent. As the substituent represented by $R_{201}$, $R_{202}$, and $R_{203}$, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a nitro group, an alkoxy group, aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, an heterocyclic azo group, an imide group, a phosphino group, a phosphinyl group, a phosphinyloxy group, a phosphinylamino group, a silyl group, and the like can be described.

Further in detail, a halogen atom (for example, a chlorine atom, a bromine atom, and an iodine atom), an alkyl group [represents a substituted or unsubstituted, linear, branched, or cyclic alkyl group; an alkyl group (preferably, an alkyl group having 1 to 30 carbon atoms, for example, methyl, ethyl, n-propyl, isopropyl, t-butyl, n-octyl, eicosyl, 2-chloroethyl, 2-cyanoethyl, and 2-ethylhexyl), a cycloalkyl group (preferably, a substituted or unsubstituted cycloalkyl group having 3 to 30 carbon atoms, for example, cyclohexyl, cyclopentyl, and 4-n-dodecylcyclohexyl), a bicycloalkyl group (preferably, a substituted or unsubstituted bicycloalkyl group having 5 to 30 carbon atoms namely, that is a monovalent group obtained by removing one hydrogen atom from bicycloalkane having 5 to 30 carbon atoms; for example, bicyclo[1,2,2]heptan-2-yl, bicyclo[2,2,2]octan-3-yl) and further tricycle structure having many cyclic structures are included; an alkyl group included in a substituent described below (for example, an alkyl group in an alkylthio group) also represents the alkyl group of this concept], an alkenyl group [represents a substituted or unsubstituted, linear, branched, or cyclic alkenyl group; an alkenyl group (preferably, a substituted or unsubstituted alkenyl group having 2 to 30 carbon atoms; for example, vinyl, allyl, prenyl, gelanyl, and oleyl), a cycloalkenyl group (preferably, a substituted or unsubstituted cycloalkenyl group having 3 to 30 carbon atoms, namely, a monovalent group obtained by removing one hydrogen atom from cycloalkene having 3 to 30 carbon atoms; for example, 2-cyclopenten-1-yl and 2-cyclohexen-1-yl), a bicycloalkenyl group (a substituted or unsubstituted bicycloalkenyl group, preferably a substituted or unsubstituted bicycloalkenyl group having 5 to 30 carbon atoms, namely, a monovalent group obtained by removing one hydrogen atom from bicycloalkene having one double bond; for example, bicyclo[2,2,1]hepto-2-en-1-yl and bicyclo[2,2,2]octo-2-en-4-yl)], an alkynyl group (preferably, a substituted or unsubstituted alkynyl group having 2 to 30 carbon atoms; for example, ethynyl, propargyl, and trimethylsilylethynyl), an aryl group (preferably, a substituted or unsubstituted aryl group having 6 to 30 carbon atoms; for example, phenyl, p-tolyl, naphthyl, m-chlorophenyl, and o-hexadecanoylaminophenyl), a heterocyclic group (preferably, a monovalent group obtained by removing one hydrogen atom from a 5- or 6-membered, substituted or unsubstituted, or aromatic or non-aromatic heterocyclic compound, and more preferably, a 5- or 6-membered aromatic heterocyclic group having 3 to 30 carbon atoms; for example, 2-furyl, 2-thienyl, 2-pyrimidinyl, and 2-benzothiazolyl), a cyano group, a nitro group, an alkoxy group (preferably, a substituted or unsubstituted alkoxy group having 1 to 30 carbon atoms; for example, methoxy, ethoxy, isopropoxy, t-butoxy, n-octyloxy, and 2-methoxyethoxy), an aryloxy group (preferably, a substituted or unsubstituted aryloxy group having 6 to 30 carbon atoms; for example, phenoxy, 2-methylphenoxy, 4-t-butylphenoxy, 3-nitrophenoxy, and 2-tetradecanoylaminophenoxy), a silyloxy group (preferably, a substituted or unsubstituted silyloxy group having 3 to 20 carbon atoms; for example, trimethylsilyloxy and t-butyldimethylsilyloxy), a heterocyclic oxy group (preferably, a substituted or unsubstituted heterocyclic oxy group having 2 to 30 carbon atoms; for example, 1-phenyltetrazole-5-oxy and 2-tetrahydropyranyloxy), an acyloxy group (preferably, a formyloxy group, a substituted or unsubstituted alkylcarbonyloxy group having 2 to 30 carbon atoms, and a substituted or unsubstituted arylcarbonyloxy group having 6 to 30 carbon atoms; for example, formyloxy, acetyloxy, pivaloyloxy, stearoyloxy, benzoyloxy, and p-methoxyphenylcarbonyloxy), a carbamoyloxy group (preferably, a substituted or unsubstituted carbamoyloxy group having 1 to 30 carbon atoms, for example, N,N-dimethylcarbamoyloxy, N,N-diethylcarbamoyloxy, morphorinocarbonyloxy, N,N-di-n-octylaminocarbonyloxy, and N-n-octylcarbamoyloxy), an alkoxycarbonyloxy group (preferably, a substituted or unsubstituted alkoxycarbonyloxy group having 2 to 30 carbon atoms; for example, methoxycarbonyloxy, ethoxycarbonyloxy, t-butoxycarbonyloxy, and n-octylcarbonyloxy), an aryloxycarbonyloxy group (preferably, a substituted or unsubstituted aryloxycarbonyloxy group having 7 to 30 carbon atoms; for example, phenoxycarbonyloxy, p-methoxyphenoxycarbonyloxy, and p-n-hexadecyloxyphenoxycarbonyloxy), an amino group (preferably, an amino group, a substituted or unsubstituted alkylamino group having 1 to 30 carbon atoms, and a substituted or unsubstituted anilino group having 6 to 30 carbon atoms; for example, amino, methylamino, dimethylamino, anilino, N-methyl-anilino, and diphenylamino), an acylamino group (preferably, a formylamino group, a substituted or unsubstituted alkylcarbonylamino group having 1 to 30 carbon atoms, and a substituted or unsubstituted arylcarbonylamino group having 1 to 30 carbon atoms; for example, formylamino, acetylamino, pivaloylamino, lauroylamino, benzoylamino, and 3,4,5-tri-n-octyloxyphenylcarbonylamino), an aminocarbonylamino group (preferably, a substituted or unsubstituted aminocarbonylamino group having 1 to 30 carbon atoms; for example, carbamoylamino, N,N-dimethylaminocarbonylamino, N,N-diethylaminocarbonylamino, and morpholinocarbonylamino), an alkoxycarbonylamino group (preferably, a substituted or unsubstituted alkoxycarbonylamino group having 2 to 30 carbon atoms; for example, methoxycarbonylamino, ethoxycarbonylamino, t-butoxycarbonylamino, n-octadecylcarbonylamino, and N-methyl-methoxycarbonylamino), an aryloxycarbonylamino group (preferably, a substituted or unsubstituted aryloxycarbonylamino group having 7 to 30 carbon atoms; for example, phenoxycarbonylamino, p-chlorophenoxycarbonylamino, and m-n-octyloxyphenoxycarbonylamino), a sulfamoylamino group (preferably, a substituted or unsubstituted sulfamoylamino group having 0 to 30 carbon atoms; for example, sulfamoylamino, N,N-dimethylaminosulfonylamino, and N-n-octylaminosulfonylamino), an alkylsulfonylamino group and an arylsulfonylamino group (preferably, a substituted or unsubstituted alkylsulfonylamino group having 1 to 30 carbon atoms and a substituted or unsubstituted arylsulfonylamino group having 6 to 30 carbon atoms; for example, methylsulfonylamino, butylsulfonylamino, phenylsulfonylamino, 2,3,5-trichlorophenylsulfonylamino, and p-methylphenylsulfonylamino), a mercapto group, an alkylthio group (preferably, a substituted or unsubstituted alkylthio group having 1 to 30 carbon atoms; for example, methylthio, ethylthio, and n-hexadecylthio), an arylthio group (preferably, a substituted or unsubstituted arylthio group having 6 to 30 carbon atoms; for example, phenylthio, p-chlorophenylthio, and m-methoxyphenylthio), a heterocyclic thio group (preferably, a substituted or unsubstituted heterocyclic thio group having 2 to 30 carbon atoms; for example, 2-benzothiazolylthio and 1-phenyltetrazol-5-ylthio a sulfamoyl group (preferably, a substituted or unsubstituted sulfamoyl group having 0 to 30 carbon atoms; for example, N-ethylsulfamoyl, N-(3-dodecyloxypropyl)sulfamoyl, N,N-dimethylsulfamoyl, N-acetylsulfamoyl, N-benzoylsulfamoyl, and N-(N"-phenylcarbamoyl)sulfamoyl), an alkylsulfinyl group and an arylsulfinyl group (preferably, a substituted or unsubstituted alkylsulfinyl group having 1 to 30 carbon atoms and a substituted or unsubstituted arylsulfinyl group having 6 to 30 carbon atoms; for example, methylsulfinyl, ethylsulfinyl, phenylsulfinyl, and p-methylphenylsulfinyl), an alkylsulfonyl group and an arylsulfonyl group (preferably, a substituted or unsubstituted alkylsulfonyl group having 1 to 30 carbon atoms and a substituted or unsubstituted arylsulfonyl group having 6 to 30 carbon atoms; for example, methylsulfonyl, ethylsulfonyl, phenylsulfonyl, and p-methylphenylsulfonyl), an acyl group (preferably, a formyl group, a substituted or unsubstituted alkylcarbonyl group having 2 to 30 carbon atoms, and a substituted or unsubstituted arylcarbonyl group having 7 to 30 carbon atoms; for example, acetyl, pivaloyl, 2-chloroacetyl, stearoyl, benzoyl, and p-n-octyloxyphenylcarbonyl), an aryloxycarbonyl group (preferably, a substituted or unsubstituted aryloxycarbonyl group having 7 to 30 carbon atoms; for example, phenoxycarbonyl, o-chlorophenoxycarbonyl, m-nitrophenoxycarbonyl, and p-t-butylphenoxycarbonyl), an alkoxycarbonyl group (preferably, a substituted or unsubstituted alkoxycarbonyl group having 2 to 30 carbon atoms; for example, methoxycarbonyl, ethoxycarbonyl, t-butoxycarbonyl, and n-octadecyloxycarbonyl), a carbamoyl group (preferably, a substituted or unsubstituted carbamoyl group having 1 to 30 carbon atoms; for example, carbamoyl, N-methylcarbamoyl, N,N-dimethylcarbamoyl, N,N-di-n-octylcarbamoyl, and N-(methylsulfonyl)carbamoyl), an arylazo group and a heterocyclic azo group (preferably, a substituted or unsubstituted arylazo group having 6 to 30 carbon atoms and a substituted or unsubstituted heterocyclic azo group having 3 to 30 carbon atoms; for example, phenylazo, p-chlorophenylazo, and 5-ethylthio-1,3,4-thiadiazol-2-ylazo), an imide group (for example, N-succinimide and N-phthalimide), a phosphino group (preferably, a substituted or unsubstituted phosphino group having 2 to 30 carbon atoms; for example, dimethylphosphino, diphenylphosphino, and methylphenoxyphosphino), a phosphinyl group (preferably, a substituted or unsubstituted phosphinyl group having 2 to 30 carbon atoms; for example, phosphinyl, dioctyloxyphosphinyl, and diethoxyphosphinyl), a phosphinyloxy group (preferably, a substituted or unsubstituted phosphinyloxy group having 2 to 30 carbon atoms; for example, diphenoxyphosphinyloxy and dioctyloxyphosphinyloxy), a phosphinylamino group (preferably, a substituted or unsubstituted phosphinylamino group having 2 to 30 carbon atoms; for example, dimethoxyphosphinylamino and dimethylaminophosphinylamino), a silyl group (preferably, a substituted or unsubstituted silyl group having 3 to 30 carbon atoms; for example, trimethylsilyl, t-butyldimethylsilyl, and phenyldimethylsilyl) are described.

When the group represented by $R_{201}$ to $R_{203}$ is a group capable of being further substituted, the group represented by $R_{201}$ to $R_{203}$ may further have a substituent, and in that case, preferable substituents represent the groups having the same meaning as the substituents explained in $R_{201}$ to $R_{203}$. When the group represented by $R_{201}$ to $R_{203}$ is substituted by two or more substituents, the substituents may be the same or different.

$R_{204}$ and $R_{205}$ each independently represent one selected from an alkyl group, an aryl group, or a heterocyclic group, and preferable ranges of the alkyl group, aryl group, and heterocyclic group represent the groups having the same meaning as the alkyl group, aryl group, and heterocyclic group explained in the substituents represented by $R_{201}$ to $R_{203}$ described above. When the group represented by $R_{204}$ or $R_{205}$ is a group being further substituted, the group represented by $R_{204}$ or $R_{205}$ may further have a substituent, and in that case, preferable substituents represent the groups having the same meaning as the substituents explained in $R_{201}$ to $R_{203}$. When the group represented by $R_{204}$ or $R_{205}$ is substituted by two or more substituents, the substituents may be the same or different.

Members in at least one combination of $R_{201}$ and $R_{202}$, and $R_{202}$ and $R_{204}$ may bond to each other to form a 5-, 6-, or 7-membered carbon ring or heterocycle.

Preferable range of the compound represented by formula (III) is explained below. $R_{201}$ to $R_{203}$ are preferably a hydrogen atom, a halogen atom, an alkyl group, an aryl group, an acylamino group, an alkylsulfonylamino group, an arylsulfonylamino group, an alkoxy group, an aryloxy group, an alkylthio group, an arylthio group, an acyl group, an alkoxycarbonyl group, an aryloxycarbonyl group, a carbamoyl group, a cyano group, a nitro group, a sulfamoyl group, an alkylsulfonyl group, an arylsulfonyl group, or an acyloxy group, and more preferably, a hydrogen atom, a halogen atom, an alkyl group, an acylamino group, an alkylsufonylamino group, an arylsulfonylamino group, an alkoxy group, an alkylthio group, an arylthio group, an alkoxycarbonyl group, a carbamoyl group, a cyano group, a nitro group, a sulfamoyl group, an alkylsulfonyl group, or an arylsulfonyl group.

It is particularly preferred that one of $R_{201}$ or $R_{203}$ is a hydrogen atom. $R_{202}$ is more preferably an alkyl group or an alkoxy group $R_{204}$ is preferably an alkyl group.

Z preferably forms a 1,2,3,4-tetrahydroquinone skeleton or an indoline skeleton together with an adjacent nitrogen atom, and the hydrogen atom of the hydrocarbon which constitutes Z may be substituted by a substituent.

$R_{205}$ is preferably an alkyl group or an aryl group, and more preferably, a substituted phenyl group represented by the following formula (IV)

Formula (IV)

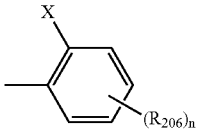

In the formula, X represents a halogen atom or a group which substitutes for a hydrogen atom on a benzene ring through a heteroatom. $R_{206}$ represents a hydrogen atom or a substituent. n represents an integer of from 0 to 4. When n is two or more, a plurality of $R_{206}$ may be the same or different from one another, and two adjacent groups thereamong may bond to each other to form a 5-, to 7-membered carbon ring or heterocycle.

As X, a halogen atom, a hydroxy group, a nitro group, an alkoxy group, aryloxy group, a silyloxy group, a heterocyclic oxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an arylazo group, a heterocyclic azo group, an imide group, a phosphino group, a phosphinyl group, a phosphinyloxy group, a phosphinylamino group, and a silyl group are described. Preferable ranges of these groups are the same as those explained in the substituents represented by $R_{201}$ to $R_{203}$ described above.

As X, more preferred are a halogen atom, a hydroxy group, an alkoxy group, aryloxy group, a silyloxy group, a heterocyclic oxy group, a carbamoyloxy group, an amino group, an acylamino group, an aminocarbonylamino group, an alkoxycarbonylamino group, an alkylsulfonylamino group, an arylsulfonylamino group, a mercapto group, an alkylthio group, a sulfamoyl group, an alkylsulfonyl group, an arylsulfonyl group, and a silyl group, and even more preferred are a halogen atom, a hydroxy group, an alkoxy group, an acylamino group, an aminocarbonylamino group, an alkoxycarbonylamino group, an alkylsulfonylamino group, and an arylsulfonylamino group.

$R_{206}$ preferably represents a substituent, and the substituent represented by $R_{206}$ represents the group having the same meaning as the substituents explained in $R_{201}$ to $R_{203}$.

$R_{206}$ is preferably a halogen atom, an alkyl group, an aryl group, an alkoxy group, an aryloxy group, an amino group, an acylamino group, an aminocarbonylamino group, an alkoxycarbonylamino group, an alkylsulfonylamino group, an arylsulfonylamino group, or an alkylthio group, and more preferably a halogen atom, an alkyl group, an alkoxy group, an acylamino group. n is preferably an integer of from 0 to 3.

In the compound represented by formula (III), it is preferable that the ClogP value of the compound in which $R_{205}$—$SO_2$—NH—CO— is replaced with a hydrogen atom is 3.0 or more. A ClogP value is a calculated value of a water/octanol distribution coefficient of a compound and the inventors of the invention calculated it using Chem Draw Ultra, ver. 5.0, produced by Cambridge Soft Corporation.

Specific examples of the compound represented by formulae (I) to (III) of the present invention are shown below, but the present invention is not limited to these.

(1)

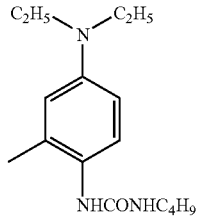

(2)

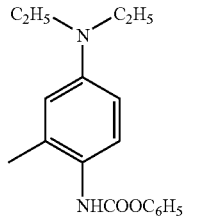

(3)

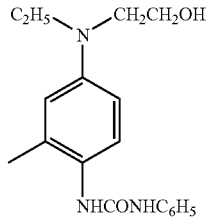

(4)

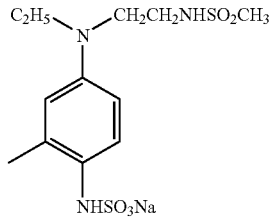

(5)

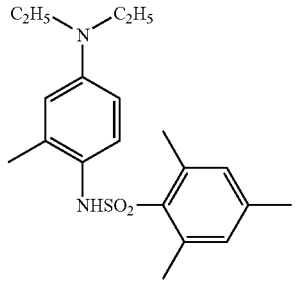

-continued
(6)
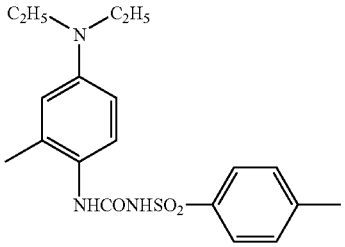
(7)
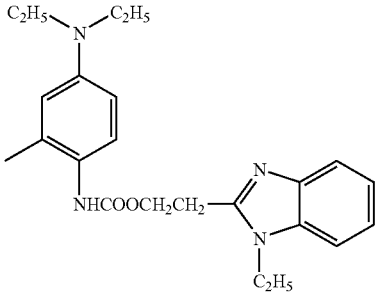
(8)
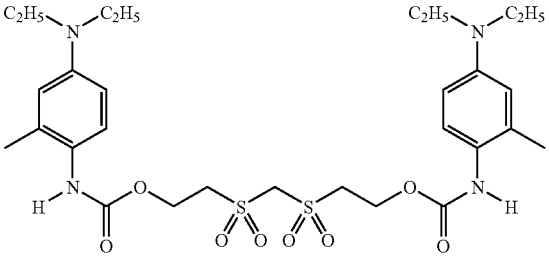
(9)
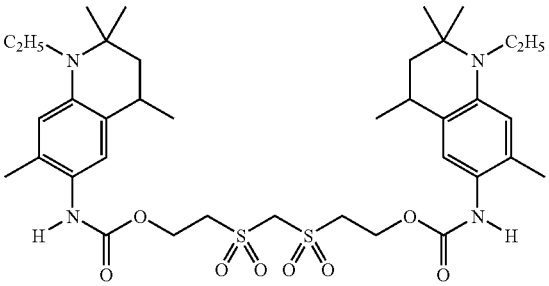
(10)
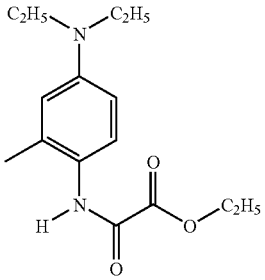
-continued
(11)
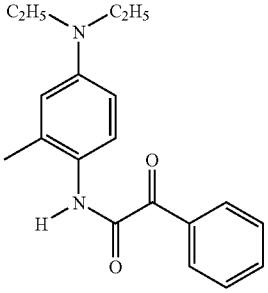
(12)
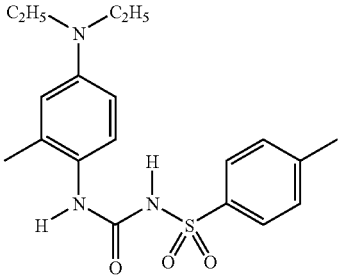
(13)
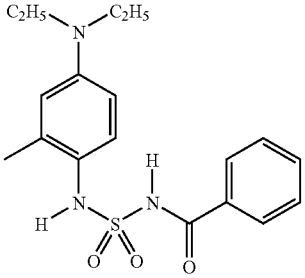
(14)
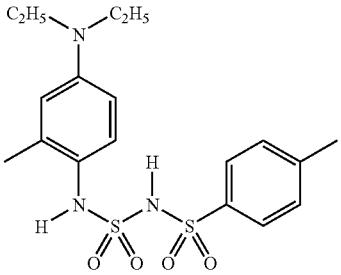
(15)
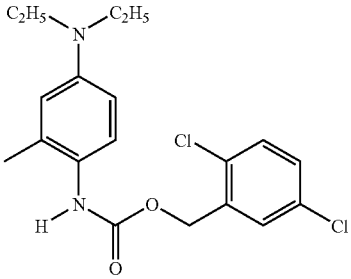

-continued
(16)
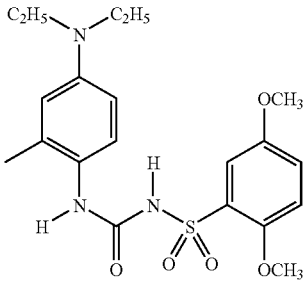
(17)
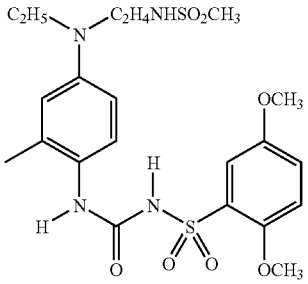
(18)
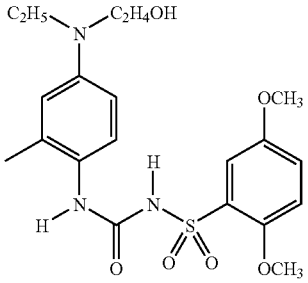
(19)
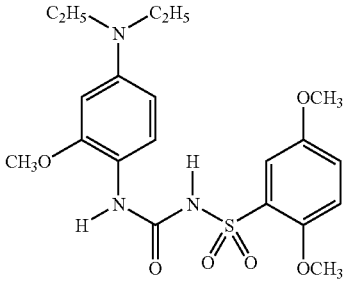
(20)
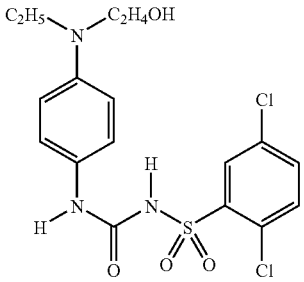
-continued
(21)
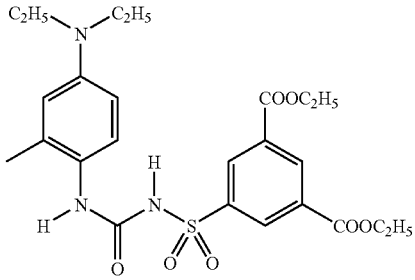
(22)
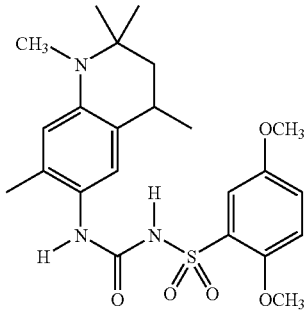
(23)
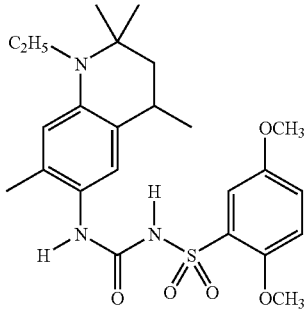
(24)
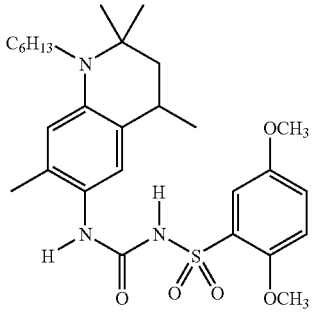
(25)
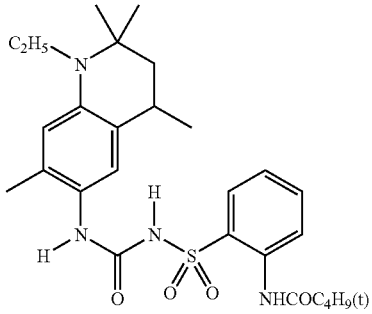

-continued (26)

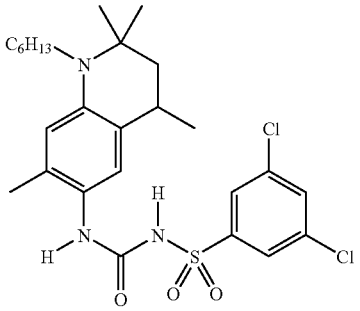

(27)

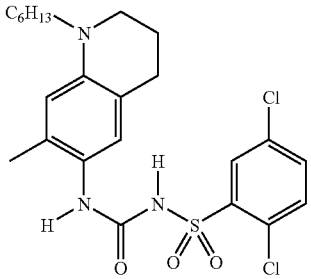

(28)

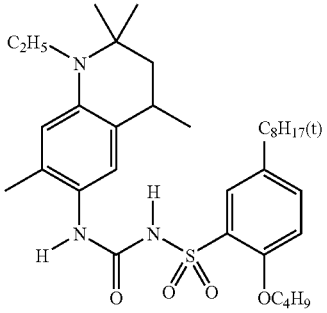

(29)

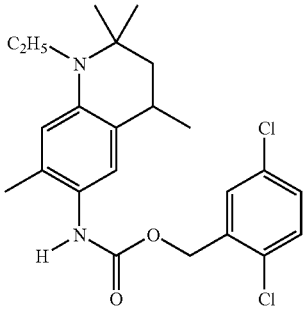

(30)

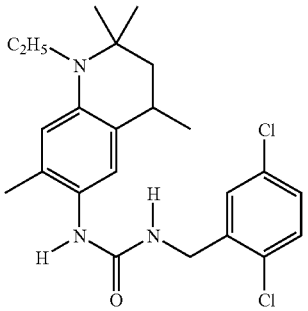

Two or more of the reducing agents represented by formulae (I) to (III) of the present invention may be used in combination in the same image forming layer or different image forming layers. Further, the reducing agent represented by formulae (I) to (III) of the present invention may be used in combination with a color reducing agent other than that of the present invention. As color reducing agents out of the present invention, the compounds described in EP-A Nos. 1,113,322, 1,113,323, 1,113,324, 1,113,325, 1,113,326, 1,158,358, 1,158,359, 1,160,621, 1,164,417, 1,164,418, and 1,168,071, U.S. Pat. No. 6,319,640B1, and WO Nos. 01/96946 and 01/96954 are described. Specifically, for example, the following reducing agents are described.

DEVP-A1

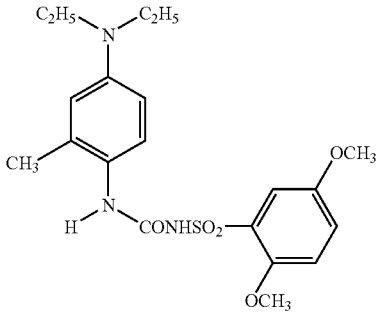

DEVP-A2

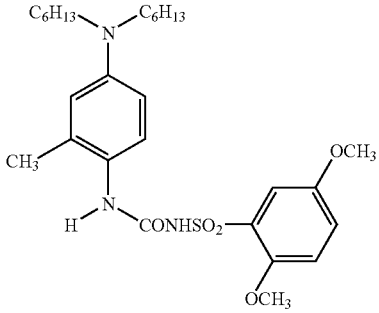

DEVP-A3

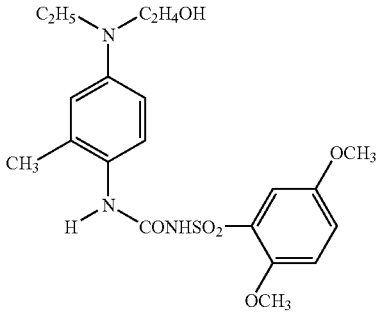

DEVP-A4

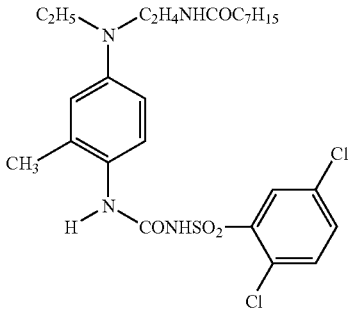

-continued
DEVP-A5
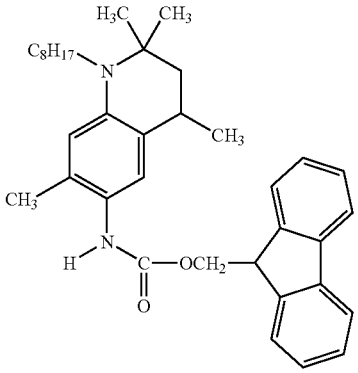
DEVP-A6
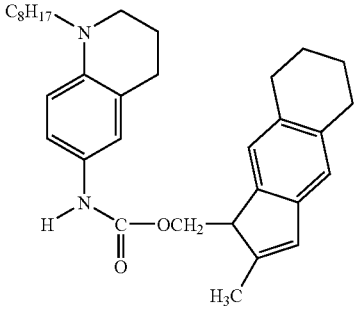
DEVP-A7
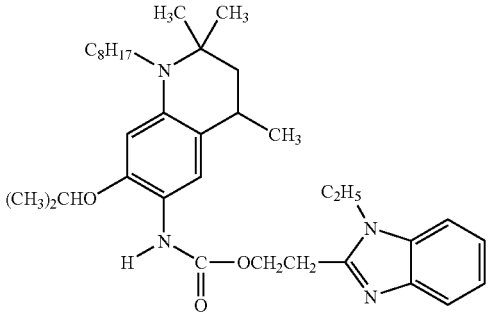
DEVP-A8
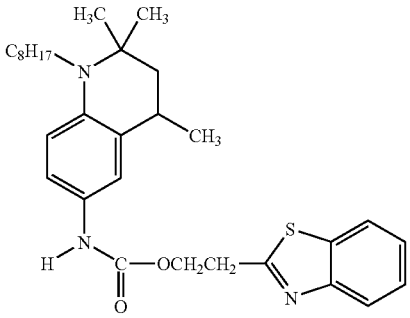
-continued
DEVP-A9
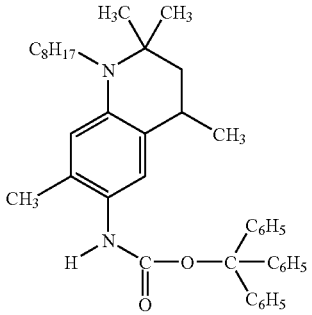
DEVP-A10
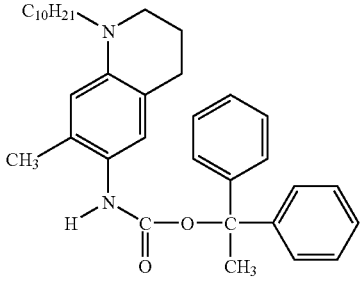
DEVP-A11
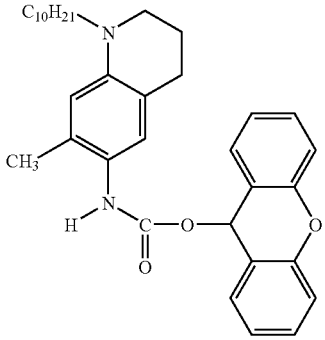
DEVP-A12
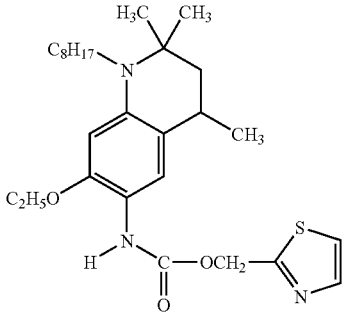
DEVP-A13
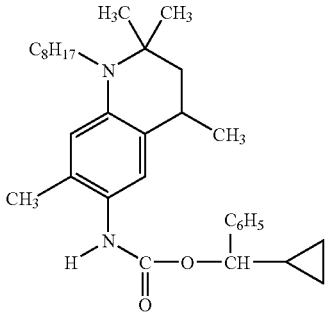

-continued
DEVP-A14
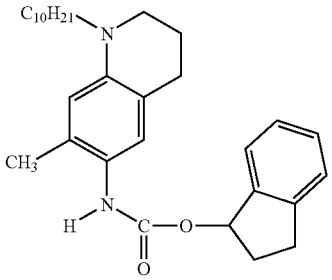
DEVP-A15
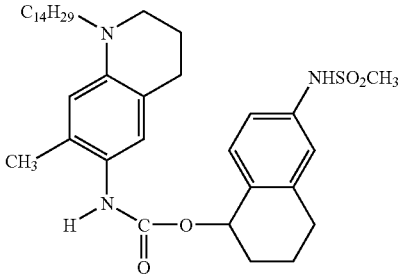
DEVP-A16
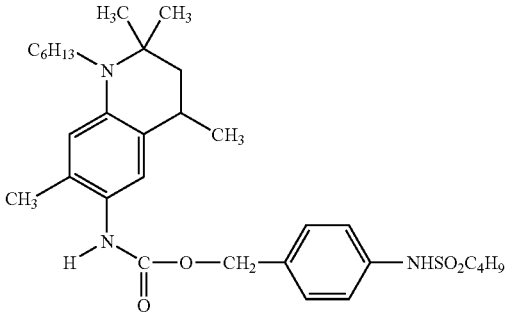
DEVP-A17
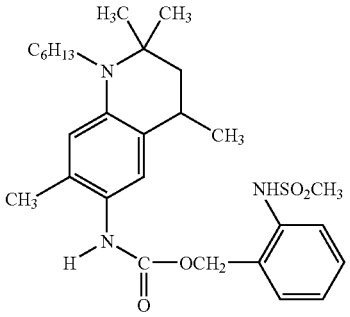
DEVP-A18
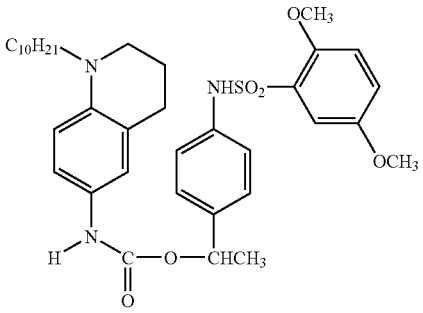
-continued
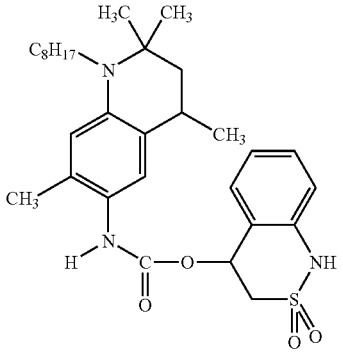
DEVP-A20
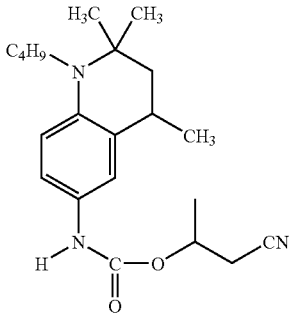
DEVP-A21
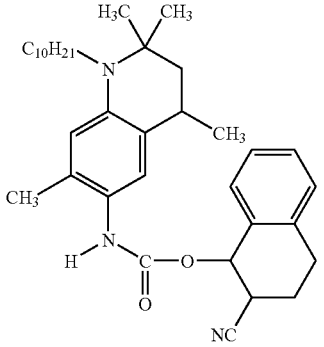
DEVP-A22
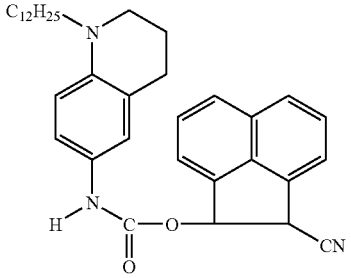

-continued

DEVP-A23

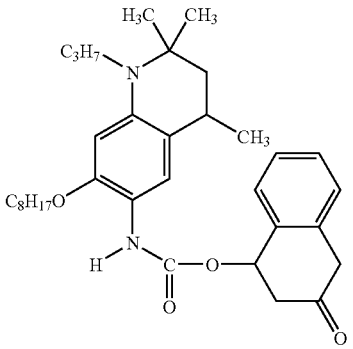

DEVP-A24

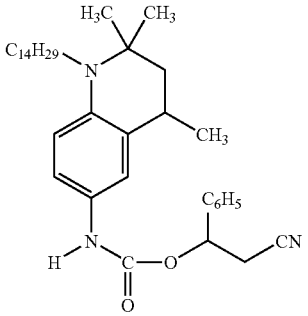

DEVP-A25

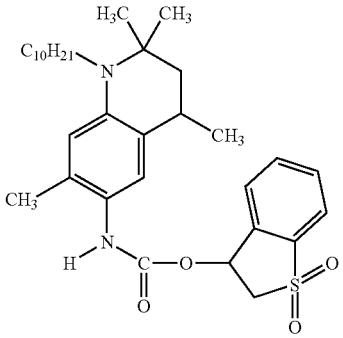

DEVP-A26

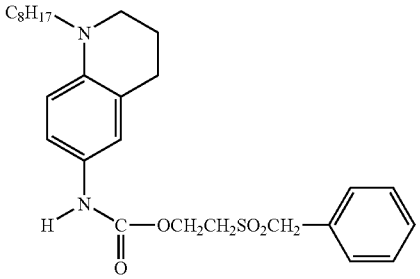

DEVP-A27

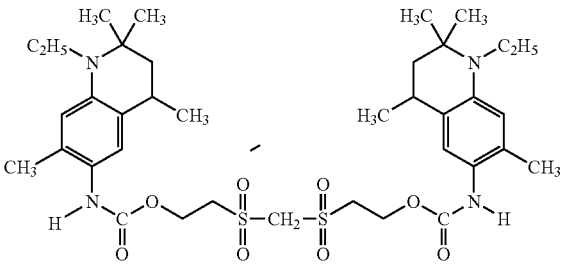

-continued

DEVP-A28

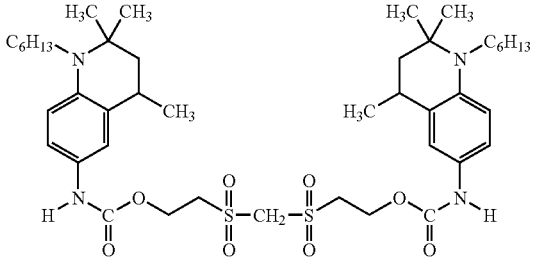

DEVP-A29

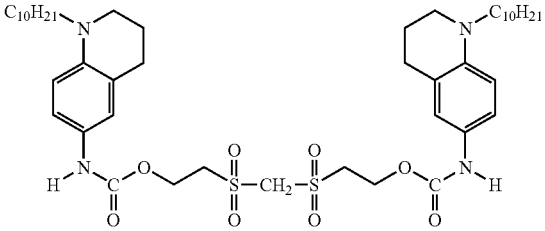

<Adding Method of Reducing Agent>

In the present invention, the reducing agent is preferably contained in the black and white photothermographic material in the form of a fine crystal particle dispersion.

Colloid dispersions of fine crystal particles of these materials can be obtained by any methods which give mechanical shearing well-known in the said technical field. Examples of the method are described in U.S. Pat. Nos. 2,581,414 and 2,855,156 and Canadian Patent No. 1,105,761, and these methods can be used. For example, a solid particle fine grinding method (a ball mill method, a pebble mill method, a roller mill method, a sand mill method, a beads mill method, a dyno mill method, a mussap mill method, and a media mill method are included. Furthermore, a colloid mill method, a fine grinding method by attrition, a dispersing method by ultrasonic energy and the high speed stirring method (described in U.S. Pat. No. 4,474,872 of Onishi et. al.,) are included. From the viewpoints of easy operation, easy washing, and good reproducibility, a ball mill method, a roller mill method, a media mill method, and a fine grinding method by attrition are preferable.

As another method, a dispersion in which the said compound exists in amorphous physical state can be prepared by a well-known method such as a colloid mill method, a uniforming method, a high speed stirring method, or a sonic method. Subsequently, the amorphous physical state of the said compound can be converted to a fine crystal physical state by a method such as a heat anneal method or a chemical anneal method. In the heat anneal method, the temperature programming method in which the dispersion is circulated to a higher temperature than the glass transition temperature of the amorphous compound is included. Preferable heat anneal method includes the process which makes the said dispersion circulate in a temperature range of from 17° C. to 90° C. This circulation process can include an order of arbitrary temperature changing which promotes formation of fine crystal phase from the remained amorphous physical state. Typically, a period of high temperature interval is selected in order to inhibit the ripening and particle growth by collision process to the minimum, and at the same time to make the said phase formation activate. In the chemical anneal method, an incubation method by a chemical agent which changes the distribution of the compound between the continuous phase of the said dispersion and the discontinuous phase and a surfactant is included. Such chemical agent includes hydrocarbons (hexadecane and the like), surfactants, alcohols (butanol, pentanol, undecanol, and the like), and organic solvents having high boiling point. These chemical agents can be added to the dispersion during particle formation or after particle formation. This chemical anneal method includes a method of incubating the said dispersion at from 17° C. to 90° C. in the presence of the above-mentioned chemical agent, a method of stirring the said dispersion in the presence of the above-mentioned chemical agent, and a method of slowly removing the chemical agent by a method of diafiltration after adding the chemical agent, and the like.

The formation of a colloid dispersion in an aqueous medium usually needs presence of auxiliary dispersing agent, such as a surfactant, a surface active polymer, and a hydrophilic polymer. Such auxiliary dispersing agents are described in U.S. Pat. No. 5,008,179 (column Nos. 13 and 14) of Chari et. al., and U.S. Pat. No. 5,104,776 (column Nos. 7 to 13) of Bagchi and Sargeant, and these can be used suitably.

In the present invention, a mean particle size of fine crystal particles contained in the fine crystal particle dispersion is preferably from 0.001 μm to 5 μm, and more preferably from 0.001 μm to 0.5 μm.

The black and white photothermographic material of the present invention contains the reducing agent on the same side of the support as the photosensitive silver halide and the reducible silver salt. The addition amount of the reducing agent of the present invention may be in a large range, and is preferably in a range of from 0.01 mol to 100 mol, more preferably from 0.1 mol to 10 mol, and even more preferably from 0.5 mol to 3.0 mol, per 1 mol of the coupler compound.

The reducing agent of the present invention preferably has solubility to water of 1 $g/m^3$ or less, and more preferably $10^{-3}$ $g/m^3$ or less, in order to raise dispersion stability of the fine crystal particle dispersion. Further, the melting point of the reducing agent of the present invention is preferably from 80° C. to 300° C.

(Coupler Represented by Formula (BC-1) or (BC-2))

The coupler represented by formula (BC-1) or (BC-2) used in the present invention is explained.

The coupler represented by formula (BC-1) or (BC-2) used in the present invention is a compound which performs a coupling reaction with an oxidation product of the reducing agent represented by formula (I) described above by thermal development, and consequently forms a black dye.

Formula (BC-1)

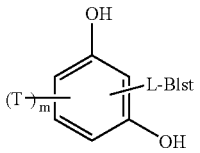

In formula (BC-1), L represents a divalent linking group, and B1st represents a ballast group which causes a coupler molecule to have diffusion resistance. T represents a substituent which leaves upon coupling reaction, and m represents an integer of from 0 to 3.

Formula (BC-2)

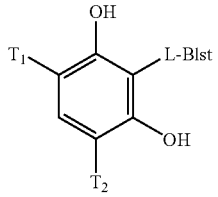

In formula (BC-2), L and B1st each have the same meaning as in formula (BC-1). $T_1$ and $T_2$ each independently represent a hydrogen atom or a substituent which leaves upon coupling reaction.

T, $T_1$, and $T_2$ are each independently a hydrogen atom or a leaving group, and preferably, at least one of them is a leaving group.

The term "leaving group" used herein means the group which leaves from the skeleton when the coupler compound is subjected to coupling with the oxidation product of the reducing agent and forms a dye. As the leaving group, a halogen atom, an alkoxy group, an aryloxy group, an alkylthio group, an arylthio group, an acyloxy group, a carbamoyloxy group, an imide group, a methylol group, a heterocyclic group, and the like are described.

In the present invention, preferable leaving group are a halogen atom (e.g., chlorine or bromine), an alkoxy group (e.g., an ethoxy group, a n-dodecyloxy group, a methoxyethylcarbamoylmethoxy group, a carboxymethoxy group, a methylsulfonamidoethoxy group, an ethylsulfonylethoxy group, or the like), an alkylthio group (e.g., an ethylthio group, a n-butylthio group, a n-decylthio group, a 3-chloropropylthio group, or the like), an arylthio group (e.g., a phenylthio group, a 4-methoxyphenylthio group, a 2,5-dihydroxyphenylthio group, a 2,5-dihydroxy-3-di-n-butylcarbamoylphenyl group, a naphthylthio group, or the like), an acyloxy group (e.g., an acetoxy group, a tetradecanoyloxy group, a benzoyloxy group, or the like), a sulfonyloxy group (e.g., a methanesulfonyloxy group, a dodecanesulfonyloxy group, or the like), an acylamino group (e.g., a dichloroacetylamino group, a heptafluorobutylylamino group, or the like), a sulfonylamino group (e.g., a methanesulfonylamino group, a dodecanesulfonylamino group, a benzenesulfonylamino group, or the like), an alkyloxycalbonyloxy group (e.g., an ethoxycarbonyloxy group, a benzoyloxycarbonyloxy group, or the like), an aryloxycarbonyloxy group (e.g., a phenoxycarbonyloxy group or the like), and an imide group (e.g., a succinimide group, a hydantoinyl group, or the like).

The group represented by L-B1st is preferably one selected from $—COR_{1b}$, $—SO_2R_{2b}$, $—COOR_{3b}$, $—NHCOR_{4b}$, $—CONHR_{5b}$, $—CON(R_{6b})(R_{7b})$, $—COSO_2R_{8b}$, $—NHCONHR_{9b}$, $—NHSO_2R_{10b}$, or $—NHR_{11b}$. $R_{1b}$ to $R_{11b}$ are a ballast group. A ballast group is the group which gives diffusion resistance for preventing a coupler molecule to move to other layers from the layer in which the coupler is added, and generally is a term used in color photosensitive materials.

As preferable ballast group, the following groups can be used.

(a) A phenyl group or naphthyl group which has a hydroxy group, a halogen atom (chlorine, bromine, iodine, or the like), a sulfonyl halide group, a nitro group, a cyano group, an amino group, an alkyl group having 1 to 20 carbon atoms, a substituted alkyl group (an alkyl halide group, an arylalkyl group, or the like), an alkoxy group having 1 to 20 carbon atoms, an alkylthio group having 1 to 20 carbon atoms, or an alkoxycarbonyl group having 1 to 20 carbon atoms;

(b) an alkyl group having 3 to 20 carbon atoms;

(c) a 5- to 10-membered heterocyclic group having an oxygen atom, a nitrogen atom, or a sulfur atom; for example, a furyl group, a quinolyl group, a thienyl group, and the like.

In addition to the above, as preferable ballast group, there may be a polymer residue. Or, there may be a bis type in which resorcynol groups are bonded to a ballast group symmetrically or unsymmetrically.

Particularly, the group represented by L-B1st is preferably —$CONHR_{5b}$ group, wherein $R_{5b}$ is an alkyl group having 3 to 20 carbon atoms, a phenyl group which is substituted by an alkyl group having 1 to 20 carbon atoms, or a phenyl group which is substituted by an alkylaryl group or alkoxy group having 1 to 20 carbon atoms.

In color photosensitive materials, it is required in the photosensitive layer with a multi-layer structure to fix a coupler, and a coupler having a large molecular weight with a large oil-soluble group in the above-mentioned coupler skeleton is used. In the present invention, it is not so important to fix a coupler and it is a characteristic that a lower molecular coupler has an advantage from the viewpoint of gaining image density. Particularly, when it is used in a solid dispersion state, the large oil-soluble group inhibits the reaction efficiency remarkably. It is especially preferable that the substituent of the skeleton is a small group in the range which can reduce water solubility.

B1st has preferably 3 to 15 carbon atoms, and more preferably 4 to 12 carbon atoms.

Specific examples of the coupler represented by formula (BC-1) or (BC-2) used for the present invention are described below, however the present invention is not limited in these compounds.

BC-1

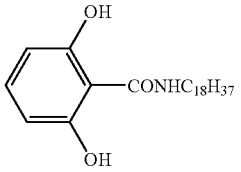

BC-2

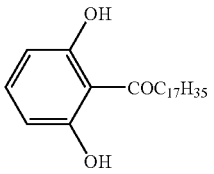

BC-3

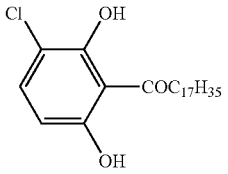

BC-4

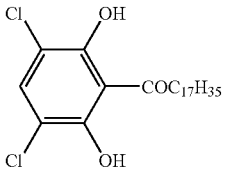

-continued

BC-5

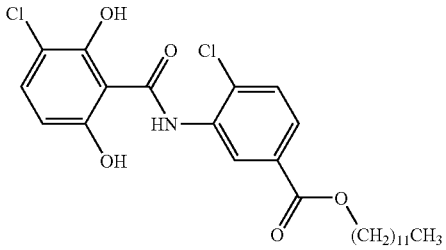

BC-6

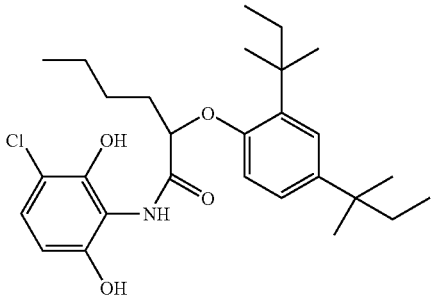

BC-7

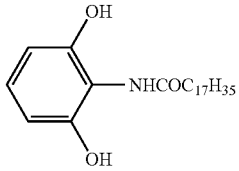

BC-8

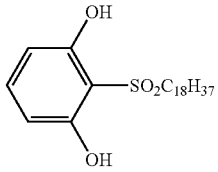

BC-9

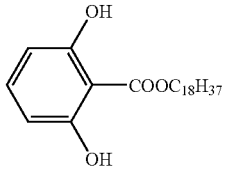

BC-10

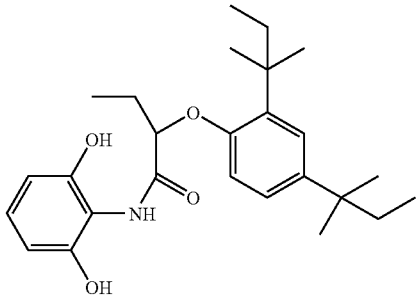

BC-11

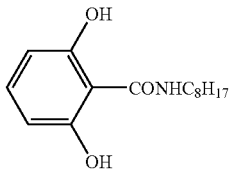

-continued

BC-12

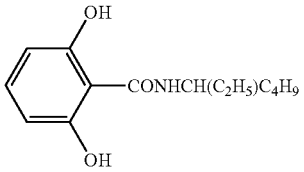

BC-13

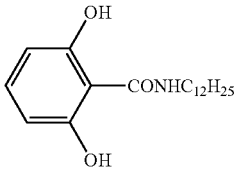

BC-14

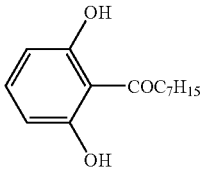

BC-15

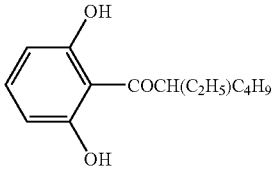

BC-16

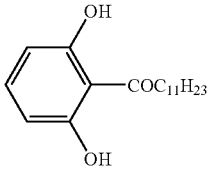

BC-17

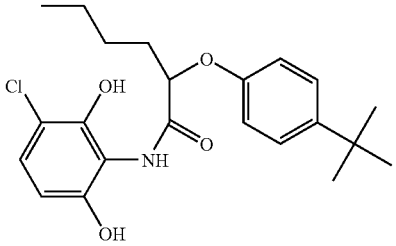

BC-18

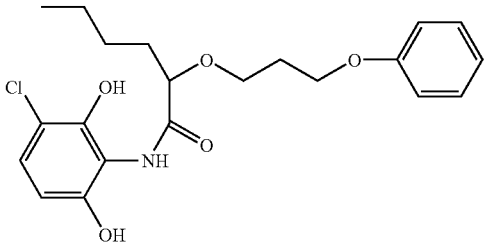

BC-19

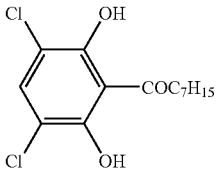

-continued

BC-20

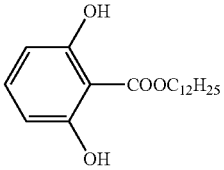

BC-21

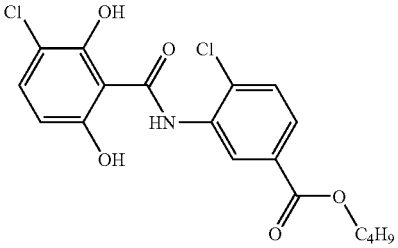

BC-22

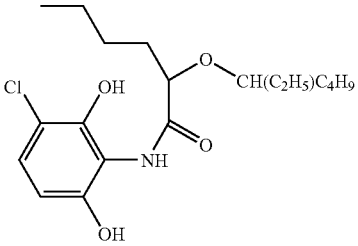

BC-23

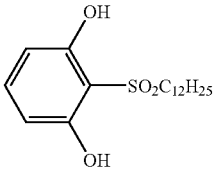

Although the coupler represented by formula (BC-1) or (BC-2) used for the present invention can be added as an oilless emulsion not using a solvent having a high boiling point, a polymer dispersion co-emulsified with polymer, or a solid particle dispersion, it is preferable added as a solid fine particle dispersion similar to the reducing agent. The dispersing method of the solid fine particle dispersion and the preferable melting point of the coupler are similar to those of the reducing agent.

The coupler represented by formula (BC-1) or (BC-2) used for the present invention can be used in a range of from 0.05 mmol/$m^2$ to 5.0 mmol/$m^2$, preferably in a range of from 0.1 mmol/$m^2$ to 2.0 mmol/$m^2$, and more preferably in a range of from 0.2 mmol/$m^2$ to 1.0 mmol/$m^2$.

(Other Couplers)

In the present invention, a known coupler which forms yellow, magenta, or cyan is preferably used in combination with the coupler represented by formula (BC-1) or (BC-2).

Such a compound is a well-known compound for the color photographic system, and as representative examples, a pyrrolotriazole type coupler, a phenol type coupler, a naphthol type coupler, a pyrazolotriazole type coupler, a pyrazolone type coupler, an acylacetoanilide type coupler, and the like are described. In color photosensitive materials, it was required in the photosensitive layer with a multi-layer structure to fix a coupler and the coupler having a large molecular weight with a large oil-soluble group in the above-mentioned coupler skeleton was used. In the present invention, it is not so important to fix a coupler and it is a characteristic that a lower molecular coupler has an advantage from the viewpoint of gaining image density. Particularly, when it is used in a solid dispersion state, the large oil-soluble group inhibits the reaction efficiency remarkably. It is especially preferable that the substituent of the skeleton is a small group in the range which can reduce water solubility.

In the present invention, preferable coupler is the coupler having the structure represented by formulae (C-1), (C-2), (C-3), (M-1), (M-2), (M-3), (Y-1), (Y-2), or (Y-3):

Formula (C-1)

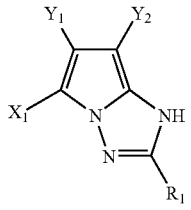

(wherein $X_1$ represents a hydrogen atom or a leaving group, $Y_1$ and $Y_2$ each independently represent an electron-attracting substituent, and $R_1$ represents one selected from an alkyl group, an aryl group, or a heterocyclic group.);

Formula (C-2)

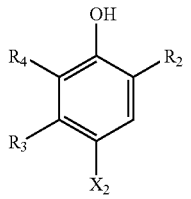

(wherein $X_2$ represents a hydrogen atom or a leaving group, $R_2$ represents one selected from an acylamino group, a ureido group, or a urethane group, $R_3$ represents one selected from a hydrogen atom, an alkyl group, or an acylamino group, $R_4$ represents a hydrogen atom or a substituent, and $R_3$ and $R_4$ may be link together to form a ring.);

Formula (C-3)

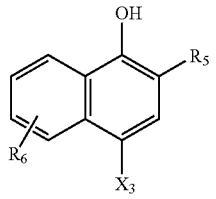

(wherein $X_3$ represents a hydrogen atom or a leaving group, $R_5$ represents a carbamoyl group or a sulfamoyl group, and $R_6$ represents a hydrogen atom or a substituent.);

Formula (M-1)

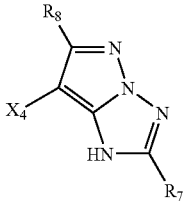

(wherein $X_4$ represents a hydrogen atom or a leaving group, $R_7$ represents one selected from an alkyl group, an aryl group, or a heterocyclic group, and $R_8$ represents a substituent.);

Formula (M-2)

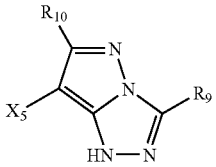

(wherein $X_5$ represents a hydrogen atom or a leaving group, $R_9$ represents one selected from an alkyl group, an aryl group, or a heterocyclic group, and $R_{10}$ represents a substituent.);

Formula (M-3)

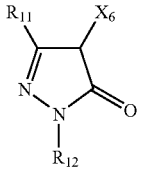

(wherein $X_6$ represents a hydrogen atom or a leaving group, $R_{11}$ represents one selected from an alkyl group, an aryl group, an acylamino group, or an anilino group, and $R_{12}$ represents one selected from an alkyl group, an aryl group, or a heterocyclic group.);

Formula (Y-1)

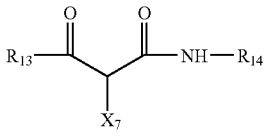

(wherein $X_7$ represents a hydrogen atom or a leaving group, $R_{13}$ represents one selected from an alkyl group, an aryl group, or an indolenyl group, and $R_{14}$ represents one selected from an aryl group or a heterocyclic group.);

Formula (Y-2)

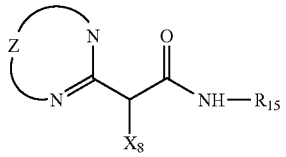

(wherein $X_8$ represents a hydrogen atom or a leaving group, Z represents a divalent group necessary for forming a 5- to 7-membered ring, and $R_{15}$ represents one selected from an aryl group or a heterocyclic group.);

Formula (Y-3)

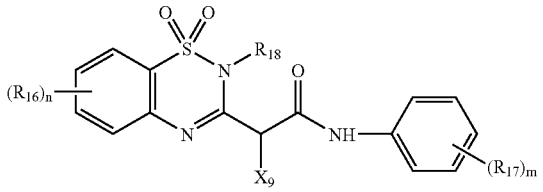

(wherein $X_9$ represents a hydrogen atom or a leaving group, $R_{16}$, $R_{17}$, and $R_{18}$ each independently represent a substituent, n represents an integer of from 0 to 4, and m represents an integer of from 0 to 5, when n represents 2 or more, a plurality of $R_{16}$ may be the same or different from one another, and when m represents 2 or more, a plurality of $R_{17}$ may be the same or different from one another.).

In formula (C-1), $X_1$ represents a hydrogen atom or a leaving group, and $Y_1$ and $Y_2$ each independently represent an electron-attracting substituent. $R_1$ represents an alkyl group, an aryl group, or a heterocyclic group, each of which may have a substituent.

$X_1$ is a hydrogen atom or a leaving group, and preferably a leaving group.

The leaving group in the present invention means the group which leaves from the skeleton at the formation of dye by coupling with the oxidization product of a reducing agent. As the leaving group, a halogen atom, an alkoxy group, an aryloxy group, an alkylthio group, an arylthio group, an acyloxy group, a carbamoyloxy group, an imide group, a methylol group, a heterocyclic group, and the like are described. $X_1$ is more preferably a carbamoyloxy group or a benzoyloxy group. $Y_1$ and $Y_2$ represent an electron-attracting group. Specifically, a cyano group, a nitro group, an acyl group, an oxycarbonyl group, a carbamoyl group, a sulfonyl group, a sulfoxide group, an oxysulfonyl group, a sulfamoyl group, a heterocyclic group, a trifluoromethyl group, and a halogen atom are described. Among these, a cyano group, an oxycarbonyl group, and a sulfonyl group are preferable, and a cyano group and an oxycarbonyl group are more preferable. Even more preferably, one of $Y_1$ or $Y_2$ is a cyano group, and particularly preferably, $Y_1$ is a cyano group. $Y_2$ is preferably an oxycarbonyl group and particularly preferably, $Y_2$ is preferably an oxycarbonyl group substituted by a bulky group (for example, 2,6-di-t-butyl-4-methylpiperazinylocycarbonyl group). $R_1$ is preferably an alkyl group or an aryl group, each of which may have a substituent. As the alkyl group, a secondary or tertiary alkyl group is preferable, and a tertiary alkyl group is more preferable. The alkyl group preferably has from 3 to 12 carbon atoms in total, and more preferably from 4 to 8 carbon atoms. As the aryl group, preferable is a phenyl group, which may have a substituent, and the aryl group preferably has from 6 to 16 carbon atoms in total, and more preferably from 6 to 12 carbon atoms. Concerning the coupler of formula (C-1), the molecular weight is preferably 700 or less, more preferably 650 or less, and even more preferably 600 or less.

In formula (C-2), $X_2$ represents a hydrogen atom or a leaving group, $R_2$ represents an acylamino group, a ureido group, or a urethane group, $R_3$ represents a hydrogen atom, an alkyl group, or an acylamino group, and $R_4$ represents a hydrogen atom or a substituent. $R_3$ and $R_4$ may link together to form a ring.

Although $X_2$ is a hydrogen atom or a leaving group similar to $X_1$, $X_2$ is preferably a halogen atom, an aryloxy group, an alkoxy group, an arylthio group, or an alkylthio group, and more preferably a halogen atom or an aryloxy group. $R_2$ is preferably an acylamino group or a ureido group. $R_2$ preferably has from 2 to 12 carbon atoms in total, and more preferably from 2 to 8 carbon atoms in total. $R_3$ is preferably an alkyl group having 1 to 4 carbon atoms or an acylamino group having 2 to 12 carbon atoms, and more preferably an alkyl group having 2 to 4 carbon atoms or an acylamino group having 2 to 8 carbon atoms. $R_4$ is preferably a halogen atom, an alkoxy group, an acylamino group, or an alkyl group, more preferably a halogen atom or an acylamino group, and particularly preferably a chlorine atom. Concerning the coupler of formula (C-2), the molecular weight is preferably 500 or less, more preferably 450 or less, and even more preferably 400 or less.

In formula (C-3), $X_3$ is a hydrogen atom or a leaving group similar to $X_1$, however $X_3$ is preferably a halogen atom, an aryloxy group, an alkoxy group, an arylthio group, or an alkylthio group, and more preferably an alkoxy group or an alkylthio group. $R_5$ is preferably an acyl group, an oxycarbonyl group, a carbamoyl group, or a sulfamoyl group, and more preferably a carbamoyl group or a sulfamoyl group. $R_5$ is preferably a group having from 1 to 12 carbon atoms in total, and more preferably from 2 to 10 carbon atoms. $R_6$ is a hydrogen atom or a substituent, and the substituent is preferably an amide group, a sulfonamide group, a urethane group or a ureido group, and more preferably an amide group or a urethane group. As the substitution position, the 5th or 8th position of a naphthol ring is preferable and the 5th position is more preferable. $R_6$ is preferably a group having from 2 to 10 carbon atoms in total, and more preferably from 2 to 6 carbon atoms. Concerning the coupler of formula (C-2), the molecular weight is preferably 550 or less, more preferably 500 or less, and even more preferably 450 or less.

In formula (M-1), $X_4$ is a hydrogen atom or a leaving group similar to $X_1$, however $X_4$ is preferably a halogen atom, an aryloxy group, an alkoxy group, an arylthio group, an alkylthio group, or a heterocyclic group, and more preferably a halogen atom, an aryloxy group, an arylthio group or a heterocyclic group. As the heterocyclic group, an azole group such as a pyrazole group, an imidazole group, a triazole group, a tetrazole group, a benzimidazole group, and a benzotriazole group are preferable, and a pyrazole group is more preferable. $R_7$ is an alkyl group, an aryl group, or a heterocyclic group, each of which may have a substituent. Preferable are a secondary or tertiary alkyl group and an aryl group. As the alkyl group, an alkyl group having from 2 to 14 carbon atoms is preferred, and more preferred is an alkyl group having from 3 to 10 carbon atoms. As the aryl group, an aryl group having from 6 to 18 carbon atoms is preferred, and more preferred is an aryl group having from 6 to 14 carbon atoms. $R_8$ is preferably an alkyl group, an aryl group, an alkoxy group, an aryloxy group, an alkylthio group, an arylthio group or a heterocyclic group, each of which may have a substituent. The alkyl group is preferably a secondary or tertiary alkyl group, and more preferably a tertiary alkyl group. The alkyl group preferably has from 3 to 12 carbon atoms in total, and more preferably from 4 to 8 carbon atoms. The aryl group is preferably a phenyl group, which may have a substituent, and the aryl group preferably has from 6 to 16 carbon atoms in total, and more preferably from 6 to 12 carbon atoms. As the alkoxy group, an alkoxy group having from 1 to 8 carbon atoms is preferable, and an alkoxy group having from 1 to 4 carbon atoms is more preferable. As the aryloxy group, an aryloxy group having from 6 to 14 carbon atoms is preferable, and an aryloxy group having from 6 to 10 carbon atoms is more preferable. The alkylthio group and the arylthio group are preferably the groups having carbon atoms in a similar number to the alkoxy group and the aryloxy group, respectively. Concerning the coupler of formula (M-1), the molecular weight is preferably 600 or less, more preferably 550 or less, and even more preferably 500 or less.

The groups represented by $X_5$, $R_9$, and $R_{10}$ of the coupler of formula (M-2) are similar groups as those represented by $X_4$, $R_7$, and $R_8$ of the coupler of formula (M-1), respectively, and preferable range of each group of them is similar to that of the coupler of formula (M-1).

In formula (M-3), although $X_6$ is a hydrogen atom or a leaving group similar to $X_1$, $X_1$ is preferably an alkylthio group, an arylthio group, or a heterocyclic group, and more preferably an arylthio group or a heterocyclic group. As the arylthio group, a phenyl group is preferable, and more preferable is an arylthio group in which an alkoxy group or an amide group is substituted at 2nd position. The arylthio group preferably has from 6 to 16 carbon atoms in total, and more preferably from 7 to 12 carbon atoms. As the heterocyclic group, an azole group such as a pyrazole group, an imidazole group, a triazole group, a tetrazole group, a benzimidazole group, a benzotriazole group, or the like is preferable, and more preferable is a pyrazole group. As $R_{11}$, an alkyl group, an aryl group, an acylamino group, and an anilino group are preferable, and an acylamino group and an anilino group are more preferable. An anilino group is most preferable. As the alkyl group, an alkyl group having from 1 to 8 carbon atoms is preferable and as the aryl group, an aryl group having from 6 to 14 carbon atoms is preferable. As the acylamino group, an acylamino group having from 2 to 14 carbon atoms is preferable, and an acylamino group having from 2 to 10 is more preferable. As the anilino group, an anilino group having from 6 to 16 carbon atoms is preferable, and an anilino group having from 6 to 12 carbon atoms is more preferable. As a substituent of the anilino group, a halogen atom and an acylamino group are preferable. Concerning the coupler of formula (M-3), the molecular weight is preferably 700 or less, more preferably 650 or less, and even more preferably 600 or less.

In formula (Y-1), although $X_7$ is a hydrogen atom or a leaving group similar to $X_1$, $X_1$ is preferably an aryloxy group, an imide group, or a heterocyclic group. As the aryloxy group, an aryloxy group which is substituted by an electron-attracting group is preferable. As the imide group, a cyclic imide group is preferable, and a hydantoin group, a 1,3-oxazolidine-2,5-dione group, and a succinimide group are particularly preferable. The imide group preferably has from 3 to 15 carbon atoms in total, more preferably from 4 to 11 carbon atoms in total, and even more preferably from 5 to 9 carbon atoms in total. As the heterocyclic group, a pyrazole group, an imidazole group, a triazole group, a tetrazole, a benzimidazole group, and a benzotriazole group are preferable, and an imidazole group is more preferable. The azole group preferably has from 3 to 12 carbon atoms in total, more preferably from 3 to 10 carbon atoms in total, and even more preferably from 3 to 8 carbon atoms in total. $R_{13}$ is preferably a secondary or tertiary alkyl group, an aryl group, or a heterocyclic group. The alkyl group may be a cycloalkyl group or a bicycloalkyl group, and a tertiary alkyl group is preferable. A 1-alkylcyclopropyl group, a bicycloalkyl group, and an adamantyl group are particularly preferable. $R_{14}$ is preferably an aryl group or a heterocyclic group, and more preferably an aryl group. Among them, a phenyl group substituted by a halogen atom, an alkoxy group, an aryloxy group, an alkylthio group, or an arylthio group at the 2nd position is particularly preferable. $R_{14}$ preferably has from 6 to 18 carbon atoms in total, more preferably from 7 to 16 carbon atoms in total, and even more preferably from 8 to 14 carbon atoms. Concerning the coupler of formula (Y-1), the molecular weight is preferably 700 or less, more preferably 650 or less, and even more preferably 600 or less.

The groups represented by $X_8$ and $R_{15}$ of the coupler of formula (Y-2) are similar to the groups represented by $X_7$ and $R_{14}$ of the coupler of formula (Y-1) respectively, and preferable range of each group of them is similar to that of the coupler of formula (Y-1). Z represents a divalent group necessary to form a 5- to 7-membered ring, and this ring may have a substituent or may be condensed by another ring.

Among the couplers of formula (Y-2), the coupler represented by formula (Y-3) is preferable.

In the coupler of formula (Y-3), $X_9$ is the same as $X_7$ of formula (Y-1) and its preferable range is also the same. $R_{16}$ is preferably a halogen atom, an alkyl group, an alkoxy group, an acyl group, an acyloxy group, an acylamino group, an alkoxycarbonyl group, a sulfonamide group, a cyano group, a sulfonyl group, a sulfamoyl group, a carbamoyl group, or an alkylthio group, and more preferably a substituent having from 1 to 4 carbon atoms. n is preferably an integer of from 0 to 3, more preferably an integer of from 0 to 2, even more preferably 0 or 1, and most preferably zero. $R_{17}$ is preferably a group similar to $R_{16}$, and more preferably a halogen atom, an alkyl group, an alkoxy group, an acylamino group, a sulfonamide group, an alkoxycarbonyl group, a sulfamoyl group, or a sulfonyl group. $R_{17}$ is particularly preferably a halogen atom, an alkoxy group, or an alkylthio group which substitutes at the ortho position with respect to the —NH— group. An alkylthio group is most preferable. The molecular weight of the coupler of formula (Y-3) is preferably 750 or less, more preferably 700 or less, and even more preferably 650 or less.

Specific examples of the coupler of the present invention are described below, but the present invention is not limited in these.

(C-1)

Cyan coupler

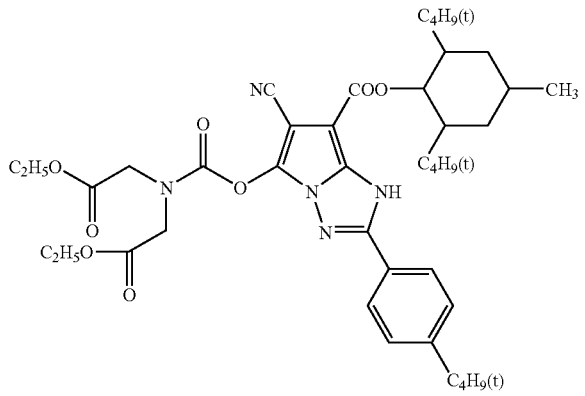

-continued
(C-2)
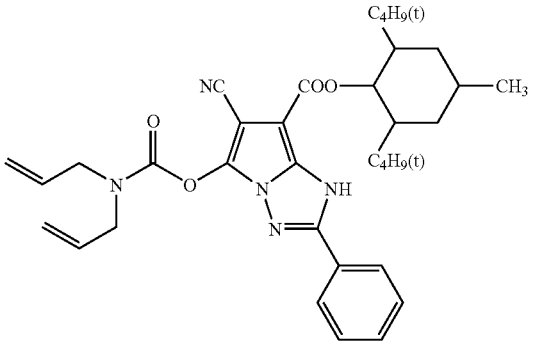
(C-3)
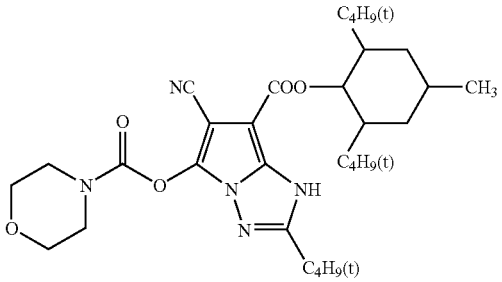
(C-4)
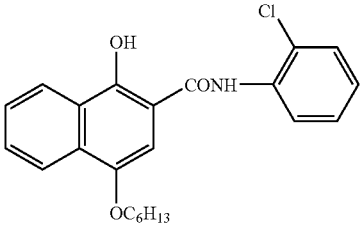
(C-5)
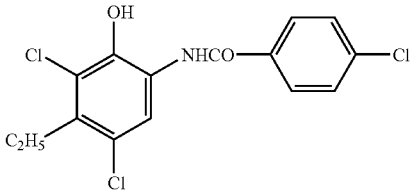
(C-6)
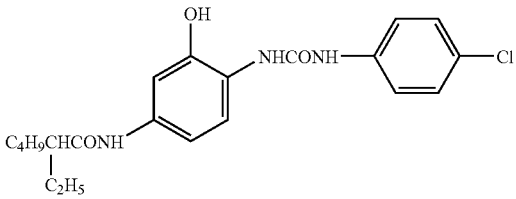
(C-7)
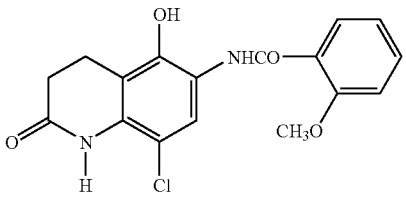
-continued
(C-8)
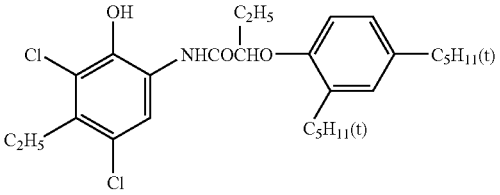
Magenta coupler
(M-1)
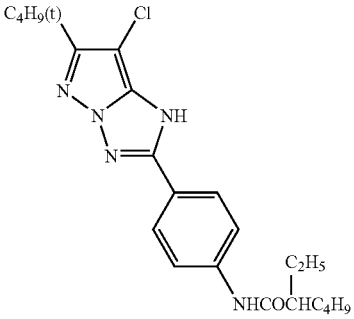
(M-2)
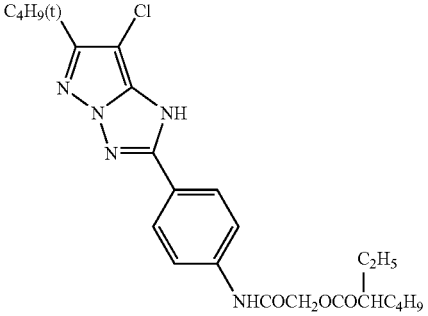
(M-3)
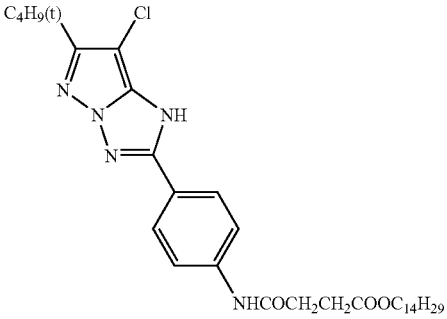
(M-4)
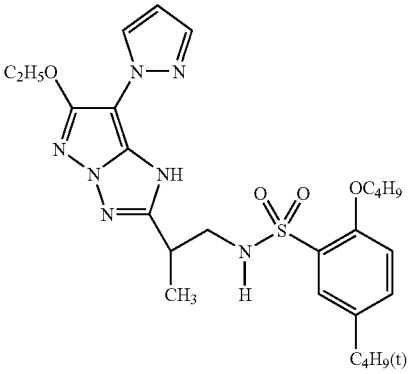

-continued
(M-5)
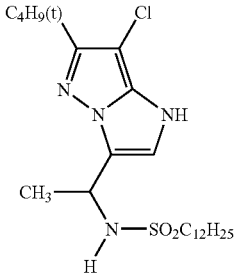
(M-6)
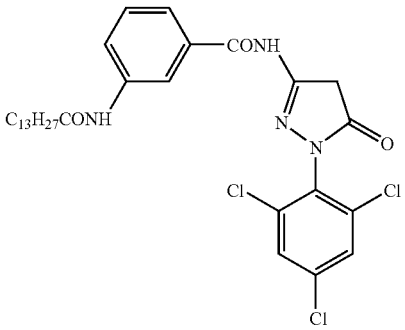
(M-7)
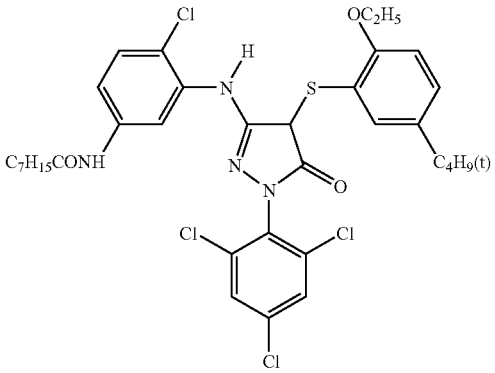
(M-8)
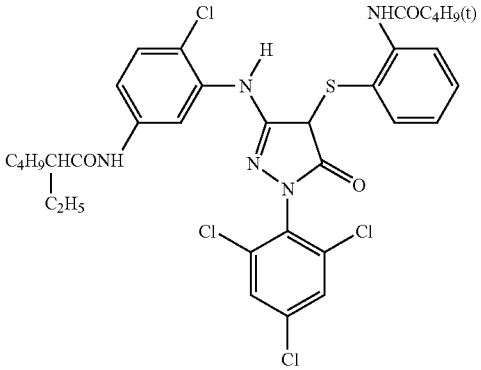
-continued
Yellow coupler
(Y-1)
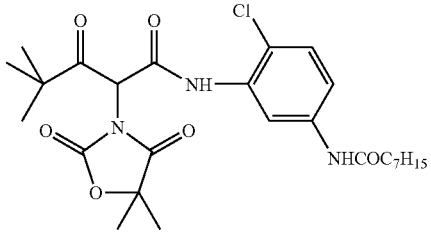
(Y-2)
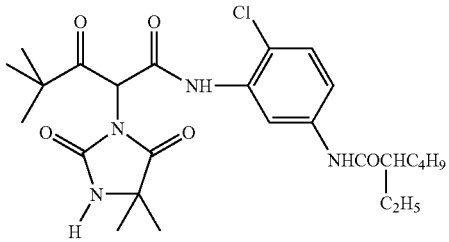
(Y-3)
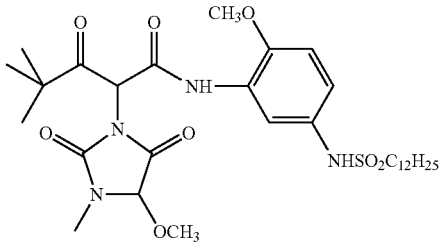
(Y-4)
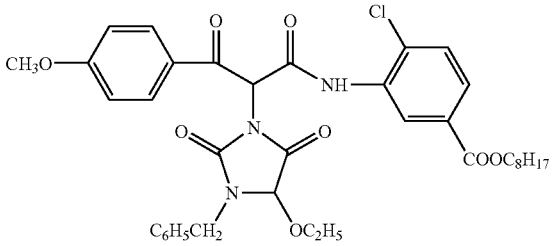
(Y-5)
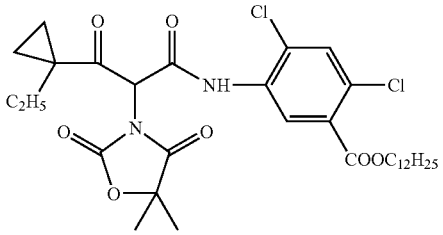
(Y-6)
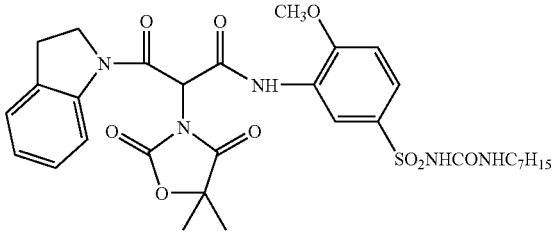

-continued (Y-7)

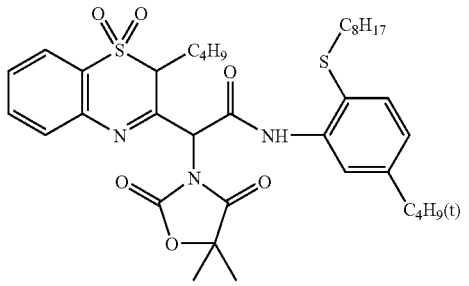

(Y-8)

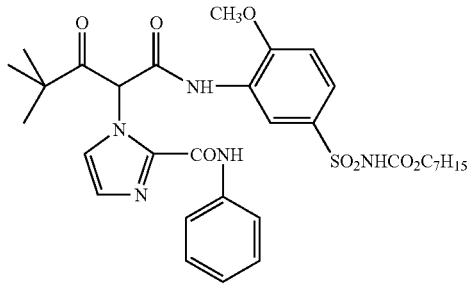

The using ratio of the coupler to the coupler represented by formula (BC-1) or (BC-2) is in a range of from 0.01 to 10.0, preferably from 0.1 to 5.0, and more preferably from 0.2 to 2.0.

It is preferred to use two or more compounds of the couplers selected from among three compounds including: one compound selected from compounds represented by formula (C-1), (C-2), or (C-3); one compound selected from compounds represented by formulae (M-1), (M-2), or (M-3); and one compound selected from compounds represented by formula (Y-1), (Y-2), or (Y-3). It is more preferred to use three compounds including: one compound selected from compounds represented by formula (C-1), (C-2), or (C-3); one compound selected from compounds represented by formula (M-1), (M-2), or (M-3); and one compound selected from compounds represented by formula (Y-1), (Y-2), or (Y-3).

(Silver Salt of Fatty Acid)

1) Composition

The silver salt of a fatty acid which can be used in the present invention is relatively stable to light but serves as to supply silver ions and forms silver images when heated to 80° C. or higher in the presence of an exposed photosensitive silver halide and a reducing agent. The silver salt of a fatty acid which can be used in the present invention is preferably a silver salt of a long chained aliphatic carboxylic acid having 10 to 30 carbon atoms, and more preferably having 15 to 28 carbon atoms. Preferred examples of the silver salt of a fatty acid include silver lignocerate, silver behenate, silver arachidinate, silver stearate, silver oleate, silver laurate, silver capronate, silver myristate, silver palmitate, silver erucate, and mixtures thereof. In the invention, among these silver salts of a fatty acid, it is preferred to use a silver salt of a fatty acid with a silver behenate content of 50 mol % or higher, more preferably, 85 mol % or higher, and even more preferably, 95 mol % or higher. Further, it is preferred to use a silver salt of a fatty acid with a silver erucate content of 2 mol % or lower, more preferably, 1 mol % or lower, and even more preferably, 0.1 mol % or lower.

It is preferred that the content of silver stearate is 1 mol % or lower. When the content of silver stearate is 1 mol % or lower, a silver salt of a fatty acid having low fog, high sensitivity and excellent image storability can be obtained. The above-mentioned content. of silver stearate is preferably 0.5 mol % or lower, and particularly preferably, silver stearate is not substantially contained.

Further, in the case where the silver salt of a fatty acid includes silver arachidinate, it is preferred that the content of silver arachidinate is 6 mol % or lower in order to obtain a silver salt of a fatty acid having low fog and excellent image storability. The content of silver arachidinate is more preferably 3 mol % or lower.

2) Shape

There is no particular restriction on the shape of the silver salt of a fatty acid usable in the invention and it may be needle-like, bar-like, tabular, or flake shaped.

In the invention, a flake shaped silver salt of a fatty acid is preferred. Short needle-like, rectangular, cubic, or potato-like indefinite shaped particles with the major axis to minor axis ratio being 5 or lower are also used preferably. Such particles of the silver salt of a fatty acid suffer less from fogging during thermal development compared with long needle-like particles with the major axis to minor axis length ratio of higher than 5. Particularly, a particle with the major axis to minor axis ratio of 3 or lower is preferred since it can improve the mechanical stability of the coating film. In the present specification, the flake shaped silver salt of a fatty acid is defined as described below. When a silver salt of a fatty acid is observed under an electron microscope, calculation is made while approximating the shape of a particle of the silver salt of a fatty acid to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those satisfying the relation: x (average)≧1.5 as an average value x is defined as a flake shape. The relation is preferably: 30≧x (average)≧1.5 and, more preferably, 15≧x (average)≧=1.5. By the way, needle-like is expressed as 1≦x (average)<1.5.

In the flake shaped particle, a can be regarded as a thickness of a tabular particle having a major plane with b and c being as the sides. a in average is preferably from 0.01 μm to 0.3 μm and, more preferably from 0.1 μm to 0.23 μm. c/b in average is preferably from 1 to 9, more preferably from 1 to 6, even more preferably from 1 to 4 and, most preferably from 1 to 3.

By controlling the equivalent spherical diameter being from 0.05 μm to 1 μm, it causes less agglomeration in the black and white photothermographic material, and image storability is improved. The equivalent spherical diameter is preferably from 0.1 μm to 1 μm.

In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake particle is preferably from 1.1 to 30 and, more preferably, from 1.1 to 15 with a viewpoint of causing less agglomeration in the black and white photothermographic material and improving the image storability.

As the particle size distribution of the silver salt of a fatty acid, monodispersion is preferred. In the monodispersion, the percentage for the value obtained by dividing the standard deviation for the length of minor axis and major axis by the minor axis and the major axis respectively is, preferably, 100% or less, more preferably, 80% or less and, even more preferably, 50% or less. The shape of the silver salt of a fatty acid can be measured by analyzing a dispersion of a silver salt of a fatty acid as transmission type electron microscopic images. Another method of measuring the monodispersion is a method of determining of the standard deviation of the volume weighted mean diameter of the silver salt of a fatty acid in which the percentage for the value defined by the volume weight mean diameter (variation coefficient), is preferably, 100% or less, more preferably, 80% or less and, even more preferably, 50% or less. The monodispersion can be determined from particle size (volume weighted mean diameter) obtained, for example, by a measuring method of irradiating a laser beam to silver salts of a fatty acid dispersed in a liquid, and determining a self correlation function of the fluctuation of scattered light to the change of time.

3) Preparation

Methods known in the art can be applied to the method for producing the silver salt of a fatty acid used in the invention and to the dispersing method thereof. For example, reference can be made to JP-A No. 10-62899, EP Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the silver salt of a fatty acid, fog increases and sensitivity becomes remarkably lower, so that it is more preferred that the photosensitive silver salt is not substantially contained during dispersion. In the invention, the amount of the photosensitive silver salt to be dispersed in the aqueous dispersion is preferably 1 mol % or less, more preferably 0.1 mol % or less, per 1 mol of the silver salt of a fatty acid in the solution and, even more preferably, positive addition of the photosensitive silver salt is not conducted.

In the invention, the black and white photothermographic material can be manufactured by each independently preparing an aqueous dispersion of the silver salt of a fatty acid and an aqueous dispersion of a photosensitive silver salt and then mixing. A method of mixing two or more aqueous dispersions of silver salts of a fatty acid and two or more aqueous dispersions of photosensitive silver salts upon mixing is used preferably for controlling the photographic properties.

4) Addition Amount

While the silver salt of a fatty acid according to the invention can be used in a desired amount, a total amount of coated silver including silver halide is preferably in a range of from 0.05 $g/m^2$ to 3.0 $g/m^2$, more preferably from 0.1 $g/m^2$ to 1.8 $g/m^2$, and even more preferably from 0.2 $g/m^2$ to 1.2 $g/m^2$.

(Auxiliary Reducing Agent)

In the black and white photothermographic material of the present invention, an auxiliary reducing agent is preferably used in combination with the reducing agent described above. The auxiliary reducing agent according to the invention can be any substance (preferably, organic substance) which reduces silver ions into metallic silver. Examples of such reducing agent are described in JP-A No. 11-65021 (column Nos. 0043 to 0045) and EP No. 0803764 (p.7, line 34 to p. 18, line 12).

The auxiliary reducing agent according to the invention is preferably a so-called hindered phenolic reducing agent or a bisphenol agent having a substituent at the ortho-position to the phenolic hydroxy group. It is more preferably a compound represented by the following formula (R).

Formula (R)

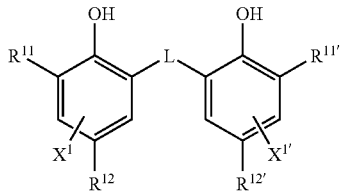

In formula (R), $R^{11}$ and $R^{11'}$ each independently represent an alkyl group having 1 to 20 carbon atoms. $R^{12}$ and $R^{12'}$ each independently represent a hydrogen atom or a group substituting for a hydrogen atom on a benzene ring. L represents an —S— group or a —$CHR^{13}$— group. $R^{13}$ represents a hydrogen atom or an alkyl group having 1 to 20 carbon atoms. Xl and Xl each independently represent a hydrogen atom or a group substituting for a hydrogen atom on a benzene ring.

Formula (R) is to be described in detail.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a group substituting for a hydrogen atom on a benzene ring. $X^1$ and $X^{1'}$ each independently represent a hydrogen atom or a group substituting for a hydrogen atom on a benzene ring. As each of the groups substituting for a hydrogen atom on the benzene ring, an alkyl group, an aryl group, a halogen atom, an alkoxy group, and an acylamino group are described preferably.

3) L

L represents an —S— group or a —$CHR^{13}$— group. $R^{13}$ represents a hydrogen atom or an alkyl group having I to 20 carbon atoms in which the alkyl group may have a substituent. Specific examples of the unsubstituted alkyl group for $R^{13}$ include a methyl group, an ethyl group, a propyl group, a butyl group, a heptyl group, an undecyl group, an isopropyl group, a 1-ethylpentyl group, a 2,4,4-trimethylpentyl group, cyclohexyl group, 2,4-dimethyl-3-cyclohexenyl group, 3,5-dimethyl-3-cyclohexenyl group, and the like. Examples of the substituent for the alkyl group include, similar to the substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

4) Preferred Substituents $R^{11}$ and $R^{11'}$ are preferably a secondary or tertiary alkyl group having 3 to 15 carbon atoms and include, specifically, an isopropyl group, an isobutyl group, a t-butyl group, a t-amyl group, a t-octyl group, a cyclohexyl group, a cyclopentyl group, a 1-methylcyclohexyl group, a 1-methylcyclopropyl group, and the like. $R^{11}$ and $R^{11'}$ each represent, more preferably, a tertiary alkyl group having 4 to 12 carbon atoms. Among them, a t-butyl group, a t-amyl group, and a 1-methylcyclohexyl group are further preferred and, a t-butyl group being most preferred.

$R^{12}$and $R^{12'}$ are preferably an alkyl group having 1 to 20 carbon atoms and include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are a methyl group, an ethyl group, a propyl group, an isopropyl group, and a t-butyl group.

$X^1$ and $X^{1'}$ are preferably a hydrogen atom, a halogen atom, or an alkyl group, and more preferably a hydrogen atom.

L is preferably a —$CHR^{13}$— group.

$R^{13}$ is preferably a hydrogen atom or an alkyl group having 1 to 15 carbon atoms. Preferable examples of the alkyl group include a methyl group, an ethyl group, a propyl group, an isopropyl group, and a 2,4,4-trimethylpentyl group. Particularly preferable $R^{13}$ is a hydrogen atom, a methyl group, an ethyl group, a propyl group, or an isopropyl group.

When $R^{13}$ is a hydrogen atom, $R^{12}$ and $R^{12'}$ are preferably an alkyl group having 2 to 5 carbon atoms, more preferably an ethyl group or a propyl group, and most preferably an ethyl group.

When $R^{13}$ is a primary or secondary alkyl group having 1 to 8 carbon atoms, $R^{12}$ and $R^{12'}$ are preferably a methyl group. The primary or secondary alkyl group having 1 to 8 carbon atoms as $R^{13}$ is preferably a methyl group, an ethyl group, a propyl group, or an isopropyl group, and more preferably a methyl group, an ethyl group, or a propyl group.

When all of $R^{11}$, $R^{11'}$, $R^{12}$ and $R^{12'}$ are a methyl group, $R^{13}$ is preferably a secondary alkyl group. In this case, the secondary alkyl group as $R^{13}$ is preferably an isopropyl group, an isobutyl group, or a 1-ethylpentyl group, and more preferably an isopropyl group.

The auxiliary reducing agent described above shows different thermal developing performance, color tone of developed silver images, or the like depending on the combination of $R^{11}$, $R^{11'}$, $R^{12}$, $R^{12'}$, and $R^{13}$. Since the performance can be controlled by using two or more reducing agents in combination, it is preferred to use two or more reducing agents in combination depending on the purpose.

Specific examples of the auxiliary reducing agent of the invention including the compounds represented by formula (R) according to the invention are shown below, but the invention is not restricted to these.

R-1

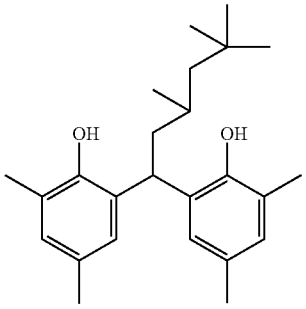

-continued

R-2

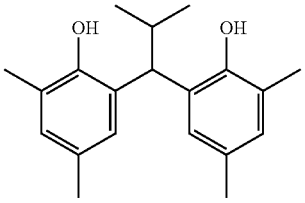

R-3

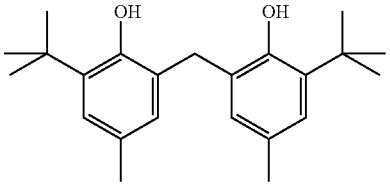

R-4

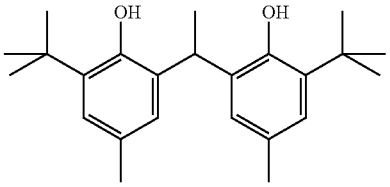

R-5

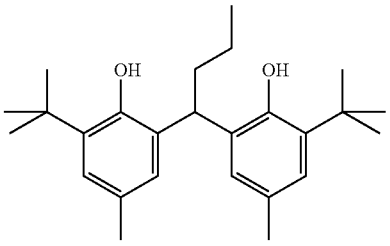

R-6

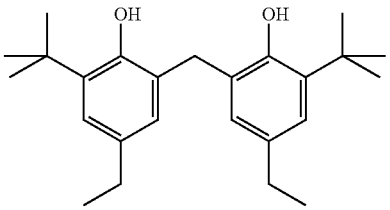

R-7

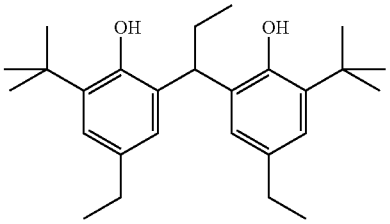

R-8

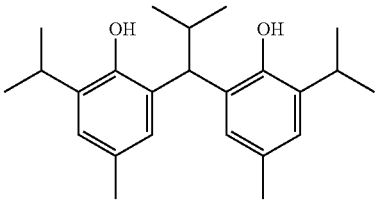

-continued

R-9

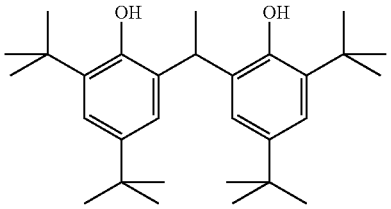

R-10

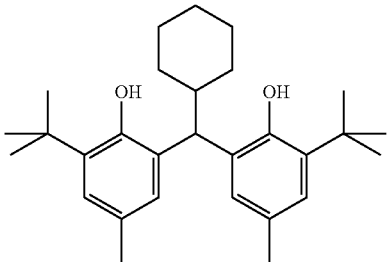

R-11

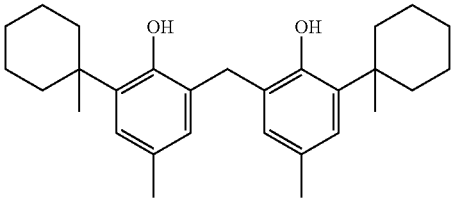

R-12

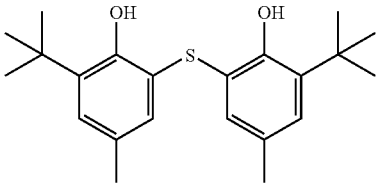

R-13

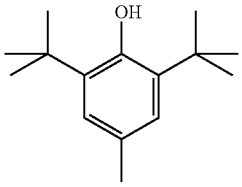

R-14

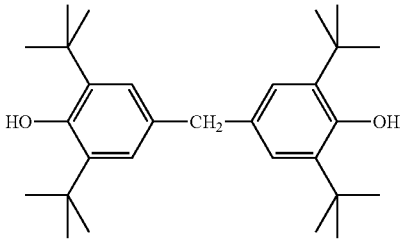

R-15

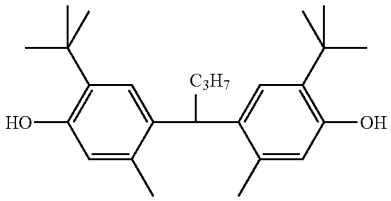

-continued

R-16

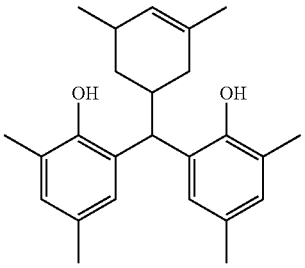

R-17

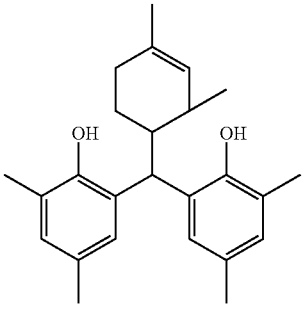

R-18

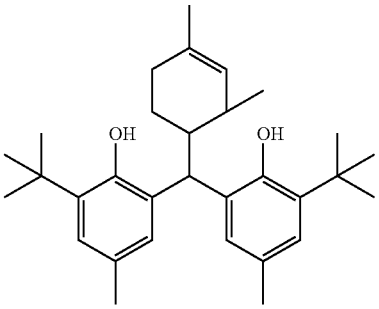

The addition amount of the auxiliary reducing agent is preferably from 0.1 g/m$^2$ to 3.0 g/m$^2$, more preferably from 0.2 g/m$^2$ to 1.5 g/m$^2$ and, even more preferably from 0.3 g/m$^2$ to 1.0 g/m$^2$. It is preferably contained in a range of from 5 mol % to 50 mol %, more preferably from 8 mol % to 30 mol % and, even more preferably from 10 mol % to 20 mol %, per 1 mol of silver in the image forming layer. The auxiliary reducing agent is preferably contained in the image forming layer.

The auxiliary reducing agent is preferably used as a solid particle dispersion, and is added in the form of fine particles having a mean particle size of from 0.01 μm to 10 μm, preferably from 0.05 μm to 5 μm and, more preferably from 0.1 μm to 2 μm.

(Photosensitive Silver Halide)

1) Halogen Composition

For the photosensitive silver halide used in the invention, there is no particular restriction on the halogen composition and silver chloride, silver chlorobromide, silver bromide, silver iodobromide, silver iodochlorobromide, or silver iodide can be used.

Among them, the photosensitive silver halide used in the invention is preferably tabular silver iodide having a high silver iodide content. The average silver iodide content is preferably 40 mol % or higher. It is more preferable that the average silver iodide content is 80 mol % or higher, and it is even more preferable from the standpoint of image storability against irradiation with light after developing process particularly when the average silver iodide content is 90 mol % or higher.

Other components are not particularly limited and can be selected from silver halide such as silver chloride, silver bromide, or the like, and organic silver salts such as silver thiocyanate, silver phosphate, or the like, and particularly, silver bromide and silver chloride are preferable.

The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, a core/shell grain having a twofold to fourfold structure can be used. A core-high-silver iodide-structure which has a high content of silver iodide in the core part, and a shell-high-silver iodide-structure which has a high content of silver iodide in the shell part can also be preferably used. Further, a technique of localizing silver bromide or silver iodide on the surface of a grain as form epitaxial parts can also be preferably used.

The X-ray diffraction method is well known in the art as for the technique of determination of halogen composition in silver halide crystals. The X-ray diffraction method is fully described in "X-Ray Diffraction Method" of Kiso Bunseki Kagaku Kouza (Lecture Series on Basic Analytical Chemistry), No. 24. Normally, an angle of diffraction is measured by the powder method with copper Kβ radiation as a beam source.

The lattice constant a can be calculated from Bragg's equation by finding the angle of diffraction 2θ as follows:

$$2d \sin \theta = \lambda$$

$$d = a/(h^2+k^2+l^2)^{1/2}$$

wherein 2 θ is an angle of diffraction of (hkl) face, λ is a wavelength of X-ray beam used, d is spacing between (hkl) faces. The relation between the halogen composition of silver halide solid solution and the lattice constant a is already known (for example, described in T. H. James, "THE THEORY OF THE PHOTOGRAPHIC PROCESS, FOURTH EDITION" (Macmillan N.Y.). Therefore, the halogen composition can be determined from the lattice constant obtained.

The tabular grain of the invention can assume any of a β phase or a γ phase. The term "β phase" described above means a high silver iodide structure having a wurtzite structure of a hexagonal system and the term "γ phase" means a high silver iodide structure having a zinc blend structure of a cubic crystal system. An average content of γ phase in the present invention is determined by a method presented by C. R. Berry. In the method, an average content of γ phase is calculated from the peak ratio of the intensity owing to γ phase (111) to that owing to β phase (100), (101), (002) in powder X ray diffraction method. Detail description, for example, is described in Physical Review, volume 161 (No. 3), pages 848 to 851 (1967).

Concerning the tabular grains used in the present invention, the distribution of the halogen composition in a host tabular grain may be uniform or the halogen composition may be changed stepwise, or it may be changed continuously.

Further, a silver halide grain having a core/shell structure can be preferably used. Preferred structure is a twofold to fivefold structure and, more preferably, core/shell grain having a twofold to fourfold structure can be used.

A core-high-silver iodide-structure which has a high content of silver iodide in the core part, and a shell-high-silver iodide-structure which has a high content of silver iodide in the shell part can also be preferably used. In order to attain the black and white photothermographic material exhibiting excellent image storability after development and depression of fog increase caused by light exposure, tabular host grains having a higher silver iodide content are preferred, and more preferred are tabular grains having an average silver iodide content of 90 mol % or higher.

2) Grain Shape

The shape of the silver halide grain used for the present invention is preferably in a shape of a tabular grain. In more detail, the grain shapes of silver halide grain are exemplified according to the structure of the crystal side phase, such as a tabular octahedral grain form, a tabular tetradecahedral form, and a tabular icosahedral form. Among them, a tabular octahedral form and a tabular tetradecahedral form are preferably used for the present invention. The term "tabular octahedral form" used herein means a grain having {0001}, {1(−1)00} crystal faces, or a grain having {0001}, {1(−2)10}, {(−1)2(−1)0} faces. The term "tabular tetradecahedral form" means a grain having {0001}, {1(−1)00}, {1(−1)01} faces, a grain having {0001}, {1(−2)10}, {(−1)2(−1)0}, {1(−2)11}, {(−1)2(−1)1} faces, a grain having {0001}, {1(−1)00}, {1(−1)0(−1)} faces or a grain having {0001}, {1(−2)10}, {(−1)9}, {1(−2)1(−1)}, {(−1)2(−1)(−1)} faces. The term "tabular icosahedral grain" means a grain having {0001}, {1(−1)00}, {1(−1)01}, {1(−1)0(−1)} faces, or a grain having {0001}, {1(−2)10}, {(−1)2(−1)0}, {1(−2)11}, {(−1)2(−1)1}, {1(−2)1(−1)}, {(−1)(−1)} faces. Herein, the {0001} face and the like express a family of crystallographic faces equivalent to (0001) face and the like. The tabular silver halide grains having other shape other than the above may also be used preferably.

According to the method of preparing dodecahedral grains, tetradecahedral grains and octahedral grains, the methods described in JP-A Nos. 2002-081020, 2003-287835, and 2003-287836 can be used for reference.

The silver halide having a high silver iodide content of the invention can take a complicated form, and as the preferable form, there are listed, for example, connecting particles as shown in R. L. JENKINS et al., J. of Phot. Sci., vol. 28 (1980), page 164, FIG. 1. Tabular grains as shown in FIG. 1 of the same literature can also be preferably used. A silver halide grain rounded at corners can also be used preferably. The surface indices (Miller indices) of the outer surface of a photosensitive silver halide grain is not particularly restricted, and it is preferable that the ratio occupied by the {100} face is large, because of showing high spectral sensitization efficiency when a spectral sensitizing dye is adsorbed. The ratio is preferably 50% or higher, more preferably, 65% or higher and, even more preferably, 80% or higher. The ratio of the {100} face, Miller indices, can be determined by a method described in T. Tani; J. Imaging Sci., vol. 29, page 165, (1985) utilizing adsorption dependency of the {111} face and {100} face in adsorption of a sensitizing dye.

3) Epitaxial Junction

In the present invention, the tabular grain preferably has an epitaxial junction. The "epitaxy" or "epitaxial" is used in the art as the term to indicate that the silver salt has a crystal form having an orientation controlled by tabular host grains.

In order to form the sensitized sites on a tabular host grain, silver salts formed with epitaxial growth can be applicable. By controlling the sites deposited by the epitaxial growth, a selective local sensitization on tabular host grain can be performed. Accordingly, at one or more regular portions, the sensitization sites can be formed. The "regular" means that the sensitization sites have predictable and orderly relations, preferably mutually, to the major crystal faces of the tabular grains. By controlling the epitaxial deposition to the major crystal faces of the tabular grains, it is possible to control the number and the space between the horizontal directions of the sensitization sites.

According to the present invention, the epitaxial junction portion can be formed onto an apex portion, a major plane or an edge portion of the tabular grains, and more preferably onto the apex portion. The tabular grain has at least one epitaxial junction portion, preferably two or more epitaxial junction portions, and more preferably four or more epitaxial junction portions.

Especially, on at least one part of the major crystal faces of tabular host grain, it is preferred to control silver salt epitaxy, and substantially to exclude the epitaxial deposition. In tabular host grains, an epitaxial deposition of silver salt tends to be formed at least one of an edge portion and a corner portion of grains.

When the epitaxial depositions are restricted on selected portions of tabular grains, the sensitivity is more increased, in comparison with randomly epitaxial growth deposition of silver salts on the major crystal faces of tabular grains. For at least one part of the major crystal faces, no epitaxial deposition of silver salts is formed substantially, and for a selected site, the silver salts is deposited in a limited range. The above range of the deposition can be changed extensively within the scope of this invention. Generally, the lesser the epitaxial coverage on the major crystal faces, the more the sensitivity increases. Silver salts formed by the epitaxial growth are preferably within less than a half, more preferably less than 25%, of the area of the major crystal faces of tabular grains. In the case where the silver salts are formed by epitaxial growth on the corner portion of tabular silver halide grain, they are preferably restricted within less than 10%, more preferably less than 5%, of the area of the major crystal faces. In some embodiments, it is observed that the epitaxial deposition initiates at the site of the edge surface of tabular grains. Accordingly, depending on the condition, the epitaxy is restricted on a selected area of the edge portion, and the epitaxial deposition on the major crystal faces is effectively excluded.

When grains having latent images are completely developed, the site and number of the latent image center can not be determined. However, while obstructing the development process before the expansion of the developed area from the neighborhood of the latent image center, the partial developed sites can be observed clearly by magnifying the partial developed grains. These partial developed sites generally correspond to the latent image centers, and these latent image centers generally correspond to the sensitization sites thereof.

The silver salts formed by epitaxy can be selected from arbitrary silver salts which are generally capable of epitaxial growth on silver halide grains, and known in the art as useful for photographic use. Especially, the silver salts are preferably selected from those known in the photographic art as effective for shell formation in core-shell type-silver halide grains. Besides useful silver halides known in the photographic chemical use, examples of preferred silver salt, which are known to deposit on silver halide grains, include silver thiocyanate, silver cyanate, silver carbonate, silver ferricyanate, silver arsenate, silver arsenite, silver chromate, and mixtures thereof. Among them, preferred are silver chloride, silver bromide, silver thicyanate, and mixtures thereof. Particularly preferred is a silver salt including at least silver bromide.

4) Grain Size

Concerning the grain size of the photosensitive silver halide according to the present invention, there exist two preferable types.

In one preferable type is a fine grain type. The grain size of the silver halide is preferably 0.20 μm or less, more preferably in a range of from 0.01 μm to 0.15 μm, and even more preferably in a range of from 0.02 μm to 0.12 μm. The term "grain size" used herein means an average diameter of a circle converted such that it has a same area as a projected area of the silver halide grain (projected area of a major plane in a case of a tabular grain).

The another preferable type includes tabular grains having a mean aspect ratio of 2 or more, and more preferably tabular grains having a mean aspect ratio of 5 or more. The mean equivalent spherical diameter of the tabular silver halide grains is preferably from 0.3 μm to 8 μm, and more preferably from 0.5 μm to 5 μm. The term "mean equivalent spherical diameter" used here means an average diameter of a sphere having the same volume as the volume of silver halide grain.

A mean grain thickness of the tabular silver halide according to the invention is preferably 0.3 μm or less, more preferably 0.2 μm or less, and even more preferably 0.1 μm or less.

5) Coating Amount

Generally, in the case of photothermographic material where silver halide is remained thereon after thermal development, the coating amount of silver halide is limited to a lower level in spite of the requirement for high sensitivity. It is because the increase of the coating amount of silver halide may result in decreasing the film transparency and deteriorating the image quality. However, according to the present invention, more amount of silver halide can be coated because thermal development can decrease the haze of film caused by the residual silver halide. In the present invention, the preferred coating amount is in a range from 0.5 mol % to 100 mol %, per 1 mol of silver salt of a fatty acid, and more preferably from 5 mol % to 50 mol %.

6) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with a silver salt of a fatty acid is used. Further, a method described in JP-A No. 11-119374 (paragraph Nos. 0217 to 0224) and methods described in JP-A Nos. 11-352627 and 2000-347335 are also preferred.

As for the method of forming tabular grains of silver iodide, the methods described in JP-A Nos. 59-119350 and 59-119344 are preferably used.

7) Heavy Metal

The photosensitive silver halide grain of the invention can contain metals or complexes of metals belonging to groups 6 to 13 of the periodic table (showing groups 1 to 18). Preferred are metals or complexes of metals belonging to groups 6 to 10. The metal or the center metal of the metal complex from groups 6 to 10 of the periodic table is preferably ferrum, rhodium, ruthenium, or iridium. The metal complex may be used alone, or two or more complexes comprising identical or different species of metals may be used together. A preferred content is in a range of from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain containing a hexacyano metal complex is preferred. Examples of the hexacyano metal complex includes $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$.

The hexacyano metal complex can be added while being mixed with water, as well as a mixed solvent of water and an appropriate organic solvent miscible with water (for example, alcohols, ethers, glycols, ketones, esters, amides, or the like) or gelatin.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No.11-84574, in paragraph Nos. 0025 to 0031 of JP-A No.11-65021, and paragraph Nos. 0242 to 0250 of JP-A No. 11-119374.

8) Gelatin

As the gelatin contained the photosensitive silver halide emulsion used in the invention, various gelatins can be used. It is necessary to maintain an excellent dispersion state of a photosensitive silver halide emulsion in a coating solution containing a silver salt of a fatty acid, and gelatin having a low molecular weight of 500 to 60,000 is preferably used. These gelatins having a low molecular weight may be used at grain formation step or at the time of dispersion after desalting treatment and it is preferably used at the time of dispersion after desalting treatment.

9) Chemical Sensitization

The photosensitive silver halide in the present invention may be used without chemical sensitization, but is preferably chemically sensitized by at least one of chalcogen sensitizing method, gold sensitizing method and reduction sensitizing method. The chalcogen sensitizing method includes sulfur sensitizing method, selenium sensitizing method, and tellurium sensitizing method.

In sulfur sensitization, unstable sulfur compounds can be used. Such unstable sulfur compounds are described in Chemie et Pysique Photographique, written by P. Grafkides, (Paul Momtel, 5th ed., 1987) and Research Disclosure (vol. 307, Item 307105), and the like.

As typical examples of sulfur sensitizer, known sulfur compounds such as thiosulfates (e.g., hypo), thioureas (e.g., diphenylthiourea, triethylthiourea, N-ethyl-N'-(4-methyl-2-thiazolyl)thiourea and carboxymethyltrimethylthiourea), thioamides (e.g., thioacetamide), rhodanines (e.g., diethylrhodanine, 5-benzylydene-N-ethylrhodanine), phosphinesulfides (e.g., trimethylphosphinesulfide), thiohydantoins, 4-oxo-oxazolidin-2-thione derivatives, disulfides or polysulfides (e.g., dimorphorinedisulfide, cystine, hexathiocanthione), polythionates, sulfur element, and active gelatin can be used. Specifically, thiosulfates, thioureas, and rhodanines are preferred.

In selenium sensitization, unstable selenium compounds can be used. These unstable selenium compounds are described in JP-B Nos. 43-13489 and 44-15748, JP-A Nos. 4-25832, 4-109340, 4-271341, 5-40324, 5-11385, 6-51415, 6-175258, 6-180478, 6-208186, 6-208184, 6-317867, 7-92599, 7-98483, and 7-140579, and the like.

As typical examples of selenium sensitizer, colloidal metal selenide, selenoureas (e.g., N,N-dimethylselenourea, trifluoromethylcarbonyl-trimethylselenourea and acetyltrimethylselemourea), selenamides (e.g., selenamide and N,N-diethylphenylselenamide), phosphineselenides (e.g., triphenylphosphineselenide and pentafluorophenyltriphenylphosphineselenide), selenophosphates (e.g., tri-p-tolylselenophosphate and tri-n-butylselenophosphate), selenoketones (e.g., selenobenzophenone), isoselenocyanates, selenocarbonic acids, selenoesters, and diacylselenides may be used.

Furthermore, non-unstable selenium compounds such as selenius acid, selenocyanic acid, selenazoles, and selenides, and the like described in JP-B Nos. 46-4553 and 52-34492 can also be used. Specifically, phosphineselenides, selenoureas, and salts of selenocyanic acids are preferred.

In the tellurium sensitization, unstable tellurium compounds are used. Unstable tellurium compounds described in JP-A Nos.4-224595, 4-271341, 4-333043, 5-303157, 6-27573, 6-175258, 6-180478, 6-208186, 6-208184, 6-317867, 7-140579, 7-301879, and 7-301880, and the like, can be used as tellurium sensitizer.

As typical examples of tellurium sensitizer, phosphinetellurides (e.g., butyl-diisopropylphosphinetelluride, tributylphosphinetelluride, tributoxyphosphinetelluride, and ethoxy-diphenylphosphinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)ditelluride, bis(N-phenyl-N-benzylcarbamoyl)telluride, and bis(ethoxycarbonyl)telluride), telluroureas (e.g., N,N'-dimethylethylenetellurourea and N,N'-diphenylethylenetellurourea), telluroamides, telluroesters, and the like are used. Specifically, diacyl(di)tellurides and phosphinetellurides are preferred. Especially, the compounds described in paragraph No. 0030 of JP-A No. 11-65021 and compounds represented by formula (II), (III), or (IV) in JP-A No. 5-313284 are more preferred.

Specifically, as for the chalcogen sensitization of the invention, selenium sensitization and tellurium sensitization are preferred, and tellurium sensitization is particularly preferred.

In gold sensitization, gold sensitizer described in Chemie et Physique Photographique, written by P. Grafkides, (Paul Momtel, 5th ed., 1987) and Research Disclosure (vol. 307, Item 307105) can be used. To speak concretely, chloroauric acid, potassium chloroaurate, potassium aurithiocyanate, gold sulfide, gold selenide and the like can be used. In addition to these, the gold compounds described in U.S. Pat. Nos. 2,642,361, 5,049,484, 5,049,485, 5,169,751, and 5,252,455, Belgium Patent No. 691,857, and the like can also be used. And another novel metal salts other than gold such as platinum, palladium, iridium and the like, which are described in Chemie et Pysique Photographique, written by P. Grafkides, (Paul Momtel, 5th ed., 1987) and Research Disclosure (vol. 307, Item 307105), can be used.

The gold sensitization can be used independently, but it is preferably used in combination with the above chalcogen sensitization. Specifically, these sensitizations are gold-sulfur sensitization (gold-plus-sulfur sensitization), gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, chemical sensitization can be applied in the presence of silver halide solvent. Specifically, thiocyanates (e.g., potassium thiocyanate), thioethers (e.g., compounds described in U.S. Pat. Nos. 3,021,215 and 3,271,157, JP-B No. 58-30571, and JP-A No. 60-136736, especially, 3,6-dithia-1,8-octanediol), tetra-substituted thioureas (e.g., compounds described in JP-B No. 59-11892 and U.S. Pat. No. 4,221,863, especially, tetramethylthiourea), thione compounds described in JP-B No. 60-11341, mercapto compounds described in JP-B No. 63-29727, mesoionic compounds described in JP-A No. 60-163042, selenoethers described U.S. Pat. No. 4,782,013, telluroether compounds described in JP-A No. 2-118566, and sulfites can be described. Among them, thiocyanates, thioethers, tetra-substituted thioureas, and thione compounds are preferable. Particularly among them, preferred is thiocyanate, and it is preferred to use water-soluble thiocyanate (for example, potassium thiocyanate, sodium thiocyanate, ammonium thiocyanate, or the like). The addition amount can be selected arbitrary, but preferably, it is $1\times10^{-4}$ mol or more, more preferably $1\times10^{-3}$ mol or more, even more preferably in a range of from $2\times10^{-3}$ mol to $8\times10^{-1}$ mol, further preferably from $3\times10^{-3}$ mol to $2\times10^{-1}$ mol, and particularly preferably from $5\times10^{-3}$ mol to $1\times10^{-1}$ mol, per 1 mol of silver halide in each case.

Further, the black and white photothermographic material of the present invention particularly preferably contains a water-soluble thiocyanate in an amount of from $1\times10^{-3}$ mol to $8\times10^{-1}$ mol, per 1 mol of silver halide.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just before coating, or the like.

The amount of chalcogen sensitizer used in the invention may vary depending on the silver halide grain used, the chemical ripening condition, or the like and it is used by about $10^{-8}$ mol to $10^{-1}$ mol, preferably, $10^{-7}$ mol to $10^{-2}$ mol, per 1 mol of silver halide.

The addition amount of the gold sensitizer may vary depending on various conditions and it is generally from $10^{-7}$ mol to $10^{-2}$ mol and, preferably from $10^{-6}$ mol to $5\times10^{-3}$ mol, per 1 mol of silver halide. There is no particular restriction on the condition for the chemical sensitization and, appropriately, the pAg is 8 or lower, preferably, 7.0 or lower, more preferably, 6.5 or lower and, particularly preferably, 6.0 or lower, and the pAg is 1.5 or higher, preferably, 2.0 or higher and, particularly preferably, 2.5 or higher; the pH is from 3 to 10, and preferably, from 4 to 9; and the temperature is from 20° C. to 95° C., and preferably, from 25° C. to 80° C.

In the invention, reduction sensitization can also be used in combination with the chalcogen sensitization or the gold sensitization. It is specifically preferred to use in combination with the chalcogen sensitization. As the specific compound for the reduction sensitization, ascorbic acid, thiourea dioxide, or dimethylamine borane is preferred, as well as use of stannous chloride, aminoimino methane sulfonic acid, hydrazine derivatives, borane compounds, silane compounds, polyamine compounds, and the like are preferred. The reduction sensitizer may be added at any stage in the photosensitive emulsion production process from crystal growth to the preparation step just before coating. Further, it is preferred to apply reduction sensitization by ripening while keeping the pH to 8 or higher and the pAg to 4 or lower for the emulsion, and it is also preferred to apply reduction sensitization by introducing a single addition portion of silver ions during grain formation.

The addition amount of the reduction sensitizer may also vary depending on various conditions and it is generally about $10^{-7}$ mol to $10^{-1}$ mol and, more preferably, $10^{-6}$ mol to $5\times10^{-2}$ mol per 1 mol of silver halide.

In the silver halide emulsion used in the invention, a thiosulfonate compound may be added by the method shown in EP-A No. 293,917.

The photosensitive silver halide grain in the invention is preferably chemically sensitized by at least one method of gold sensitizing method and chalcogen sensitizing method for the purpose of designing a high-sensitivity black and white photothermographic material.

10) Compound that is one-electron-oxidized to provide a one-electron oxidation product which releases one or more electrons The black and white photothermographic material of the present invention preferably contains a compound that is one-electron-oxidized to provide a one-electron oxidation product which releases one or more electrons. The said compound can be used alone or in combination with various chemical sensitizers described above to increase the sensitivity of silver halide.

As the compound that is one-electron-oxidized to provide a one-electron oxidation product which releases one or more electrons, which is contained in the black and white photothermographic material of the invention, is preferably a compound selected from the following Groups 1 or 2:

(Group 1) a compound that is one-electron-oxidized to provide a one-electron oxidation product which further releases one or more electrons, due to being subjected to a subsequent bond cleavage reaction;

(Group 2) a compound that is one-electron-oxidized to provide a one-electron oxidation product, which further releases one or more electrons after being subjected to a subsequent bond formation reaction.

The compound of Group 1 will be explained below.

In the compound of Group 1, as a compound that is one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc. Preferred ranges of these compounds are the same as the preferred ranges described in the quoted specifications.

In the compound of Group 1, as a compound that is one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8) (same as formula (1) described in JP-A No. 2004-239943), and the compound represented by formula (9) (same as formula (3) described in JP-A No. 2004-245929) among the compounds which can undergo the chemical reaction represented by chemical reaction formula (1) (same as chemical reaction formula (1) described in JP-A No. 2004-245929).

Preferable ranges of these compounds are the same as the preferable ranges described in the quoted specifications.

Formula (1)

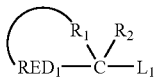

Formula (2)

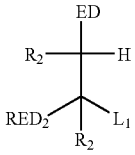

Formula (3)

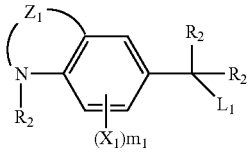

Formula (4)

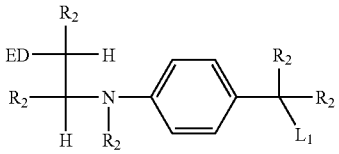

Formula (5)

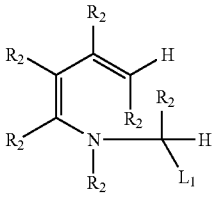

Formula (6)

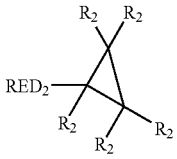

Formula (7)

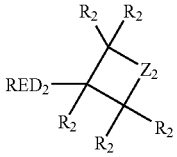

Formula (8)

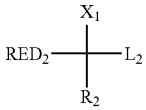

-continued

Formula (9)

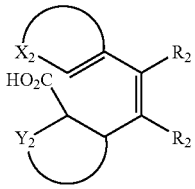

In the formulae, $RED_1$ and $RED_2$ represent a reducing group. $R_1$ represents a nonmetallic atomic group forming a cyclic structure equivalent to a tetrahydro derivative or an octahydro derivative of a 5- or 6-membered aromatic ring (including a hetero aromatic ring) with a carbon atom (C) and $RED_1$. $R_2$ represents a hydrogen atom or a substituent. In the case where plural $R_2$s exist in a same molecule, these may be identical or different from each other. $L_1$ represents a leaving group. ED represents an electron-donating group. $Z_1$ represents an atomic group which forms a 6-membered ring with a nitrogen atom and two carbon atoms of a benzene ring. $X_1$ represents a substituent, and ml represents an integer of from 0 to 3. $Z_2$ represents one selected from —$CR_{11}R_{12}$—, —$NR_{13}$—, or —O—. $R_{11}$ and $R_{12}$ each independently represent a hydrogen atom or a substituent. $R_{13}$ represents one selected from a hydrogen atom, an alkyl group, an aryl group, or a heterocyclic group. $X_1$ represents one selected from an alkoxy group, an aryloxy group, a heterocyclic oxy group, an alkylthio group, an arylthio group, a heterocyclic thio group, an alkylamino group, an arylamino group, or a heterocyclic amino group. $L_2$ represents a carboxy group or a salt thereof, or a hydrogen atom. $X_2$ represents a group which forms a 5-membered heterocycle with C═C. $Y_2$ represents a group which forms a 5-membered aryl group or heterocyclic group with C═C. M represents one selected from a radical, a radical cation, or a cation.

Next, the compound of Group 2 is explained.

In the compound of Group 2, as a compound that is one-electron-oxidized to provide a one-electron oxidation product which further releases one or more electrons, after being subjected to a subsequent bond cleavage reaction, specific examples include the compound represented by formula (10) (same as formula (1) described in JP-A No. 2003-140287), and the compound represented by formula (11) (same as formula (2) described in JP-A No. 2004-245929) which can undergo the chemical reaction represented by reaction formula (1) (same as chemical reaction formula (1) described in JP-A No. 2004-245929). Preferable ranges of these compounds are the same as the preferable ranges described in the quoted specifications.

Formula (10)

$RED_6$—Q—Y

Reaction formula (1)

Reaction formula (1)

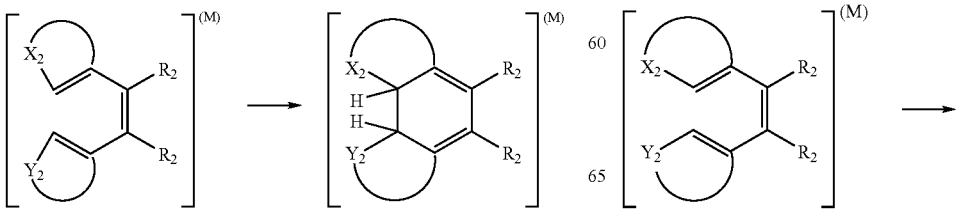

-continued

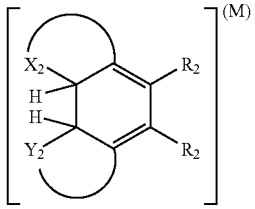

(M)

Formula (11)

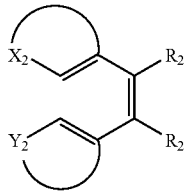

In the formulae described above, X represents a reducing group which is one-electron-oxidized. Y represents a reactive group containing a carbon-carbon double bond part, a carbon-carbon triple bond part, an aromatic group part or benzo-condensed non-aromatic heterocyclic group which reacts with one-electron-oxidized product formed by one-electron-oxidation of X to form a new bond. $L_2$ represents a linking group to link X and Y. $R_2$ represents a hydrogen atom or a substituent. In the case where plural $R_2$s exist in a same molecule, these may be identical or different from one another.

$X_2$ represents a group which forms a 5-membered heterocycle with C═C. $Y_2$ represents a group which forms a 5- or 6-membered aryl group or heterocyclic group with C═C. M represents one selected from a radical, a radical cation, or a cation.

The compounds of Groups 1 or 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from one another.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having an —NH— group which forms silver iminate (—N(Ag)—), as a partial structure of heterocycle (e.g., a benzotriazole group, a benzimidazole group, an indazole group, or the like) are described. A 5-mercaptotetrazole group, a 3-mercapto-1,2,4-triazole group and a benzotriazole group are particularly preferable, and a 3-mercapto-1,2,4-triazole group and a 5-mercaptotetrazole group are most preferable.

As the adsorptive group, the group which has two or more mercapto groups as a partial structure in a molecule is also particularly preferable. Herein, a mercapto group (-SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group and a 3,5-dimercapto-1,2,4-triazole group.

Further, a quaternary salt structure of nitrogen or phosphorus is also preferably used as the adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5- or 6-membered aromatic heterocyclic group containing a quaternary nitrogen atom is further preferably used. Particularly preferably, a pyrydinio group, a quinolinio group and an isoquinolinio group are used.

These nitrogen-containing heterocyclic groups containing a quaternary nitrogen atom may have any substituent.

Examples of counter anions of quaternary salt include a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion, and methanesulfonate ion are particularly preferable.

The preferred structure of the compound represented by Groups 1 or 2 having a quaternary salt of nitrogen or phosphorus as an adsorptive group is represented by formula (X).

$$(P—Q_1—)_i—R(—Q_2—S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$—, —C(═O)—, —$SO_2$—, —SO—, —P(═O)— or combinations of these groups. Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 or 2 may be used at any time during preparation of the photosensitive silver halide emulsion and production of the black and white photothermographic material. For example, the compound may be used in a photosensitive silver halide grain formation step, in a desalting step, in a chemical sensitization step, before coating, or the like. The compound may be added in several times during these steps. The compound is preferably added after the photosensitive silver halide grain formation step and before the desalting step; at the chemical sensitization step (just before the chemical sensitization to immediately after the chemical sensitization); or before coating. The compound is more preferably added from at the chemical sensitization step to before being mixed with the silver salt of a fatty acid.

It is preferred that the compound of Groups 1 or 2 according to the invention is dissolved in water, a water-soluble solvent such as methanol or ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer which contains the photosensitive silver halide and the silver salt of a fatty acid. The compound may be added to a surface protective layer, or an intermediate layer, as well as the image forming layer containing the photosensitive silver halide and the silver salt of a fatty acid, to be diffused to the image forming layer at the coating step. The compound may be added before or after addition of a sensitizing dye. Each compound is contained in the image forming layer preferably in an amount of from $1\times10^{-9}$ mol to $5\times10^{-1}$ mol, more preferably from $1\times10^{-8}$ mol to $5\times10^{-2}$ mol, per 1 mol of silver halide.

11) Compound Having Adsorptive Group and Reducing Group

The black and white photothermographic material of the present invention preferably contains a compound having an adsorptive group to silver halide and a reducing group in a molecule. It is preferred that the compound is represented by the following formula (Rd).

A—(W)n—B Formula (Rd)

In formula (Rd), A represents a group which adsorbs to a silver halide (hereafter, it is called an adsorptive group); W represents a divalent linking group; n represents 0 or 1; and B represents a reducing group.

In formula (Rd), an adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group (or the salt thereof) as the adsorptive group means a mercapto group (or a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or non-aromatic heterocyclic group having at least a 5- to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described.

A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; or the like.

Further, the mercapto group as the adsorptive group may become a thione group by a tautomerization. The thione group used as the adsorptive group also includes a linear or cyclic thioamide group, thioureido group, thiourethane group, and dithiocarbamate ester group.

The heterocyclic group, as the adsorptive group, which contains at least one atom selected from a nitrogen atom, a sulfur atom, a selenium atom, or a tellurium atom represents a nitrogen-containing heterocyclic group having —NH— group, which forms silver iminate (—N(Ag)—), as a partial structure of a heterocycle, or a heterocyclic group having an —S— group, a —Se— group, a —Te— group, or a ═N— group, which coordinates to a silver ion by a coordination bond, as a partial structure of a heterocycle. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, a benzotellurazole group, and the like are described.

The sulfide group or disulfide group as the adsorptive group contains all groups having "—S—" or "—S—S—" as a partial structure.

The cationic group as the adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described. The ethynyl group as the adsorptive group means —C≡CH group and the said hydrogen atom may be substituted.

The adsorptive group described above may have any substituent.

Further, as typical examples of the adsorptive group, the compounds described in pages 4 to 7 in the specification of JP-A No. 11-95355 are described.

As the adsorptive group represented by A in formula (Rd), a heterocyclic group substituted by a mercapto group (for example, a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen atom containing heterocyclic group having an —NH— group which forms silver iminate (—N(Ag)—) as a partial structure of heterocycle (for example, a benzotriazole group, a benzimidazole group, an indazole group, or the like) are preferable, and more preferable as the adsorptive group are a 2-mercaptobenzimidazole group and a 3,5-dimercapto-1,2,4-triazole group.

In formula (Rd), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (for example, a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (for example, a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (Rd), a reducing group represented by B represents the group which reduces a silver ion. As the examples, a formyl group, an amino group, a triple bond group such as an acetylene group, a propargyl group and the like, a mercapto group, and residues which are obtained by removing one hydrogen atom from hydroxyamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like are described. They may have any substituent.

The oxidation potential of a reducing group represented by B in formula (Rd) can be measured by using the measuring method described in Akira Fujishima, "DENKIKAGAKU SOKUTEIHO", pages 150 to 208, GIHODO SHUPPAN and The Chemical Society of Japan, "JIKKEN KAGAKUKOZA", 4th ed., vol. 9, pages 282 to 344, MARUZEN. For example, the method of rotating disc voltammetry can be used; namely the sample is dissolved in the solution (methanol : pH 6.5 Britton-Robinson buffer=10%: 90% (% by volume)) and after bubbling with nitrogen gas during 10 minutes the voltamograph can be measured under the conditions of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducing group represented by B in the present invention is measured by the method described above, an oxidation potential is preferably in a range of from about −0.3 V to about 1.0 V, more preferably from about −0.1 V to about 0.8 V, and particularly preferably from about 0 V to about 0.7 V.

In formula (Rd), a reducing group represented by B is preferably a residue which is obtained by removing one hydrogen atom from hydroxyamines, hydroxamic acids, hydroxyureas, hydroxysemicarbazides, reductones, phenols, acylhydrazines, carbamoylhydrazines, or 3-pyrazolidones.

The compound of formula (Rd) according to the present invention may have a ballast group or a polymer chain, which are generally used in non-moving photographic additives for a coupler or the like, in it. And as a polymer, for example, the polymer described in JP-A No. 1-100530 is selected.

The compound of formula (Rd) according to the present invention may be bis or tris type of compound. The molecular weight of the compound represented by formula (Rd) according to the present invention is preferably from 100 to 10000, more preferably from 120 to 1000, and particularly preferably from 150 to 500.

The examples of the compound represented by formula (Rd) according to the present invention are shown below, but the present invention is not limited in these.

(1)

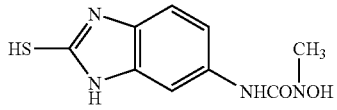

(2)

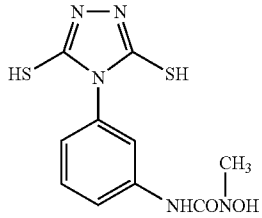

(3)

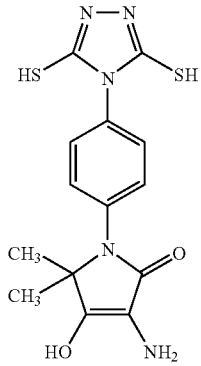

(4)

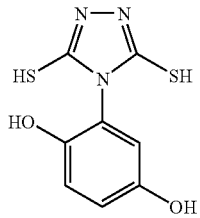

(5)

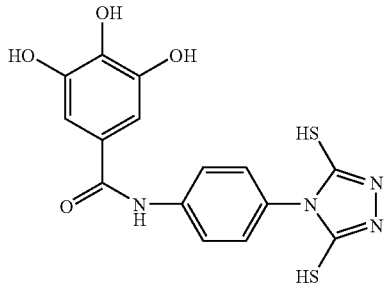

-continued (6)

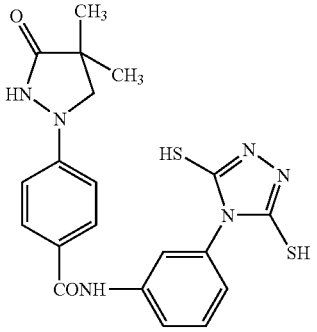

(7)

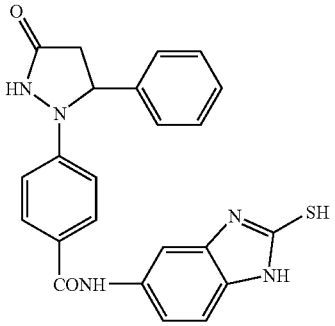

(8)

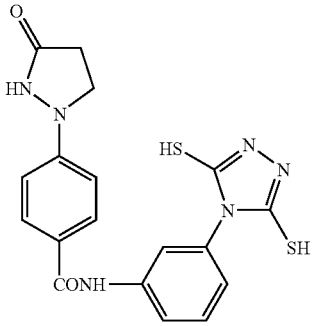

(9)

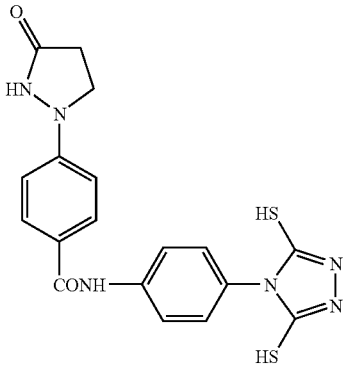

-continued (10)

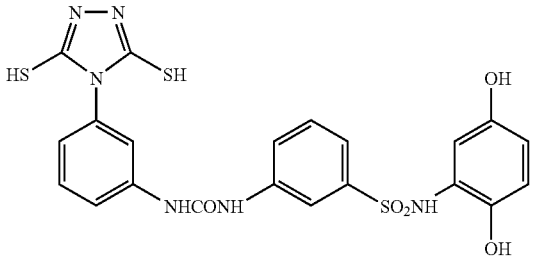

(11)

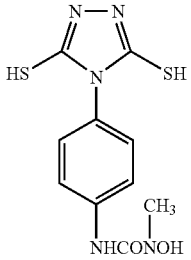

(12)

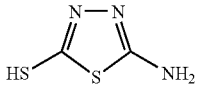

(13)

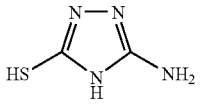

Further, example compounds 1 to 30 and 1"-1 to 1"-77 shown in EP No. 1308776A2, pages 73 to 87 are also described as preferable examples of the compound having an adsorptive group and a reducing group according to the invention.

These compounds can be easily synthesized by any known method. The compound of formula (Rd) according to the present invention can be used alone, but it is preferred to use two or more of the compounds in combination. When two or more of the compounds are used in combination, those may be added to the same layer or the different layers, whereby adding methods may be different from each other.

The compound represented by formula (Rd) according to the present invention is preferably added to an image forming layer and more preferably, is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound can be added in several times during these steps. It is preferred to be added in the image forming layer. But the compound may be added to a surface protective layer or an intermediate layer, in combination with its addition to the image forming layer, to be diffused to the image forming layer at the coating step.

The preferred addition amount is largely dependent on the adding method described above or the compound, but generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (Rd) according to the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds can be added as an emulsified dispersion by dissolving them in an organic solvent having a high boiling point and also can be added as a solid dispersion.

12) Sensitizing Dye

As the sensitizing dye applicable in the invention, those which spectrally sensitizes the silver halide grains in a desired wavelength region upon adsorption to the silver halide grains having spectral sensitivity suitable to the spectral characteristic of an exposure light source can be advantageously selected. It is particularly preferred that the black and white photothermographic material of the present invention is spectrally sensitized so that it has a spectral sensitivity peak in the region of from 600 nm to 900 nm or from 300 nm to 500 nm. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 803,764A1, and in JP-A Nos. 2001-272747, 2001-290238 and 2002-23306, and the like. The sensitizing dye may be used alone or two or more of them may be used in combination.

In the invention, the sensitizing dye may be added at any amount according to the property of sensitivity and fogging, but it is preferably added in an amount of from $10^{-6}$ mol to 1 mol, and more preferably from $10^{-4}$ mol to $10^{-1}$ mol, per 1 mol of silver halide in the image forming layer.

The black and white photothermographic material of the invention can contain super sensitizers in order to improve the spectral sensitizing effect. The super sensitizers usable in the invention can include those compounds described in EP-A No. 587338, U.S. Pat. Nos. 3,877,943 and 4,873,184, JP-A Nos. 5-341432, 11-109547, and 10-111543, and the like.

13) Combined Use of Silver Halides

The photosensitive silver halide emulsion in the black and white photothermographic material used in the invention may be used alone, or two or more of them (for example, those having different average particle sizes, different halogen compositions, different crystal habits, or different conditions for chemical sensitization) may be used together. Gradation can be controlled by using plural photosensitive silver halides having different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

14) Mixing Silver Halide and Silver Salt of Fatty Acid

The photosensitive silver halide in the invention is particularly preferably formed in the absence of the silver salt of a fatty acid and chemically sensitized. This is because sometimes sufficient sensitivity can not be attained by the method of forming the silver halide by adding a halogenating agent to a silver salt of a fatty acid.

The method of mixing the silver halide and the silver salt of a fatty acid can include a method of mixing a separately prepared photosensitive silver halide and a silver salt of a fatty acid by a high speed stirrer, ball mill, sand mill, colloid mill, vibration mill, homogenizer, or the like, or a method of mixing a photosensitive silver halide completed for preparation at any timing in the preparation of a silver salt of a fatty acid and preparing the silver salt of a fatty acid. The effect of the invention can be obtained preferably by any of the methods described above.

15) Mixing Silver Halide Into Coating Solution

In the invention, the time of adding silver halide to the coating solution for the image forming layer is preferably in a range of from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Compound Which Substantially Reduces Visible Light Absorption by Photosensitive Silver Halide After Thermal Development)

In the present invention, it is preferred that the black and white photothermographic material contains a compound which substantially reduces visible light absorption by photosensitive silver halide after thermal development relative to that before thermal development.

In the present invention, it is particularly preferred that a silver iodide complex-forming agent is used as the compound which substantially reduces visible light absorption by photosensitive silver halide after thermal development.

<Silver Iodide Complex-Forming Agent>

Concerning the silver iodide complex-forming agent according to the present invention, at least one of a nitrogen atom and a sulfur atom in the compound can contribute to a Lewis acid-base reaction which gives an electron to a silver ion, as a ligand atom (electron donor: Lewis base). The stability of the complex is defined by successive stability constant or total stability constant, but it depends on the combination of silver ion, iodo ion, and the silver complex forming agent. As a general guide, it is possible to obtain a large stability constant by a chelate effect from intramolecular chelate ring formation, by means of increasing the acid-base dissociation constant or the like.

In the present invention, the ultra violet-visible light absorption spectrum of the photosensitive silver halide can be measured by a transmission method or a reflection method. When the absorption derived from other compounds added to the black and white photothermographic material overlaps with the absorption of photosensitive silver halide, the ultra violet-visible light absorption spectrum of photosensitive silver halide can be observed by using, independently or in combination, the means of difference spectrum or removal of other compounds by solvent, or the like.

As a silver iodide complex-forming agent according to the present invention, a 5- to 7-membered heterocyclic compound containing at least one nitrogen atom is preferable. In the case where the compound does not have a mercapto group, a sulfide group, or a thione group as a substituent, the said nitrogen containing 5- to 7-membered heterocycle may be saturated or unsaturated, and may have another substituent. The substituent on a heterocycle may bond to each other to form a ring.

As preferable examples of 5- to 7-membered heterocyclic compounds, pyrrole, pyridine, oxazole, isooxazole, thiazole, isothiazole, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, naphthylizine, purine, pterizine, carbazole, acridine, phenanthoridine, phenanthroline, phenazine, phenoxazine, phenothiazine, benzothiazole, benzoxazole, 1,2,4-triazine, 1,3,5-triazine, pyrrolidine, imidazolidine, pyrazolidine, piperidine, piperazine, morpholine, indoline, isoindoline, and the like are described.

More preferably, pyridine, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, 1,8-naphthylizine, 1,10-phenanthroline, benzotriazole, 1,2,4-triazine, 1,3,5-triazine, and the like can be described. Particularly preferably, pyridine, imidazole, pyrazine, pyrimidine, pyridazine, phthalazine, triazine, 1,8-naphthylizine, 1,10-phenanthroline, and the like are described.

These rings may have a substituent and any substituent can be used as far as it does not negatively impact the photographic property. As preferable examples, a halogen atom (fluorine atom, chlorine atom, bromine atom, or iodine atom), an alkyl group (a straight, a branched, a cyclic alkyl group containing a bicycloalkyl group and an active methine group), an alkenyl group, an alkynyl group, an aryl group, a heterocyclic group (substituted position is not asked), an acyl group, an alkoxycarbonyl group, an aryloxycarbonyl group, a heterocyclic oxycarbonyl group, a carbamoyl group, an N-acylcarbamoyl group, an N-sulfonylcarbamoyl group, an N-carbamoylcarbamoyl group, an N-sulfamoylcarbamoyl group, a carbazoyl group, a carboxyl group and a salt thereof, an oxalyl group, an oxamoyl group, a cyano group, a carbonimidoyl group, a formyl group, a hydroxy group, an alkoxy group (including the group in which ethylene oxy group units or propylene oxy group units are repeated), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, a heterocyclic amino group, an acylamino group, a sulfonamide group, a ureido group, a thioureido group, an imide group, an alkoxycarbonylamino group, an aryloxycarbonylamino group, a sulfamoylamino group, a semicarbazide group, an ammonio group, an oxamoylamino group, an N-alkylsulfonylureido group, an N-arylsulfonylureido group, an N-acylureido group, an N-acylsulfamoylamino group, a nitro group, a heterocyclic group containing a quaternary nitrogen atom (e.g., a pyridinio group, an imidazolio group, a quinolinio group, or an isoquinolinio group), an isocyano group, an imino group, an alkylsulfonyl group, an arylsulfonyl group, an alkylsulfinyl group, an arylsulfinyl group, a sulfo group and a salt thereof, a sulfamoyl group, an N-acylsulfamoyl group, an N-sulfonylsulfamoyl group and a salt thereof, a phosphino group, a phosphinyl group, a phosphinyloxy group, a phosphinylamino group, a silyl group, and the like are described. Here, an active methine group means a methine group substituted by two electron-attracting groups, wherein the electron-attracting group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, a carbonimidoyl group.

Herein, two electron-attracting groups may bond to each other to form a cyclic structure. And, the salt means a salt formed with positive ion such as an alkaline metal, an alkaline earth metal, a heavy metal, or the like, or organic positive ion such as an ammonium ion, a phosphonium ion, or the like. These substituents may be further substituted by these substituents.

These heterocycles may be further condensed by another ring. In the case where the substituent is an anion group (e.g., $—CO_2^-$, $-SO_3^-$, $—S^-$, or the like), the heterocycle containing nitrogen atom of the invention may become a positive ion (e.g., pyridinium, 1,2,4-triazolium, or the like) and may form an intramolecular salt.

In the case where a heterocyclic compound is pyridine, pyrazine, pyrimidine, pyridazine, phthalazine, triazine, naphthilizine, or phenanthroline derivative, the acid dissociation constant (pKa) of a conjugated acid of nitrogen containing heterocyclic part in acid dissociation equilibrium of the said compound is preferably from 3 to 8 in the mixture solution of tetrahydrofuran/water (3/2) at 25° C., and more preferably, the pKa is from 4 to 7.

As the heterocyclic compound, pyridine, pyridazine, and a phthalazine derivative are preferable, and particularly preferable are pyridine and a phthalazine derivative.

In the case where these heterocyclic compounds have a mercapto group, a sulfide group, or a thione group as the substituent, pyridine, thiazole, isothiazole, oxazole, isoxazole, imidazole, pyrazole, pyrazine, pyrimidine, pyridazine, triazine, triazole, thiadiazole, and oxadiazole derivatives are preferable, and thiazole, imidazole, pyrazole, pyrazine, pyrimidine, pyridazine, triazine, and triazole derivatives are particularly preferable.

For example, as the said silver iodide complex-forming agent, the compound represented by the following formulae (1) or (2) can be used.

Formula (1)

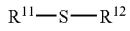

Formula (2)

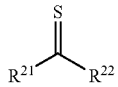

In formula (1), $R^{11}$ and $R^{12}$ each independently represent a hydrogen atom or a substituent. In formula (2), $R^{21}$ and $R^{22}$ each independently represent a hydrogen atom or a substituent. However, both of $R^{11}$ and $R^{12}$ are not simultaneously a hydrogen atom and both of $R^{21}$ and $R^{22}$ are not simultaneously a hydrogen atom. As the substituent herein, the substituent explained as the substituent of a 5- to 7-membered nitrogen containing heterocyclic type silver iodide complex-forming agent mentioned above can be described.

Further, the compound represented by formula (3) described below can also be used preferably.

Formula (3)

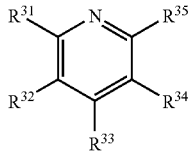

In formula (3), $R^{31}$ to $R^{35}$ each independently represent a hydrogen atom or a substituent. As the substituent represented by $R^{31}$ to $R^{35}$, the substituent of a 5- to 7-membered nitrogen containing heterocyclic type silver iodide complex-forming agent mentioned above can be used. In the case where the compound represented by formula (3) has a substituent, preferred substituting position is $R^{32}$ to $R^{34}$. $R^{31}$ to $R^{35}$ may bond to each other to form a saturated or an unsaturated ring. A preferred substituent is a halogen atom, an alkyl group, an aryl group, a carbamoyl group, a hydroxy group, an alkoxy group, an aryloxy group, a carbamoyloxy group, an amino group, an acylamino group, a ureido group, an alkoxycarbonylamino group, an aryloxycarbonylamino group, or the like.

In the compound represented by formula (3), the acid dissociation constant (pKa) of conjugated acid of pyridine ring part is preferably from 3 to 8 in the mixed solution of tetrahydrofuran/water (3/2) at 25° C., and particularly preferably, from 4 to 7.

Furthermore, the compound represented by formula (4) is also preferable.

Formula (4)

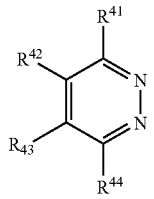

In formula (4), $R^{41}$ to $R^{44}$ each independently represent a hydrogen atom or a substituent. $R^{41}$ to $R^{44}$ may bond to each other to form a saturated or an unsaturated ring. As the substituent represented by $R^{41}$ to $R^{44}$, the substituent of a 5- to 7-membered nitrogen containing heterocyclic type silver iodide complex-forming agent mentioned above can be described. As preferred group, an alkyl group, an alkenyl group, an alkynyl group, an aryl group, a hydroxy group, an alkoxy group, an aryloxy group a heterocyclic oxy group, and a group which forms a phthalazine ring by benzo-condensation are described. In the case where a hydroxy group exists at the carbon atom adjacent to nitrogen atom of the compound represented by formula (4), there exists equilibrium between pyridazinone.

The compound represented by formula (4) more preferably forms a phthalazine ring represented by the following formula (5), and furthermore, this phthalazine ring particularly preferably has at least one substituent. As examples of $R^{51}$ to $R^{56}$ in formula (5), the substituent of a 5- to 7-membered nitrogen containing heterocyclic type silver iodide complex-forming agent mentioned above can be described.

As more preferable examples of the substituent, an alkyl group, an alkenyl group, an alkynyl group, an aryl group, a hydroxy group, an alkoxy group, an aryloxy group, and the like are described. An alkyl group, an alkenyl group, an aryl group, an alkoxy group, and an aryloxy group are preferable and an alkyl group, an alkoxy group, and an aryloxy group are more preferable.

Formula (5)

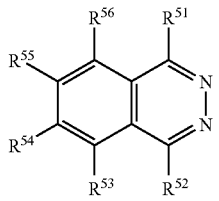

Further, the compound represented by formula (6) described below is also a preferable embodiment.

Formula (6)

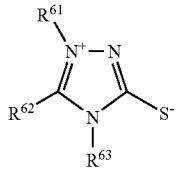

In formula (6), $R^{61}$ to $R^{63}$ each independently represent a hydrogen atom or a substituent. As examples of the substituent, the substituent of a 5- to 7-membered nitrogen containing heterocyclic type silver iodide complex-forming agent mentioned above can be described.

As the compound preferably used, the compound represented by the following formula (7) is described.

Formula (7)

$$R^{71}-S-(L)_n-S-R^{72}$$

In formula (7), $R^{71}$ and $R^{72}$ each independently represent a hydrogen atom or a substituent. L represents a divalent linking group. n represents 0 or 1. As the substituent represented by $R^{71}$ and $R^{72}$, an alkyl group (containing a cycloalkyl group), an alkenyl group (containing a cycloalkenyl group), an alkynyl group, an aryl group, a heterocyclic group, an acyl group, an aryloxycarbonyl group, an alkoxycarbonyl group, a carbamoyl group, an imide group and a complex substituent containing these groups are described as examples. A divalent linking group represented by L preferably has the length of 1 to 6 atoms and more preferably has the length of 1 to 3 atoms, and furthermore, may have a substituent.

One more of the compounds preferably used is a compound represented by formula (8).

Formula (8)

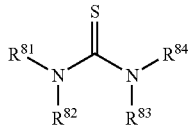

In formula (8), $R^{81}$ to $R^{84}$ each independently represent a hydrogen atom or a substituent. As the substituent represented by $R^{81}$ to $R^{84}$, an alkyl group (including a cycloalkyl group), an alkenyl group (including a cycloalkenyl group), an alkynyl group, an aryl group, a heterocyclic group, an acyl group, an aryloxycarbonyl group, an alkoxycarbonyl group, a carbamoyl group, an imide group, and the like are described as examples.

Among the silver iodide complex-forming agents described above, the compounds represented by formulae (3), (4), (5), (6), or (7) are more preferable and, the compounds represented by formulae (3) or (5) are particularly preferable.

Preferable examples of silver iodide complex-forming agent are described below, however the present invention is not limited in these.

(1)
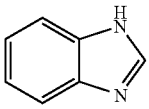
(2)
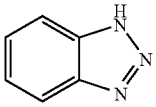
(3)
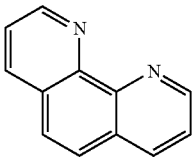
(4)
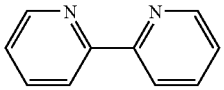
(5) $C_5H_{11}SC_5H_{11}$
(6) $C_4H_9SCH_2CH_2SC_4H_9$
(7)
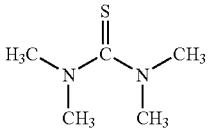
(8)
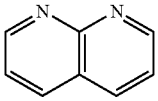
(9)
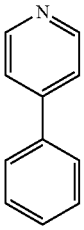
(10)
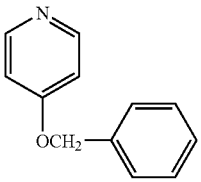
(11)
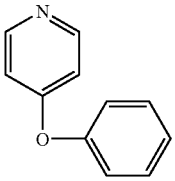
-continued
(12)
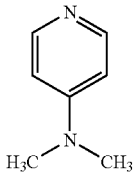
(13)
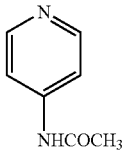
(14)
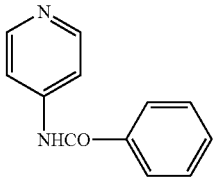
(15)
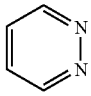
(16)
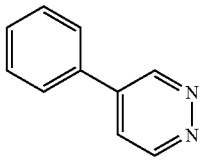
(17)
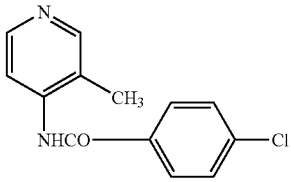
(18)
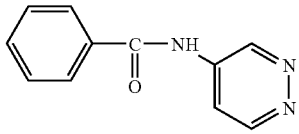
(19)
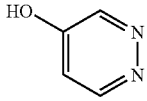
(20)
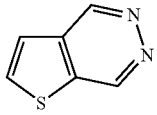
(21)
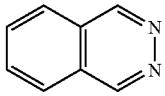

-continued
(22)
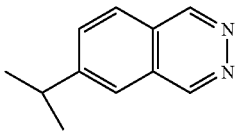
(23)
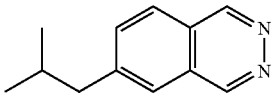
(24)
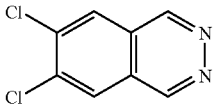
(25)
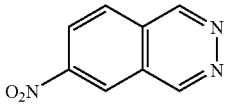
(26)
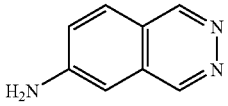
(27)
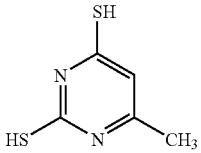
(28)
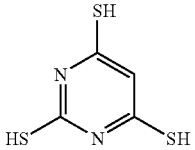
(29)
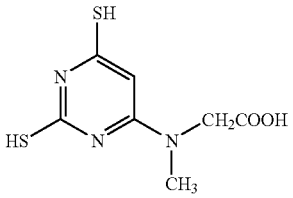
(30)
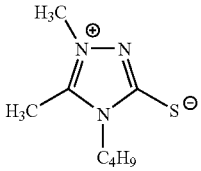
(31)
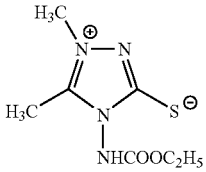
-continued
(32)
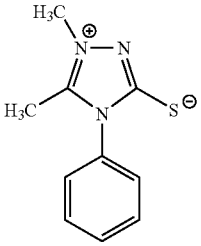
(33)
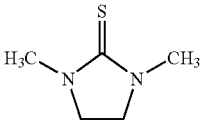
(34)
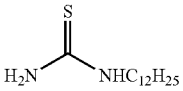
(35)
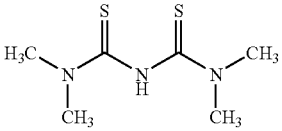
(36)
$HO(CH_2)_3S(CH_2)_2S(CH_2)_3OH$
(37)
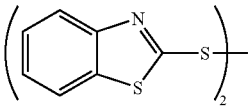
(38)
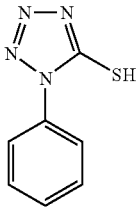
(39)
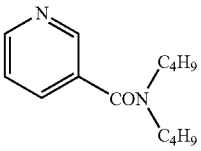
(40)
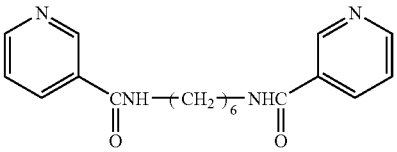
(41)
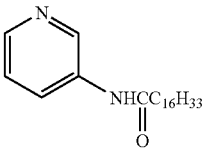
(42)
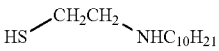

The silver iodide complex-forming agent according to the present invention can also be a compound common to a toner, in the case where the agent achieves the function of conventionally known toner. The silver iodide complex-forming agent according to the present invention can be used in combination with a toner. And, two or more of the silver iodide complex-forming agents may be used in combination.

The silver iodide complex-forming agent according to the present invention preferably exists in a film under the state separated from a photosensitive silver halide, such as a solid state or the like. It is also preferably added to the layer adjacent to the image forming layer.

Concerning the silver iodide complex-forming agent according to the present invention, a melting point of the compound is preferably adjusted to a suitable range so that it can be dissolved when heated at thermal developing temperature.

In the present invention, the absorption intensity of ultra violet-visible light absorption after thermal development is preferably decreased to 80% or less of that before thermal development. More preferably, it is decreased to 40% or less of that before thermal development, and particularly preferably 10% or less.

The silver iodide complex-forming agent according to the invention may be incorporated into the black and white photothermographic material by being added into the coating solution, such as in the form of a solution, an emulsified dispersion, a solid fine particle dispersion, or the like.

Well known emulsified dispersing methods include a method comprising dissolving the silver iodide complex-forming agent in an oil such as dibutylphthalate, tricresylphosphate, glyceryl triacetate, diethylphthalate, or the like, using an auxiliary solvent such as ethyl acetate, cyclohexanone, or the like, followed by mechanically forming an emulsified dispersion.

Solid fine particle dispersing methods include a method comprising dispersing the powder of the silver iodide complex-forming agent according to the invention in a proper solvent such as water or the like, by means of ball mill, colloid mill, vibrating ball mill, sand mill, jet mill, roller mill, or ultrasonics, thereby obtaining a solid dispersion.

In this case, there may also be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Depending on the dispersing conditions, the amount of Zr or the like incorporated in the dispersion is generally in a range of from 1 ppm to 1000 ppm. It is practically acceptable as far as Zr is incorporated in the black and white photothermographic material in an amount of 0.5 mg or less per 1 g of silver.

Preferably, an antiseptic (for instance, benzisothiazolinone sodium salt) is added in an aqueous dispersion.

The silver iodide complex-forming agent according to the invention is preferably used in the form of a solid dispersion.

The silver iodide complex-forming agent according to the invention is preferably used in a range of from 1 mol % to 5000 mol %, more preferably, from 10 mol % to 1000 mol % and, even more preferably, from 50 mol % to 300 mol %, with respect to the photosensitive silver halide in each case.

(Phthalic Acid and Derivatives Thereof)

In the present invention, the black and white photothermographic material preferably contains a compound selected from phthalic acid or derivatives thereof, in combination with the silver iodide complex-forming agent. As the phthalic acid and derivatives thereof used in the present invention, the compound represented by the following formula (PH) is preferable.

Formula (PH)

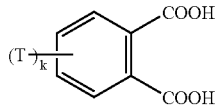

wherein T represents one selected from a halogen atom (fluorine, bromine, or iodine atom), an alkyl group, an aryl group, an alkoxy group, or a nitro group; k represents an integer of 0 to 4, and when k is 2 or more, plural Ts may be the same or different from each other. k is preferably 0, 1, or 2, and more preferably, 0 or 1.

The compound represented by formula (PH) may be used just as an acid or may be used as suitable salt from the viewpoint of easy addition to a coating solution and from the viewpoint of pH adjustment. As a salt, an alkaline metal salt, an ammonium salt, an alkaline earth metals salt, an amine salt, or the like can be used. An alkaline metal salt (Li, Na, K, or the like) and an ammonium salt are preferred.

Phthalic acid and the derivatives thereof used in the present invention are described below, however the present invention is not limited in these compounds.

(1)

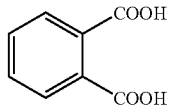

(2)

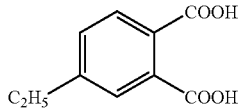

(3)

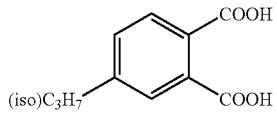

(4)

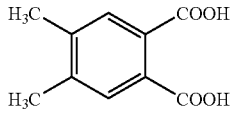

(5)

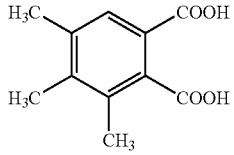

(6)

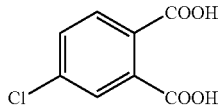

-continued (7)

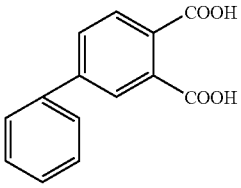

(8)

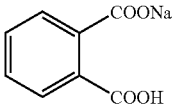

(9)

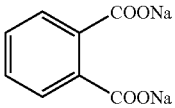

(10)

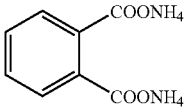

(11)

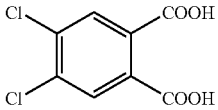

(12)

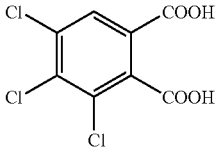

(13)

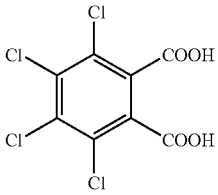

In the invention, the addition amount of phthalic acid or a derivative thereof is from $1.0\times10^{-4}$ mol to 1 mol, preferably from $1.0\times10^{-3}$ mol to 0.5 mol and, even more preferably from $2.0\times10^{-3}$ mol to 0.2 mol, per 1 mol of coated silver.

(Development Accelerator)

In the black and white photothermographic material of the invention, as a development accelerator, sulfonamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphtholic compounds represented by formula (2) described in the specification of JP-A No. 2001-264929 are used preferably. The development accelerator described above is used in a range of from 0.1 mol % to 20 mol %, preferably, in a range of from 0.5 mol % to 10 mol % and, more preferably in a range of from 1 mol % to 5 mol %, with respect to the reducing agent. The introducing methods to the black and white photothermographic material can include similar methods as those for the reducing agent and, it is particularly preferred to add as a solid dispersion or an emulsified dispersion. In the case of adding as an emulsified dispersion, it is preferred to add as an emulsified dispersion dispersed by using a solvent having a high boiling point which is solid at a normal temperature and an auxiliary solvent having a low boiling point, or to add as a so-called oilless emulsified dispersion not using a solvent having a high boiling point.

In the present invention, among the development accelerators described above, hydrazine compounds represented by formula (D) described in the specification of JP-A No. 2002-156727, and phenolic or naphtholic compounds represented by formula (2) described in the specification of JP-A No. 2001-264929 are more preferred.

Particularly preferred development accelerators of the invention are compounds represented by the following formulae (A-1) or (A-2).

$$Q_1\text{—NHNH—}Q_2 \qquad \text{Formula (A-1)}$$

In the formula, $Q_1$ represents an aromatic group or a heterocyclic group which bonds to —NHNH—$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or the heterocyclic group represented by $Q_1$ is preferably a 5- to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which the rings described above are condensed to each other are also preferred.

The rings described above may have substituents and in a case where they have two or more substituents, the substituents may be identical or different from each other. Examples of the substituent include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may have further substituents and examples of preferred substituents can include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms and, more preferably having 6 to 40 carbon atoms, and examples include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl) carbamoyl, N-octadecylcarbamoyl, N-{3-(2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbamoyl, N-3-pyridylcarbamoyl, and N-benzylcarbamoyl.

The acyl group represented by $Q_2$ is an acyl group, preferably having 1 to 50 carbon atoms and, more preferably having 6 to 40 carbon atoms, and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group, preferably having 2 to 50 carbon atoms and, more preferably having 6 to 40 carbon atoms, and can include, for example, methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group, preferably having 7 to 50 carbon atoms and, more preferably having 7 to 40 carbon atoms, and include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group preferably having 1 to 50 carbon atoms and, more preferably having 6 to 40 carbon atoms and include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group preferably having 0 to 50 carbon atoms, and more preferably having 6 to 40 carbon atoms, and include, for example, unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5- to 7-membered unsaturated ring represented by $Q_1$ at the position capable of substitution. In a case where the group has two or more substituents, such substituents may be identical or different from one another.

Next, preferred range for the compound represented by formula (A-1) is to be described. A 5- or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thioazole ring, an oxazole ring, an isothiazole ring, an isooxazole ring, and a ring in which the ring described above is condensed with a benzene ring or unsaturated heterocycle are more preferred. Further, $Q_2$ is preferably a carbamoyl group and, particularly, a carbamoyl group having a hydrogen atom on the nitrogen atom is particularly preferred.

Formula (A-2)

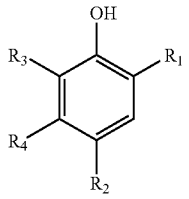

In formula (A-2), $R_1$ represents one selected from an alkyl group, an acyl group, an acylamino group, a sulfonamide group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including a ureido group and a urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case .where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, a benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them

A-1

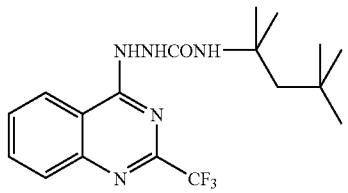

-continued

A-2

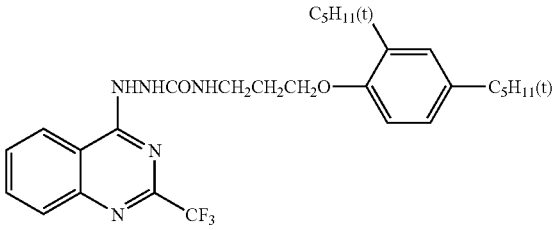

A-3

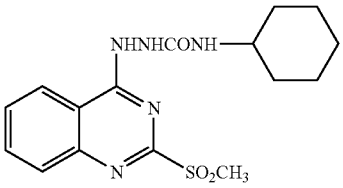

A-4

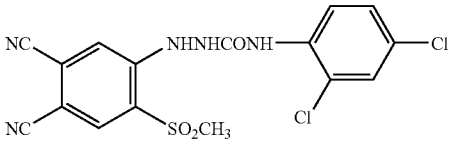

A-5

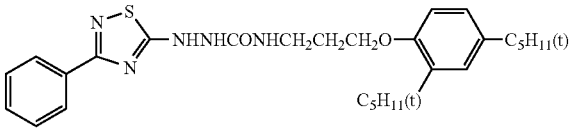

A-6

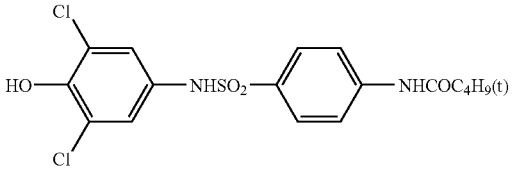

A-7

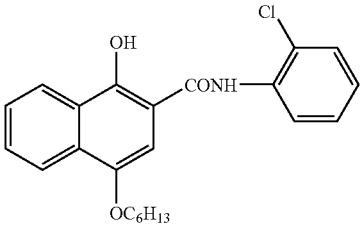

A-8

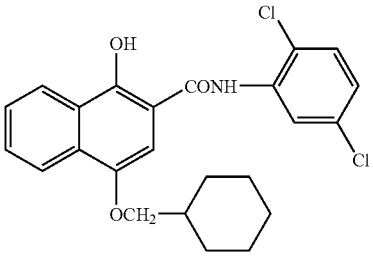

-continued

A-9

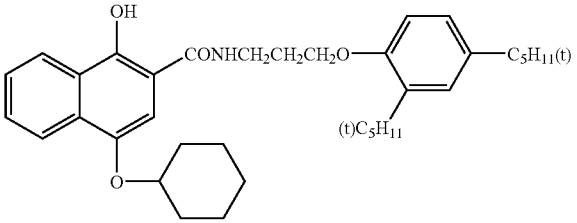

A-10

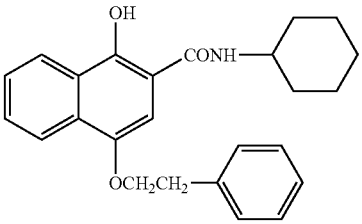

A-11

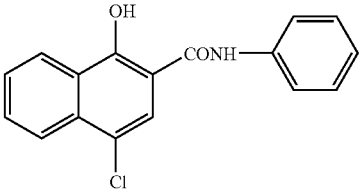

A-12

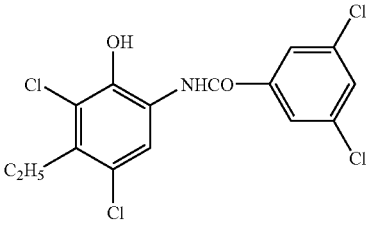

(Hydrogen Bonding Compound)

In the invention, in the case where the reducing agent has an aromatic hydroxy group (—OH) or an amino group (—NHR, R represents a hydrogen atom or an alkyl group), particularly in the case where the reducing agent is a bisphenol described above, it is preferred to use in combination, a non-reducing compound having a group which reacts with these groups of the reducing agent and forms a hydrogen bond therewith.

As the group forming a hydrogen bond with a hydroxy group or an amino group, there are mentioned a phosphoryl group, a sulfoxide group, a sulfonyl group, a carbonyl group, an amide group, an ester group, a urethane group, a ureido group, a tertiary amino group, a nitrogen-containing aromatic group, and the like. Particularly preferred among them is a phosphoryl group, a sulfoxide group, an amide group (not having —N(H)— moiety but being blocked in the form of —N(Ra)— (where, Ra represents a substituent other than H)), a urethane group (not having —N(H)— moiety but being blocked in the form of —N(Ra)— (where, Ra represents a substituent other than H)), and a ureido group (not having —N(H)— moiety but being blocked in the form of —N(Ra)— (where, Ra represents a substituent other than H)).

In the invention, particularly preferable as the hydrogen bonding compound is the compound represented by formula (D) shown below.

Formula (D)

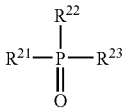

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxy group, there are mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there are mentioned a phenoxy group, a cresyloxy group, an isopropylphenoxy group, a 4-t-butylphenoxy group, a naphthoxy group, a biphenyloxy group, and the like.

As an amino group, there are mentioned a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ are an alkyl group, an aryl group, an alkoxy group, and an aryloxy group. Concerning the effect of the invention, it is preferred that at least one of $R^{21}$ to $R^{23}$ is an alkyl group or an aryl group, and more preferably, two or more of them are an alkyl group or an aryl group. From the viewpoint of low cost availability, it is preferred that $R^{21}$ to $R^{23}$ are of the same group.

Specific examples of the hydrogen bonding compound represented by formula (D) of the invention and others according to the invention are shown below, but the invention is not limited thereto.

D-1

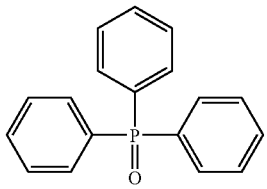

D-2

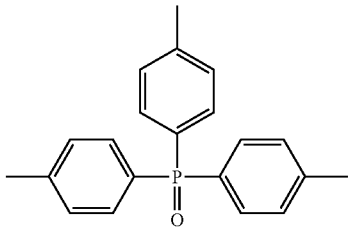

D-3

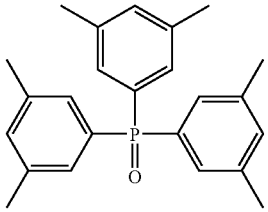

D-4

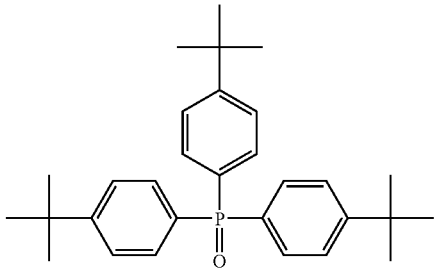

D-5

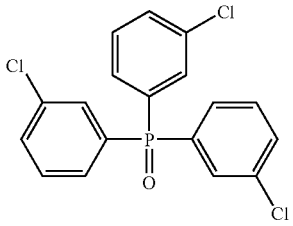

D-6

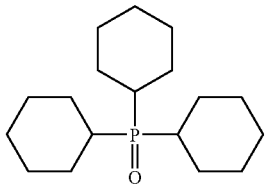

-continued

D-7

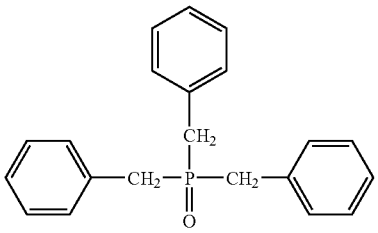

D-8

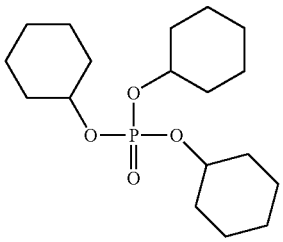

D-9

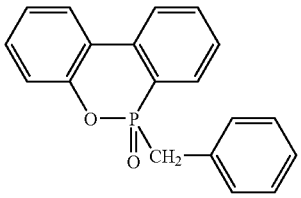

D-10

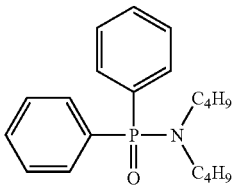

D-11

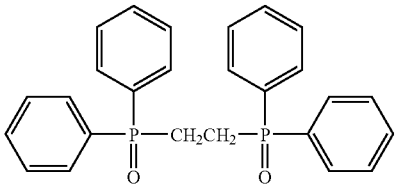

D-12

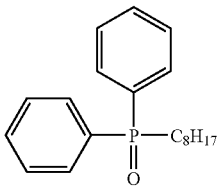

D-13

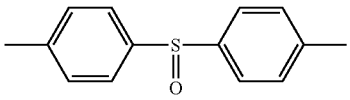

D-14

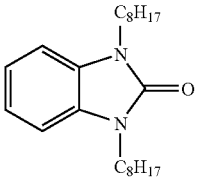

-continued

D-15

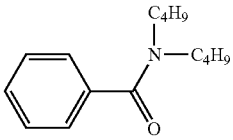

Specific examples of hydrogen bonding compounds other than those enumerated above can be found in those described in EP No. 1,096,310 and in JP-A Nos. 2002-156727 and 2002-318431.

The compound represented by formula (D) of the invention can be used in the black and white photothermographic material by being incorporated into the coating solution in the form of a solution, an emulsified dispersion, or a solid fine particle dispersion, similar to the case of reducing agent. However, it is preferably used in the form of a solid dispersion. In the solution, the compound represented by formula (D) forms a hydrogen-bonded complex with a compound having a phenolic hydroxy group or an amino group, and can be isolated as a complex in crystalline state depending on the combination of the reducing agent and the compound represented by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the compound represented by formula (D) in the form of powder and dispersing them with a proper dispersion agent using sand grinder mill or the like.

The compound represented by formula (D) is preferably used in a range from 1 mol % to 200 mol %, more preferably from 10 mol % to 150 mol %, and even more preferably, from 20 mol % to 100 mol %, with respect to the reducing agent.

(Binder)

Any hydrophobic polymer may be used as the hydrophobic binder for the image forming layer of the invention. Suitable as the binder are those that are transparent or translucent, and that are generally colorless, such as natural resin or polymer and their copolymers; synthetic resin or polymer and their copolymer; or media forming a film; for example, included are rubbers, cellulose acetates, cellulose acetate butyrates, poly(vinyl chlorides), poly(methacrylic acids), styrene-maleic anhydride copolymers, styrene-acrylonitrile copolymers, styrene-butadiene copolymers, poly(vinyl acetals) (e.g., poly(vinyl formal) or poly(vinyl butyral)), polyesters, polyurethanes, phenoxy resin, poly(vinylidene chlorides), polyepoxides, polycarbonates, poly(vinyl acetates), polyolefins, cellulose esters, and polyamides. A binder may be used with water, an organic solvent or emulsion to form a coating solution.

The glass transition temperature (Tg) of the binder which is used in the image forming layer is preferably in a range of from 0° C. to 80° C., more preferably from 10° C. to 70° C. and, even more preferably from 15° C. to 60° C.

In the specification, Tg is calculated according to the following equation:

$$1/Tg=\Sigma(Xi/Tgi)$$

where the polymer is obtained by copolymerization of n monomer compounds (from i=1 to i=n); Xi represents the mass fraction of the ith monomer (ΣXi=1), and Tgi is the glass transition temperature (absolute temperature) of the homopolymer obtained with the ith monomer. The symbol Σ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of two or more polymers depending on needs. And, the polymer having Tg of 20° C. or more and the polymer having Tg of less than 20° C. can be used in combination. In the case where two or more polymers differing in Tg may be blended for use, it is preferred that the weight-average Tg is in the range mentioned above.

In the invention, the image forming layer is preferably formed by applying a coating solution containing 30% by weight or more of water in the solvent and by then drying.

In the invention, in the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower at 25° C. and 60% RH is used, the performance can be enhanced. Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-miscible organic solvent. As the water-miscible organic solvent, there can be described, for example, alcohols such as methyl alcohol, ethyl alcohol, propyl alcohol, or the like; cellosolves such as methyl cellosolve, ethyl cellosolve, butyl cellosolve, or the like; ethyl acetate; dimethylformamide; or the like.

The term "aqueous solvent" is also used in the case where the polymer is not thermodynamically dissolved, but is present in a so-called dispersed state .

The term "equilibrium water content at 25° C. and 60% RH" as referred herein can be expressed as follows:

$$\text{Equilibrium water content at 25° C. and 60\% } RH = [(W1-W0)/W0]\times 100 \text{ (\% by weight)}$$

wherein W1 is the weight of the polymer in moisture-controlled equilibrium under an atmosphere of 25° C. and 60% RH, and W0 is the absolutely dried weight at 25° C. of the polymer. For the definition and the method of measurement for water content, reference can be made to Polymer Engineering Series 14, "Testing methods for polymeric materials" (The Society of Polymer Science, Japan, published by Chijin Shokan).

The equilibrium water content at 25° C. and 60% RH is preferably 2% by weight or lower, and is more preferably, in a range of from 0.01% by weight to 1.5% by weight, and is even more preferably, from 0.02% by weight to 1% by weight.

The binders used in the invention are particularly preferably polymers capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle diameter of the dispersed particles is in a range of from 1 nm to 50,000 nm, preferably from 5 nm to 1,000 nm, more preferably from 10 nm to 500 nm, and even more preferably from 50 nm to 200 nm. There is no particular limitation concerning particle diameter distribution of the dispersed particles, and they may be widely distributed or may exhibit a monodispersed particle diameter distribution. From the viewpoint of controlling the physical properties of the coating solution, preferred mode of usage includes mixing two or more types of dispersed particles each having monodispersed particle diameter distribution.

In the invention, preferred embodiment of the polymers capable of being dispersed in aqueous solvent includes hydrophobic polymers such as acrylic polymers, polyesters, rubbers (e.g., SBR resin), polyurethanes, poly(vinyl chlorides), poly(vinyl acetates), poly(vinylidene chlorides), polyolefins, or the like. As the polymers above, usable are straight chain polymers, branched polymers, or crosslinked polymers; also usable are the so-called homopolymers in which one type of monomer is polymerized, or copolymers in which two or more types of monomers are polymerized. In the case of a copolymer, it may be a random copolymer or a block copolymer. The molecular weight of these polymers is, in number average molecular weight, in a range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

Preferably, 50% by weight or more of the binder is occupied by polymer latex having a monomer component represented by the following formula (M).

$$CH_2{=}CR^{01}{-}CR^{02}{=}CH_2 \qquad \text{Formula (M)}$$

In the formula, $R^{01}$ and $R^{02}$ each independently represent one selected from a hydrogen atom, an alkyl group having 1 to 6 carbon atoms, a halogen atom, or a cyano group. More preferably, both of $R^{01}$ and $R^{02}$ represent a hydrogen atom, or one of $R^{01}$ or $R^{02}$ represents a hydrogen atom and the other represents a methyl group.

Preferably, the polymer latex contains the monomer component represented by formula (M) within a range of from 10% by weight to 70% by weight, and more preferably from 20% by weight to 60% by weight.

<Examples of Latex>

Specific examples of preferred polymer latexes are given below, which are expressed by the starting monomers with % by weight given in parenthesis. The molecular weight is given in number average molecular weight.

In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)- (molecular weight 37000, Tg 61° C.)

P-2; Latex of -MMA(70)-2EHA(20)-St(5)-AA(5)- (molecular weight 40000, Tg 59° C.)

P-3; Latex of -St(50)-Bu(47)-MAA(3)- (crosslinking, Tg −17° C.)

P-4; Latex of -St(68)-Bu(29)-AA(3)- (crosslinking, Tg 17° C.)

P-5; Latex of -St(71)-Bu(26)-AA(3)- (crosslinking, Tg 24° C.)

P-6; Latex of -St(70)-Bu(27)-IA(3)- (crosslinking)

P-7; Latex of -St(75)-Bu(24)-AA(1)- (crosslinking, Tg 29° C.)

P-8; Latex of -St(60)-Bu(35)-DVB(3)-MAA(2)- (crosslinking)

P-9; Latex of -St(70)-Bu(25)-DVB(2)-AA(3)- (crosslinking)

P-10; Latex of -VC(50)-MMA(20)-EA(20)-AN(5)-AA(5)- (molecular weight 80000)

P-11; Latex of -VDC(85)-MMA(5)-EA(5)-MAA(5)- (molecular weight 67000)

P-12; Latex of -Et(90)-MAA(10)- (molecular weight 12000)

P-13; Latex of -St(70)-2EHA(27)-AA(3)- (molecular weight 130000, Tg 43° C.)

P-14; Latex of -MMA(63)-EA(35)-AA(2)- (molecular weight 33000, Tg 47° C.)

P-15; Latex of -St(70.5)-Bu(26.5)-AA(3)- (crosslinking, Tg 23° C.)

P-16; Latex of -St(69.5)-Bu(27.5)-AA(3)- (crosslinking, Tg 20.5° C.)

P-17; Latex of -St(61.5)-Isoprene(35.5)-AA(3)- (crosslinking, Tg 17° C.)

P-18; Latex of -St(67)-Isoprene(28)-Bu(2)-AA(3)- (crosslinking, Tg 27° C.)

P-19; Latex of -St(56)-Isoprene(42)-AA(2)- (crosslinking, Tg 13° C.)

P-20; Latex of -St(65)-Isoprene(31)-AA(4)- (crosslinking, Tg 22° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more of them depending on needs.

<Preferable Latex>

Preferable as the polymer latex for use in the invention are that of styrene-butadiene copolymer and that of styrene-isoprene copolymer, and particularly preferable is styrene-isoprene copolymer latex. The mass ratio of monomer unit for styrene to that of butadiene constituting the styrene-butadiene copolymer is preferably in a range of from 40:60 to 95:5, more preferably from 55:45 to 85:15, and particularly preferably from 65:35 to 75:25. Further, the monomer unit of styrene and that of butadiene preferably account for 60% by weight to 99% by weight, more preferably from 80% by weight to 99% by weight, and particularly preferably from 90% by weight to 99% by weight, with respect to the copolymer. Further, the polymer latex of the invention preferably contains acrylic acid or methacrylic acid in a range from 1% by weight to 6% by weight with respect to the sum of styrene and butadiene, and more preferably from 2% by weight to 5% by weight. The polymer latex of the invention preferably contains acrylic acid. Preferable range of monomer content is similar to that described above. Further, the ratio of copolymerization in the styrene-isoprene copolymer is preferably in a range of from 30:70 to 85:15, more preferably from 45:55 to 75:25, and particularly preferably from 55:45 to 65:35.

As the latex of styrene-butadiene copolymer preferably used in the invention, there are mentioned P-3 to P-9 and P-15 described above, and commercially available LACSTAR-3307B, 7132C, Nipol Lx416, and the like. And as examples of the latex of styrene-isoprene copolymer, there are mentioned P-17 to P-20 described above.

In the image forming layer of the black and white photothermographic material according to the invention, if necessary, there can be added hydrophilic polymers such as gelatin, poly(vinyl alcohol), methyl cellulose, hydroxypropyl cellulose, carboxymethyl cellulose, or the like. The hydrophilic polymer is added in an amount of 30% by weight or less, and preferably 20% by weight or less, with respect to the total weight of the binder incorporated in the image forming layer.

According to the invention, the layer containing a silver salt of a fatty acid (image forming layer) is preferably formed by using polymer latex for the binder. Concerning the amount of the binder for the image forming layer, the mass ratio of total binder to silver salt of a fatty acid (total binder/silver salt of a fatty acid) is preferably in a range of from 1/10 to 10/1, more preferably from 1/3 to 5/1, and even more preferably from 1/1 to 3/1.

The image forming layer is, in general, a photosensitive layer (image forming layer) containing a photosensitive silver halide, i.e., the photosensitive silver salt; in such a case, the mass ratio of total binder to silver halide (total binder/silver halide) is in a range of from 5 to 400, and more preferably from 10 to 200.

The total amount of binder in the image forming layer of the invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$. As for the image forming layer of the invention, there may be added a crosslinking agent for crosslinking, a surfactant to improve coating ability, or the like.

(Antifoggant)

1) Organic Polyhalogen Compound

Preferable organic polyhalogen compound that can be used in the invention is explained specifically below. In the invention, preferred organic polyhalogen compound is the compound represented by the following formula (H).

$$Q\text{—}(Y)n\text{-}C(Z_1)(Z_2)X \qquad \text{Formula (H)}$$

In formula (H), Q represents one selected from an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group.

In formula (H), Q is preferably an alkyl group having 1 to 6 carbon atoms, an aryl group having 6 to 12 carbon atoms, or a heterocyclic group comprising at least one nitrogen atom (pyridine, quinoline, or the like).

In the case where Q is an aryl group in formula (H), Q is preferably a phenyl group substituted by an electron-attracting group whose Hammett substituent constant σp yields a positive value. For the details of Hammett substituent constant, reference can be made to Journal of Medicinal Chemistry, vol. 16, No. 11 (1973), pp. 1207 to 1216, and the like.

As such electron-attracting groups, examples include a halogen atom, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, sulfamoyl group, and the like. Preferable as the electron-attracting group is a halogen atom, a carbamoyl group, or an arylsulfonyl group, and particularly preferred among them is a carbamoyl group.

X is preferably an electron-attracting group. As the electron-attracting group, preferable are a halogen atom, an aliphatic arylsulfonyl group, a heterocyclic sulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably a bromine atom or an iodine atom, and more preferably, a bromine atom.

Y preferably represents —C(═O)—, —SO—, —$SO_2$—, —C(═O)N(R)—, or —$SO_2$N(R)—; more preferably, —C(═O)—, —$SO_2$—, or —C(═O)N(R)—; and particularly preferably, —$SO_2$— or —C(═O)N(R)—. Herein, R represents a hydrogen atom, an aryl group, or an alkyl group, preferably a hydrogen atom or an alkyl group, and particularly preferably a hydrogen atom.

n represents 0 or 1, and is preferably 1.

In formula (H), in the case where Q is an alkyl group, Y is preferably —C(═O)N(R)—. And, in the case where Q is an aryl group or a heterocyclic group, Y is preferably —$SO_2$—.

In formula (H), the embodiment where the residues, which are obtained by removing a hydrogen atom from the compound, bond to each other (generally called bis type, tris type, or tetrakis type) is also preferably used.

In formula (H), the embodiment having a substituent of a dissociative group (for example, a COOH group or a salt thereof, an $SO_3H$ group or a salt thereof, a $PO_3H$ group or a salt thereof, or the like), a group containing a quaternary nitrogen cation (for example, an ammonium group, a pyridinium group, or the like), a polyethyleneoxy group, a hydroxy group, or the like is also preferable.

Specific examples of the compound represented by formula (H) of the invention are shown below.

H-1

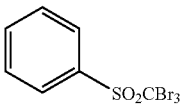

H-2

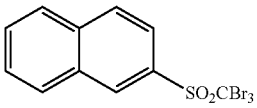

-continued

H-3

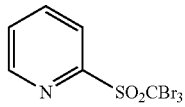

H-4

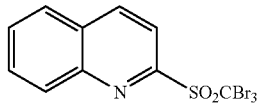

H-5

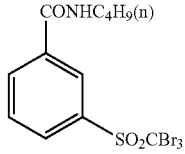

H-6

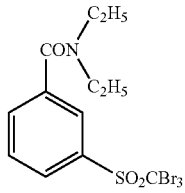

H-7

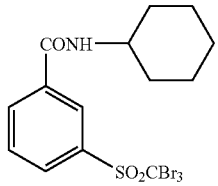

H-8

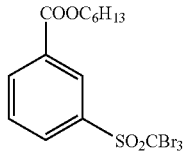

H-9

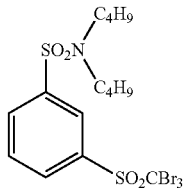

H-10

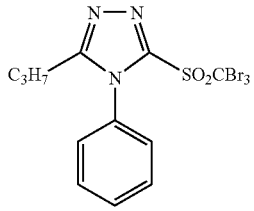

H-11

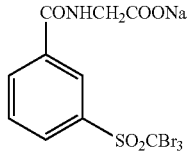

-continued

H-12

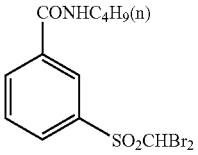

H-13

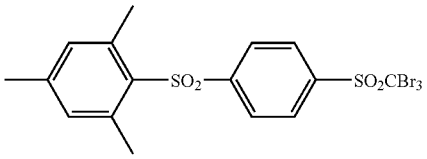

H-14

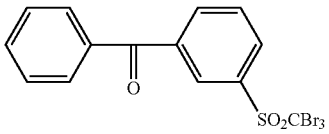

H-15

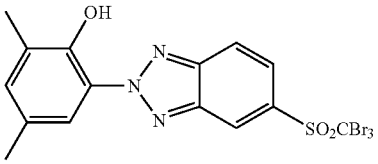

H-16

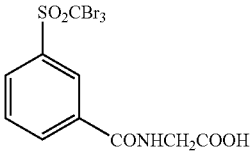

H-17

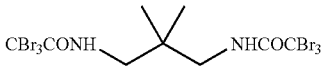

H-18

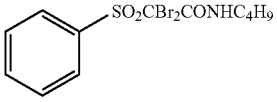

H-19

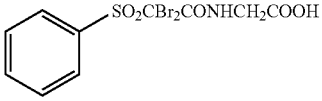

As preferred organic polyhalogen compounds which can be used in the present invention other than those above, there are mentioned compounds disclosed in U.S. Pat. Nos. 3,874,946, 4,756,999, 5,340,712, 5,369,000, 5,464,737, and 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Particularly, the compounds specifically illustrated in JP-A Nos. 7-2781, 2001-33911, and 20001-312027 are preferable.

The compound represented by formula (H) of the invention is preferably used in an amount of from $10^{-4}$ mol to 1 mol, more preferably from $10^{-3}$ mol to 0.5 mol, and even more preferably from $1\times10^{-2}$ mol to 0.2 mol, per 1 mol of non-photosensitive silver salt incorporated in the image forming layer.

In the invention, usable methods for incorporating the antifoggant into the black and white photothermographic material are those described above in the method for incorporating the reducing agent, and also for the organic polyhalogen compound, it is preferably added in the form of a solid fine particle dispersion.

2) Other Antifoggants

As other antifoggants, there are mentioned a mercury (II) salt described in paragraph number 0113 of JP-A No. 11-65021, benzoic acids described in paragraph number 0114 of the same literature, a salicylic acid derivative described in JP-A No. 2000-206642, a formalin scavenger compound represented by formula (S) in JP-A No. 2000-221634, a triazine compound related to claim 9 of JP-A No. 11-352624, a compound represented by formula (III), 4-hydroxy-6-methyl-1,3,3a,7-tetrazaindene and the like, described in JP-A No. 6-11791.

The black and white photothermographic material according to the invention may further contain an azolium salt in order to prevent fogging. Azolium salts useful in the present invention include a compound represented by formula (XI) described in JP-A No. 59-193447, a compound described in JP-B No. 55-12581, and a compound represented by formula (II) in JP-A No. 60-153039. The azolium salt may be added to any part of the black and white photothermographic material, but as an additional layer, it is preferred to select a layer on the side having thereon the image forming layer, and more preferred is to select the image forming layer itself. The azolium salt may be added at any time of the process of preparing the coating solution; in the case where the azolium salt is added into the image forming layer, any time of the process may be selected, from the preparation of the silver salt of a fatty acid to the preparation of the coating solution, but preferred is to add the azolium salt after preparing the silver salt of a fatty acid and just before coating. As the method for adding the azolium salt, any method using powder, a solution, a fine particle dispersion, or the like may be used. Furthermore, it may be added as a solution having mixed therein other additives such as sensitizing agents, reducing agents, toners, and the like.

In the invention, the azolium salt may be added in any amount, but preferably, it is added in a range of from $1\times10^{-6}$ mol to 2 mol, and more preferably from $1\times10^{-3}$ mol to 0.5 mol, per 1 mol of silver.

(Other Additives)

1) Mercapto Compounds, Disulfides, and Thiones

In the invention, mercapto compounds, disulfide compounds, and thione compounds can be added in order to control the development by suppressing or enhancing development, to improve spectral sensitization efficiency, and to improve storage stabilities of before and after development. Descriptions can be found in paragraph numbers 0067 to 0069 of JP-A No. 10-62899, a compound represented by formula (I) of JP-A No. 10-186572 and specific examples thereof shown in paragraph numbers 0033 to 0052, in lines 36 to 56 in page 20 of EP No. 803,764A1. Among them, mercapto-substituted heterocyclic aromatic compounds described in JP-A Nos. 9-297367, 9-304875, 2001-100358, 2002-303954, 2002-303951, and the like are preferred.

2) Toner

In the black and white photothermographic material of the present invention, addition of a toner is preferred. Description on the toner can be found in JP-A No. 10-62899 (paragraph numbers 0054 to 0055), EP No. 803,764A1 (page 21, lines 23 to 48), JP-A Nos. 2000-356317 and 2000-187298. Preferred are phthalazinones (phthalazinone, phthalazinone derivatives and metal salts thereof, (e.g., 4-(1-naphthyl)phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

Plasticizers and lubricants usable in the image forming layer of the invention are described in paragraph No. 0117 of JP-A No. 11-65021. Lubricants are described in paragraph Nos. 0061 to 0064 of JP-A No. 11-84573.

4) Dyes and Pigments

From the viewpoints of improving color tone, preventing the generation of interference fringes and preventing irradiation on laser exposure, various dyes and pigments (for instance, C.I. Pigment Blue 60, C.I. Pigment Blue 64, and C.I. Pigment Blue 15:6) can be used in the image forming layer of the invention. Detailed description can be found in WO No. 98/36322, JP-A Nos. 10-268465 and 11-338098, and the like.

5) Nucleator

Concerning the black and white photothermographic material of the invention, it is preferred to add a nucleator into the image forming layer. Details on the nucleators, method for their addition and addition amount can be found in paragraph No. 0118 of JP-A No. 11-65021, paragraph Nos. 0136 to 0193 of JP-A No. 11-223898, as compounds represented by formulae (H), (1) to (3), (A), or (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide in an amount of 5 mmol or less, and more preferably 1 mmol or less, per 1 mol of silver.

In the case of using a nucleator in the black and white photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 $mg/m^2$ to 100 $mg/m^2$.

(Preparation of Coating Solution and Coating)

The temperature for preparing the coating solution for the image forming layer of the invention is preferably from 30° C. to 65° C., more preferably, 35° C. or more and less than 60° C., and further preferably, from 35° C. to 55° C. Furthermore, the temperature of the coating solution for the image forming layer immediately after adding the polymer latex is preferably maintained in the temperature range from 30° C. to 65° C.

(Layer Constitution and Constituent Components)

The black and white photothermographic material of the invention has one or more image forming layers constructed on a support. In the case of constituting the image forming layer from one layer, the image forming layer comprises a silver salt of a fatty acid, a photosensitive silver halide, a reducing agent, and a binder, and may further comprise additional materials as desired and necessary, such as an antifoggant, a toner, a film-forming promoting agent, and other auxiliary agents. In the case of constituting the image forming layer from two or more layers, the first image forming layer (in general, a layer placed nearer to the support) contains a silver salt of a fatty acid and a photosensitive silver halide. Some of the other components may be incorporated in the second image forming layer or in both of the layers.

The black and white photothermographic material according to the invention can have a non-photosensitive layer in addition to the image forming layer. Non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided on the side opposite to the image forming layer.

Furthermore, a layer that functions as an optical filter may be provided as (a) or (b) above. An antihalation layer may be provided as (c) or (d) to the black and white photothermographic material.

1) Surface Protective Layer

The black and white photothermographic material according to the invention can comprise a surface protective layer with an object to prevent adhesion of the image forming layer, and the like. The surface protective layer may be a single layer, or plural layers.

Description on the surface protective layer may be found in paragraph Nos. 0119 to 0120 of JP-A No. 11-65021 and in JP-A No. 2000-171936.

Preferred as the binder of the surface protective layer of the invention is gelatin, but poly(vinyl alcohol) (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105, the partially saponified PVA-205, and PVA-335, as well as modified poly(vinyl alcohol) MP-203 (all trade name of products from Kuraray Ltd.). The amount of coated poly(vinyl alcohol) (per 1 $m^2$ of support) in the surface protective layer (per one layer) is preferably in a range from 0.3 $g/m^2$ to 4.0 $g/m^2$, and more preferably, from 0.3 $g/m^2$ to 2.0 $g/m^2$.

The total amount of the coated binder (including water-soluble polymer and latex polymer) (per 1 $m^2$ of support) in the surface protective layer (per one layer) is preferably in a range from 0.3 g/m$^2$ to 5.0 g/m$^2$, and more preferably, from 0.3 g/m$^2$ to 2.0 g/m$^2$.

2) Antihalation Layer

The black and white photothermographic material of the present invention can comprise an antihalation layer provided to the side farther from the light source than the image forming layer. It is preferred that an antihalation layer is a back layer or a layer provided between the image forming layer and the support.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case where the exposure wavelength is in the infrared region, an infrared-absorbing dye is used, and in such a case, preferred are dyes having no absorption in the visible light region.

In general, the dye is used at an amount as such that the optical density (absorbance) exceeds 0.1 when measured at the desired wavelength. The optical density is preferably in a range from 0.15 to 2, and more preferably from 0.2 to 1. The addition amount of dyes to obtain optical density in the above range is generally about from 0.001 g/m$^2$ to 1 g/m$^2$.

3) Back Layer

Back layers usable in the invention are described in paragraph Nos. 0128 to 0130 of JP-A No. 11-65021.

In the invention, coloring matters having maximum absorption in the wavelength range from 300 nm to 450 nm can be added in order to improve color tone of developed silver images and deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in a range of from 0.1 mg/m$^2$ to 1 g/m$^2$, preferably to the back layer which is provided to the opposite side of the support from the image forming layer.

4) Matting Agent

A matting agent is preferably added to the black and white photothermographic material of the invention in order to improve transportability. Description on the matting agent can be found in paragraphs Nos. 0126 to 0127 of JP-A No. 11-65021. The addition amount of the matting agent is preferably in a range from 1 mg/m$^2$ to 400 mg/m$^2$, and more preferably, from 5 mg/m$^2$ to 300 mg/m$^2$, with respect to the coating amount per 1 m$^2$ of the photothermographic material.

The shape of the matting agent usable in the invention may be a fixed form or non-fixed form. Preferred is to use those having fixed form and globular shape. The mean particle diameter is preferably in a range of from 0.5 μm to 10 μm, more preferably, from 1.0 μm to 8.0 μm, and even more preferably, from 2.0 μm to 6.0 μm. Furthermore, the particle size distribution of the matting agent is preferably set as such that the variation coefficient may become 50% or lower, more preferably, 40% or lower, and further preferably, 30% or lower. The variation coefficient, herein, is defined by (the standard deviation of particle diameter)/(mean diameter of the particle)×100. Furthermore, it is preferred to use two types of matting agents having low variation coefficient and the ratio of their mean particle diameters being higher than 3, in combination.

The level of matting on the image forming layer surface is not restricted as far as star-dust trouble does not occur, but the level of matting of from 30 seconds to 2000 seconds is preferred, and particularly preferred, from 40 seconds to 1500 seconds, when expressed by Beck's smoothness. Beck's smoothness can be calculated easily, using Japan Industrial Standard (JIS) P8119 "The method of testing Beck's smoothness for papers and sheets using Beck's test apparatus", or TAPPI standard method T479.

The level of matting of the back layer in the invention is preferably in a range of 1200 seconds or less and 10 seconds or more; more preferably, 800 seconds or less and 20 seconds or more; and even more preferably, 500 seconds or less and 40 seconds or more, when expressed by Beck's smoothness.

In the present invention, a matting agent is preferably contained in an outermost layer, in a layer which can function as an outermost layer, or in a layer nearer to outer surface, and also preferably is contained in a layer which functions as a so-called protective layer.

5) Polymer Latex

In the present invention, a polymer latex is preferably used in the surface protective layer or the back layer of the black and white photothermographic material. As such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there are mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl acrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like.

Furthermore, as the binder for the surface protective layer, there may be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer is preferably contained in an amount of from 10% by weight to 90% by weight, particularly preferably from 20% by weight to 80% by weight, based on a total weight of binder.

6) Surface pH

The surface pH of the black and white photothermographic material according to the invention preferably yields a pH of 7.0 or lower, and more preferably 6.6 or lower, before thermal developing process. Although there is no particular restriction concerning the lower limit, the lower limit of pH value is about 3. The most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener may be used in each of image forming layer, protective layer, back layer, and the like of the invention. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193, and the like, epoxy compounds of U.S. Pat. No. 4,791,042 and the like, and vinylsulfone compounds of JP-A No. 62-89048.

The hardener is added as a solution, and the solution is added to a coating solution 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Ekitai Kongo Gijutu (Liquid Mixing Technology)" (Nikkan Kogyo Shinbunsha, 1989), and the like.

8) Surfactant

Concerning the surfactant, the solvent, the support, the antistatic agent, and the electrically conductive layer, and the method for obtaining color images applicable in the invention, there can be used those disclosed in paragraph numbers 0132, 0133, 0134, 0135, and 0136, respectively, of JP-A No. 11-65021. Concerning lubricants, there can be used those disclosed in paragraph numbers 0061 to 0064 of JP-A No. 11-84573 and in paragraph numbers 0049 to 0062 of JP-A No. 2001-83679.

In the invention, it is preferred to use a fluorocarbon surfactant. Specific examples of the fluorocarbon surfactant can be found in those described in JP-A Nos. 10-197985, 2000-19680, and 2000-214554. Polymer fluorocarbon surfactants described in JP-A No. 9-281636 can be also used preferably. For the photothermographic material in the invention, the fluorocarbon surfactants described in JP-A Nos. 2002-82411, 2003-57780, and 2001-264110 are preferably used. Especially, the usage of the fluorocarbon surfactants described in JP-A Nos. 2003-57780 and 2001-264110 in an aqueous coating solution is preferred viewed from the standpoints of capacity in static control, stability of the coated surface state, and sliding facility. The fluorocarbon surfactant described in JP-A No. 2001-264110 is most preferred because of high capacity in static control and that it needs small amount to use.

According to the invention, the fluorocarbon surfactant can be used on either side of image forming layer side or backside, but is preferred to use on the both sides. Further, it is particularly preferred to use in combination with electrically conductive layer including metal oxides described below. In this case the amount of the fluorocarbon surfactant on the side of the electrically conductive layer can be reduced or removed.

The addition amount of the fluorocarbon surfactant is preferably in a range of from 0.1 mg/m$^2$ to 100 mg/m$^2$ on each side of image forming layer and back layer, more preferably from 0.3 mg/m$^2$ to 30 mg/m$^2$, and even more preferably from 1 mg/m$^2$ to 10 mg/m$^2$. Especially, the fluorocarbon surfactant described in JP-A No. 2001-264110 is effective, and used preferably in a range of from 0.01 mg/m$^2$ to 10 mg/m$^2$, and more preferably, in a range of from 0.1 mg/m$^2$ to 5 mg/m$^2$.

9) Antistatic Agent

The black and white photothermographic material of the invention preferably contains an electrically conductive layer including metal oxides or electrically conductive polymers. The antistatic layer may serve as an undercoat layer, a back surface protective layer, or the like, but can also be placed specially. As an electrically conductive material of the antistatic layer, metal oxides having enhanced electric conductivity by the method of introducing oxygen defects or different types of metallic atoms into the metal oxides are preferable for use. Examples of metal oxides are preferably selected from ZnO, $TiO_2$, or $SnO_2$. As the combination of different types of atoms, preferred are ZnO combined with Al, or In; $SnO_2$ with Sb, Nb, P, halogen atoms, or the like; $TiO_2$ with Nb, Ta, or the like.

Particularly preferred for use is $SnO_2$ combined with Sb. The addition amount of different types of atoms is preferably in a range of from 0.01 mol % to 30 mol %, and more preferably, in a range of from 0.1 mol % to 10 mol %. The shape of the metal oxides can include, for example, spherical, needle-like, or tabular. The needle-like particles, with a rate of (the major axis)/(the minor axis) is 2.0 or more, and more preferably from 3.0 to 50, is preferred viewed from the standpoint of the electric conductivity effect. The metal oxides is preferably used in a range of from 1 mg/m$^2$ to 1000 mg/m$^2$, more preferably from 10 mg/m$^2$ to 500 mg/m$^2$, and even more preferably from 20 mg/m$^2$ to 200 mg/m$^2$.

The antistatic layer may be laid on either side of the image forming layer side or the backside, but it is preferred to set between the support and the back layer.

Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

10) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the Example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like. The moisture content of the support is preferably 0.5% by weight or lower, when coating for image forming layer or back layer is conducted on the support.

11) Other Additives

Furthermore, an anti-oxidizing agent, a stabilizing agent, a plasticizer, a UV absorbent, or a film-forming promoting agent may be added to the black and white photothermographic material. Each of the additives is added to the image forming layer or either of the non-photosensitive layers. Reference can be made to WO No. 98/36322, EP No. 803,764AI, JP-A Nos. 10-186567 and 10-18568, and the like.

12) Coating Method

The black and white photothermographic material of the invention may be coated by any method. Specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and particularly preferably used is slide coating. Example of the shape of the slide coater for use in slide coating is shown in FIG. 11.1, page 427, of the same literature. If desired, two or more layers can be coated simultaneously by the method described in pages 399 to 536 of the same literature, or by the method described in U.S. Pat. No. 2,761,791 and British Patent No. 837,095. Particularly preferred in the invention is the method described in JP-A Nos. 2001-194748, 2002-153808, 2002-153803, and 2002-182333.

The coating solution for the image forming layer in the invention is preferably a so-called thixotropic fluid. For the details of this technology, reference can be made to JP-A No. 11-52509. Viscosity of the coating solution for the image forming layer in the invention at a shear velocity of $0.1S^{-1}$ is preferably from 400 mPa·s to 100,000 mPa·s, and more preferably, from 500 mPa·s to 20,000 mPa·s. At a shear velocity of $1000S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to antifoaming treatment to maintain the coated surface in a fine state. Preferred method for antifoaming treatment in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and successively produce the black and white photothermographic material of the invention.

The black and white photothermographic material is preferably of mono-sheet type (i.e., a type which forms an image on the black and white photothermographic material without using other sheets such as an image-receiving material).

13) Wrapping Material

In order to suppress fluctuation from occurring on photographic property during a preservation of the black and white photothermographic material of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1} m^{-2} day^{-1}$ or lower at 25° C., more preferably, 10 $mL \cdot atm^{-1} m^{-2} day^{-1}$ or lower, and even more preferably, 1.0 $mL \cdot atm^{-1} m^{-2} day^{-1}$ or lower. Preferably, vapor transmittance is 10 $g \cdot atm^{-1} m^{-2} day^{-1}$ or lower, more preferably, 5 $g \cdot atm^{-1} m^{-2}$ $day^{-1}$ or lower, and even more preferably, 1 $g \cdot atm^{-1} m^{-2} day^{-1}$ or lower.

As specific examples of a wrapping material having low oxygen transmittance and/or vapor transmittance, reference can be made to, for instance, the wrapping material described in JP-A Nos. 8-254793 and 2000-206653.

14) Other Applicable Techniques

Techniques which can be used for the black and white photothermographic material of the invention also include those in EP No. 803,764A1, EP No. 883,022A1, WO No. 98/36322, JP-A Nos. 56-62648, 58-62644, JP-A Nos. 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, JP-A Nos. 2000-187298, 2000-10229, 2000-47345, 2000-206642, 2000-98530, 2000-98531, 2000-112059, 2000-112060, 2000-112104, 2000-112064, and 2000-171936.

(Image Forming method)

1) Imagewise Exposure

The black and white photothermographic material of the invention may be subjected to imagewise exposure by any known methods.

As one embodiment, the black and white photothermographic material of the present invention is subjected to scanning exposure using a laser beam.

As preferred laser beam which can be used in the invention, He—Ne laser of red through infrared emission, red laser diode, or $Ar^+$, He—Ne, He—Cd laser of blue through green emission, or blue laser diode are described. Preferred is red to infrared laser diode and the peak wavelength of laser beam is 600 nm to 900 nm, and preferably 620 nm to 850 nm.

In recent years, development has been made particularly on a light source module with an SHG (a second harmonic generator) and a laser diode integrated into a single piece whereby a laser output apparatus in a short wavelength region has become popular. A blue laser diode enables high definition image recording and makes it possible to obtain an increase in recording density and a stable output over a long lifetime, which results in expectation of an expanded demand in the future. The peak wavelength of blue laser beam is preferably from 300 nm to 500 nm, and particularly preferably from 400 nm to 500 nm.

Laser beam which oscillates in a longitudinal multiple modulation by a method such as high frequency superposition is also preferably employed.

As another embodiment, the black and white photothermographic material of the present invention can be preferably applied for an image forming method to record X-ray images using a fluorescent intensifying screen.

The image forming method using the black and white photothermographic materials described above comprises:

(a) providing an assembly for forming an image by placing the black and white photothermographic material between a pair of the fluorescent intensifying screens;

(b) putting an analyte between the assembly and an X-ray source;

(c) applying X-rays having an energy level in a range of 25 kVp to 125 kVp to the analyte;

(d) taking the black and white photothermographic material out of the assembly; and (e) heating the removed black and white photothermographic material in a temperature range of from 90° C. to 180° C.

The black and white photothermographic material used for the assembly in the present invention is subjected to X-ray exposure through a step wedge tablet and thermal development. On the photographic characteristic curve having an optical density (D) and an exposure value (log E) along the rectangular coordinates having the equal axis-of-coordinate unit, it is preferred to adjust so that the thermal developed image may have the photographic characteristic curve where the average gamma (γ) made at the points of a density of fog+0.1 and a density of fog+0.5 is from 0.5 to 0.9, and the average gamma (γ) made at the points of a density of fog+1.2 and a density of fog+1.6 is from 3.2 to 4.0. For the X-ray radiography employed in the practice of the present invention, the use of a black and white photothermographic material having the aforesaid photographic characteristic curve would give the radiation images with excellent photographic properties that exhibit an extended bottom portion and high gamma value at a middle density area. According to this photographic property, the photographic properties mentioned have the advantage of that the depiction in a low density area on the mediastinal region and the heart shadow region having little X-ray transmittance becomes excellent, and that the density becomes easy to view, and that gradation in the images on the lung field region having much X-ray transmittance becomes excellent.

The black and white photothermographic material having a preferred photographic characteristic curve mentioned above can be easily prepared, for example, by the method where each of the image forming layers of both sides is constituted of two or more image forming layers containing silver halide and having sensitivity different from each other. Especially, the aforesaid image forming layer preferably comprises an emulsion of high sensitivity for the upper layer and an emulsion with photographic properties of low sensitivity and high gradation for the lower layer. In the case of preparing the image forming layer comprising two layers, the sensitivity difference between the silver halide emulsion in each layer is preferably from 1.5 times to 20 times, and more preferably from 2 times to 15 times. The ratio of the amounts of emulsion used for forming each layer may depend on the sensitivity difference between emulsions used and the covering power. Generally, as the sensitivity difference is large, the ratio of the using amount of high sensitivity emulsion is reduced. For example, if the sensitivity difference is two times, and the covering power is equal, the ratio of the amount of high sensitivity emulsion to low sensitivity emulsion would be preferably adjusted to be in a range of from 1:20 to 1:50 based on silver amount.

As the techniques for crossover cutting (in the case of double-sided photosensitive material), dyes or combined use of dye and mordant described in JP-A. No. 2-68539, (from page 13, left lower column, line 1 to page 14, left lower column, line 9) can be employed.

Next, the fluorescent intensifying screen of the present invention is explained below. The fluorescent intensifying screen essentially comprises a support and a fluorescent substance layer coated on one side of the support as the fundamental structure. The fluorescent substance layer is a layer where the fluorescent substance is dispersed in a binder. On the surface of a fluorescent substance layer opposite to the support side (the surface of the side that does not face on the support), a transparent protective layer is generally disposed to protect the fluorescent substance layer from chemical degradation and physical shock.

Preferred fluorescent substances according to the present invention are described below. Tungstate fluorescent substances ($CaWO_4$, $MgWO_4$, $CaWO_4$:Pb, and the like), terbium activated rare earth sulfoxide fluorescent substances ($Y_2O_2S$:Tb, $Gd_2O_2S$:Tb, $La_2O_2S$:Tb, $(Y,Gd)_2O_2S$:Tb, $(Y,Gd)O_2S$:Tb, Tm, and the like), terbium activated rare earth phosphate fluorescent substances ($YPO_4$:Tb, $GdPO_4$:Tb, $LaPO_4$:Tb, and the like), terbium activated rare earth oxyhalogen fluorescent substances (LaOBr:Tb, LaOBr:Tb, Tm, LaOCl:Tb, LaOCl:Tb, Tm, LaOBr:Tb, GdOBr:Tb, GdOCl:Tb, and the like), thulium activated rare earth oxyhalogen fluorescent substances (LaOBr:Tm, LaOCl:Tm, and the like), barium sulfate fluorescent substances ($BaSO_4$:Pb, $BaSO_4$:$Eu^{2+}$, $(Ba,Sr)SO_4$:$Eu^{2+}$, and the like), divalent europium activated alkali earth metal phosphate fluorescent substances ($(Ba_2PO_4)_2$:$Eu^{2+}$, $(Ba_2PO_4)_2$:$Eu^{2+}$, and the like), divalent europium activated alkali earth metal fluorinated halogenide fluorescent substances (BaFCl:$Eu^{2+}$, BaFBr:$Eu^{2+}$, BaFCl:$Eu^{2+}$, Tb, BaFBr:$Eu^{2+}$, Tb, $BaF_2$.BaCl.KCl:$Eu^{2+}$, $(Ba,Mg)F_2$.BaCl.KCl:$Eu^{2+}$, and the like), iodide fluorescent substances (CsI:Na, CsI:Tl, NaI, KI:Tl, and the like), sulfide fluorescent substances (ZnS:Ag(Zn,Cd)S:Ag, (Zn,Cd)S:Cu, (Zn,Cd)S:Cu, Al, and the like), hafnium phosphate fluorescent substances ($HfP_2O_7$:Cu and the like), $YTaO_4$ and a substance in which various activator is added as an emission center to $YTaO_4$. However, the fluorescent substance used in the present invention is not particularly limited to these specific examples, as far as the fluorescent substance emits light in visible light region or near ultraviolet region by exposure with a radioactive ray.

In the fluorescent intensifying sheets used for the present invention, the fluorescent substance is preferably packed in a particle diameter graded structure. Especially, the fluorescent substance particles having a large particle diameter are preferably coated at the side of the surface protective layer and fluorescent substance particles having a small particle diameter are preferably coated at the side of the support. The small particle diameter of fluorescent substance is preferably in a range of from 0.5 μm to 2.0 μm, and the large particle diameter is preferably in a range of from 10 μm to 30 μm.

<Combined Use with Ultraviolet Fluorescent Intensifying Screen>

Concerning the image forming method using the black and white photothermographic material of the present invention, it is preferred that the image forming method is performed in combination with a fluorescent substance having a main emission peak at 400 nm or lower. And more preferably, the image forming method is performed in combination with a fluorescent substance having a main emission peak at 380 nm or lower. Either single-sided photosensitive material or double-sided photosensitive material can be applied for the assembly. As the screen having a main emission peak at 400 nm or lower, the screens described in JP-A No. 6-11804 and WO No. 93/01521 and the like are used, but the present invention is not limited to these. As the techniques of crossover cutting (for double-sided photosensitive material) and anti-halation (for single-sided photosensitive material) of ultraviolet light, the technique described in JP-A No. 8-76307 can be applied. As ultraviolet absorbing dyes, the dye described in JP-A No. 2001-144030 is particularly preferred.

2) Thermal Development

Although any method may be used for developing the black and white photothermographic material of the present invention, development is usually performed by elevating the temperature of the black and white photothermographic material exposed imagewise. The temperature of development is preferably from 80° C. to 250° C., more preferably from 100° C. to 140° C., and even more preferably from 110° C. to 130° C. Time period for development is preferably from 1 second to 60 seconds, more preferably from 3 seconds to 30 seconds, and even more preferably from 5 seconds to 25 seconds.

In the process of thermal development, either a drum type heater or a plate type heater may be used, although a plate type heater is preferred. A preferable process of thermal development by a plate type heater is a process described in JP-A No. 11-133572, which discloses a thermal developing apparatus in which a visible image is obtained by bringing a black and white photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the black and white photothermographic material between the pressing rollers and the plate heater. It is preferred that the plate heater is divided into 2 to 6 steps, with the leading end having a lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A No. 54-30032, which allows for passage of moisture and organic solvents included in the black and white photothermographic material out of the system, and also allows for suppressing the change of shapes of the support of the black and white photothermographic material upon rapid heating of the black and white photothermographic material.

For downsizing the thermal developing apparatus and for reducing the time period for thermal development, it is preferred that the heater is more stably controlled, and a top part of one sheet of the black and white photothermographic material is exposed and thermal development of the exposed part is started before exposure of the end part of the sheet has completed.

Preferable imagers which enable a rapid process according to the invention are described in, for example, JP-A Nos. 2002-289804 and 2002-287668.

3) System

Examples of a medical laser imager equipped with an exposing portion and a thermal developing portion include Fuji Medical Dry Laser Imager FM-DPL and DRYPIX 7000. In connection with FM-DPL, description is found in Fuji Medical Review No. 8, pages 39 to 55. The described techniques may be applied as the laser imager for the black and white photothermographic material of the invention. In addition, the present black and white photothermographic material can be also applied as a photothermographic material for the laser imager used in "AD network" which was proposed by Fuji Film Medical Co., Ltd. as a network system accommodated to DICOM standard (Application of the Invention)

The black and white photothermographic material of the present invention is preferably employed as photothermographic materials for use in medical diagnosis, photothermographic materials for use in industrial photographs, photothermographic materials for use in graphic arts, as well as for COM, through forming black and white images by silver imaging.

All publications, patent applications, and technical standards mentioned in this specification are herein incorporated by reference to the same extent as if each individual publication, patent application, or technical standard was specifically and individually indicated to be incorporated by reference.

EXAMPLES

The present invention is specifically explained by way of Examples below, which should not be construed as limiting the invention thereto.

Example 1

1. Preparation of PET Support and Undercoating 1-1. Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, and colored blue with a blue dye (1,4-bis(2,6-diethylanilinoanthraquinone). Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

1-2. Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV-A minute/m$^2$ was executed, judging from the readings of current and voltage on that occasion. The frequency upon this treatment was 9.6 kHz, and the gap clearance between the electrode and dielectric roll was 1.6 mm.

1-3. Undercoating

1) Preparation of Coating Solution for Undercoat Layer

| | |
|---|---|
| Pesresin A-520 manufactured by Takamatsu Oil & Fat Co., Ltd. (30% by weight solution) | 46.8 g |
| BAIRONAARU MD-1200 manufactured by Toyo Boseki Co., Ltd. | 10.4 g |
| Polyethylene glycol monononylphenylether (average ethylene oxide number = 8.5) 1% by weight solution | 11.0 g |
| MP-1000 manufactured by Soken Chemical & Engineering Co., Ltd. (PMMA polymer fine particle, mean particle diameter of 0.4 μm) | 0.91 g |
| Distilled water | 931 mL |

2) Undercoating

Both surfaces of the aforementioned biaxially tentered polyethylene terephthalate support having the thickness of 175 μm were subjected to the corona discharge treatment as described above. Thereafter, the aforementioned formula of the coating solution for the undercoat was coated with a wire bar so that the amount of wet coating became 6.6 mL/m$^2$ (per one side), and dried at 180° C. for 5 minutes. This was subjected on both sides, and thus, an undercoated support was produced.

2. Preparations of Coating Material

1) Preparations of Silver Halide Emulsion

<<Preparation of Silver Halide Emulsion A>>

A solution was prepared by adding 4.3 mL of a 1% by weight potassium iodide solution, and then 3.5 mL of 0.5 mol/L sulfuric acid, 36.5 g of phthalated gelatin, and 160 mL of a 5% by weight methanol solution of 2,2'-(ethylene dithio)diethanol to 1421 mL of distilled water. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 16 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 80 minutes, accompanied by adding the solution D while maintaining the pAg at 10.2. Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The silver halide emulsion A was a pure silver iodide emulsion, and grains in the silver halide emulsion A were pure silver iodide grains having a mean projected area equivalent diameter of 0.93 μm, a variation coefficient of a projected area equivalent diameter distribution of 17.7%, a mean thickness of 0.057 μm, and a mean aspect ratio of 16.3. Tabular grains having an aspect ratio of 2 or more occupied 80% or more of the total projected area. A mean equivalent spherical diameter of the grains was 0.42 μm.

30% or more of the silver iodide existed in γ phase from the result of powder X-ray diffraction analysis.

<<Preparation of Silver Halide Emulsion B>>

1 mol of the tabular grain-AgI emulsion prepared by silver halide emulsion A described above was added to a reaction vessel. The pAg measured at 38° C. was 10.2. 0.5 mol/L potassium bromide solution and 0.5 mol/L silver nitrate solution were added at an addition speed of 10 mL/min over 20 minutes by the method of double jet addition to precipitate substantially a 10 mol % of silver bromide on the silver iodide host grains as epitaxial form while keeping the pAg at 10.2 during the operation. Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The above silver halide dispersion was kept at 38° C. with stirring, and to each was added 5 mL of a 0.34% by weight methanol solution of 1,2-benzoisothiazoline-3-one, and after 40 minutes the temperature was elevated to 47° C. At 20 minutes after elevating the temperature, sodium benzene thiosulfonate in a methanol solution was added at $7.6\times10^{-5}$ mol per 1 mol of silver. At additional 5 minutes later, tellurium sensitizer C in a methanol solution was added at $2.9\times10^{-5}$ mol per 1 mol of silver and subjected to ripening for 91 minutes. Then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $8.5\times10^{-3}$ mol per 1 mol of silver were added to obtain silver halide emulsion B.

<<Preparation of Silver Halide Emulsion C>>

Preparation of silver halide emulsion C was conducted in a similar manner to the process in the preparation of the silver halide emulsion A except that adequately changing the addition amount of a 5% by weight methanol solution of 2,2'-(ethylene dithio)diethanol, the temperature at grain formation step, and the time period for adding the solution A. The silver halide emulsion C was a pure silver iodide emulsion, and grains in the silver halide emulsion C were pure silver iodide grains having a mean projected area equivalent diameter of 1.369 μm, a variation coefficient of a projected area equivalent diameter distribution of 19.7%, a mean thickness of 0.130 μm, and a mean aspect ratio of 11.1. Tabular grains having an aspect ratio of 2 or more occupied 80% or more of the total projected area. A mean equivalent spherical diameter of the grains was 0.71 μm.

15% or more of the silver iodide existed in y phase from the result of powder X-ray diffraction analysis.

<<Preparation of Silver Halide Emulsion D>>

Preparation of silver halide emulsion D was conducted in a similar manner to the process in the preparation of the silver halide emulsion B except that using silver halide emulsion C. The silver halide emulsion D contained 10 mol % of epitaxial silver bromide.

<<Preparation of Mixed Emulsion-1 for Coating Solution>>

The silver halide emulsion B and the silver halide emulsion D were dissolved to give the silver molar ratio of 5:1, and thereto was added benzothiazolium iodide in a 1% by weight aqueous solution to give $7\times10^{-3}$ mol per 1 mol of silver. Further, as "a compound that is one-electron-oxidized to provide a one-electron oxidation product, which releases one or more electrons", the compounds Nos. 1, 2, and 3 are added respectively in an amount of $2\times10^{-3}$ mol per 1 mol of silver in silver halide. Thereafter, as "a compound having an adsorptive group and a reducing group", the compound Nos. 1 and 2 are added respectively in an amount of $8\times10^{-3}$ mol per 1 mol of silver halide. Further, water is added thereto to give the content of silver halide of 15.6 g in terms of silver, per 1 liter of the mixed emulsion for a coating solution.

2) Preparation of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<Preparation of Dispersion of Silver Salt of Fatty Acid>

88 kg of the recrystallized behenic acid, 422 L of distilled water, 49.2 L of 5 mol/L sodium hydroxide aqueous solution, and 120 L of t-butyl alcohol were admixed, and subjected to reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of a fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of poly(vinyl alcohol) (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparations of Reducing Agent Dispersion

<Preparation of Auxiliary Reducing Agent-1 Dispersion>

To 10 kg of auxiliary reducing agent-1 (1,1-bis(2-hydroxy-3,5-dimethylphenyl)-3,5,5-trimethylhexane) and 16 kg of a 10% by weight aqueous solution of modified poly(vinyl alcohol) (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzoisothiazolinone sodium salt and water were added thereto, thereby adjusting the concentration of the auxiliary reducing agent to be 25% by weight. This dispersion was subjected to heat treatment at 60° C. for 5 hours to obtain auxiliary reducing agent-1 dispersion.

Particles of the auxiliary reducing agent included in the resulting auxiliary reducing agent dispersion had a median diameter of 0.40 Jim, and a maximum particle diameter of 1.4 μm or less. The resulting auxiliary reducing agent dispersion was subjected to filtration with a polypropylene filter having a pore size of 3.0 μm to remove foreign substances such as dust, and stored.

<Preparation of Dispersion of Reducing Agent of Formula (I)>

Preparation of the dispersion of reducing agent (23) represented by formula (I) was conducted in a similar manner to the process in the preparation of the auxiliary reducing agent-1 dispersion. Particles of the reducing agent included in the resulting reducing agent dispersion had a median diameter of from 0.30 μm to 0.50 μm, and a maximum particle diameter of 2.0 μm or less.

Reducing agent (23)

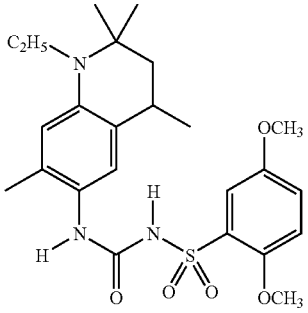

4) Preparations of Y, M, C Coupler Dispersion

Preparations of the dispersions of coupler C-1, M-1, and Y-1 were each conducted in a similar manner to the process in the preparation of the auxiliary reducing agent-i dispersion. Particles of the coupler included in the resulting coupler dispersion had a median diameter of from 0.30 μm to 0.50 μm, and a maximum particle diameter of 2.0 μm or less.

Cyan coupler (C-1)

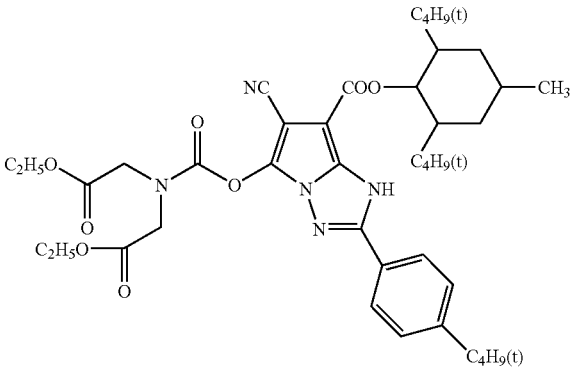

-continued

Magenta coupler (M-1)

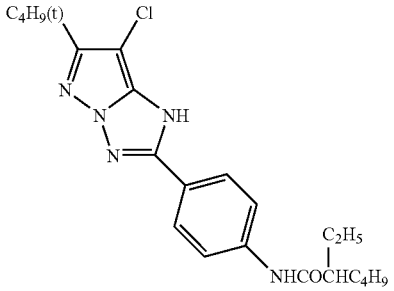

Yellow coupler (Y-1)

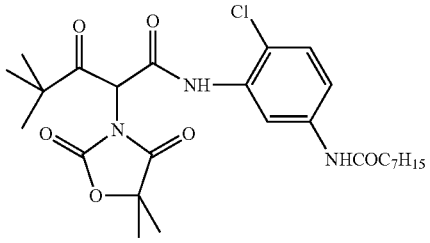

5) Preparations of Dispersion of Coupler of Formula (BC-1)

Preparations of dispersions of the coupler represented by formula (BC-1), which are shown in Table 1, were conducted in a similar manner to the process in the preparation of the auxiliary reducing agent-1 dispersion. Particles of the coupler included in the resulting coupler dispersion had a median diameter of from 0.30 μm to 0.50 μm, and a maximum particle diameter of 2.0 μm or less.

6) Preparation of Hydrogen Bonding Compound Dispersion

<Preparation of Hydrogen Bonding Compound-1 Dispersion>

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resulting hydrogen bonding compound dispersion was subjected to filtration with a polypropylene filter having a pore size of 3.0 μm to remove foreign substances such as dust, and stored.

7) Preparations of Development Accelerator Dispersions and Color-tone-adjusting Agent Dispersion <Preparation of Development Accelerator-1 Dispersion>

To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resulting development accelerator dispersion was subjected to filtration with a polypropylene filter having a pore size of 3.0 μm to remove foreign substances such as dust, and stored.

Also concerning solid dispersions of development accelerator-2 and color-tone-adjusting agent-1, dispersion was executed similar to the development accelerator-1, and thus dispersions of 20% by weight and 15% by weight were respectively obtained.

8) Preparations of Organic Polyhalogen Compound Dispersion

<Preparation of Organic Polyhalogen Compound-1 Dispersion>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 26% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resulting organic polyhalogen compound dispersion was subjected to filtration with a polypropylene filter having a pore size of 10.0 μm to remove foreign substances such as dust, and stored.

<Preparation of Organic Polyhalogen Compound-2 Dispersion>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203) and 0.4 kg of a 20% by weight aqueous solution of sodium triisopropylnaphthalenesulfonate were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resulting organic polyhalogen compound dispersion was subjected to filtration with a polypropylene filter having a pore size of 3.0 μm to remove foreign substances such as dust, and stored.

9) Preparation of Silver Iodide Complex-forming Agent Solution

Modified poly(vinyl alcohol) MP-203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of 6-isopropyl phthalazine to prepare a 5% by weight solution of silver iodide complex-forming agent.

10) Preparations of Solution of Additive

<Preparation of Aqueous Solution of Mercapto Compound-1>

Mercapto compound-1 (1-(3-sulfophenyl)-5-mercaptotetrazole sodium salt) in an amount of 7 g was dissolved in 993 g of water to give a 0.7% by weight aqueous solution.

<Preparation of Aqueous Solution of Mercapto Compound-2>

Mercapto compound-2 (1-(3-methylureidophenyl)-5-mercaptotetrazole) in an amount of 20 g was dissolved in 980 g of water to give a 2.0% by weight aqueous solution.

<Preparation of Aqueous Solution of Phthalic Acid>

A 20% by weight aqueous solution of diammonium phthalate was prepared.

11) Preparation of Pigment-1 Dispersion

C.I. Pigment Blue 60 in an amount of 64 g and 6.4 g of DEMOL N manufactured by Kao Corporation were added to 250 g of water and thoroughly mixed to give slurry. Zirconia beads having the mean particle diameter of 0.5 mm were provided in an amount of 800 g, and charged in a vessel with the slurry. Dispersion was performed with a dispersing machine (1/4G sand grinder mill: manufactured by AIMEX Co., Ltd.) for 25 hours. Thereto was added water to adjust so that the concentration of the pigment became 5% by weight to obtain pigment-i dispersion. Particles of the pigment included in the resulting pigment dispersion had a mean particle diameter of 0.21 μm.

12) Preparations of Latex Binder

<<Preparation of SBR Latex Liquid>>

SBR latex (TP-1) was prepared as follows.

To a polymerization vessel of a gas monomer reaction apparatus (manufactured by Taiatsu Techno Corporation, TAS-2J type) were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion : $NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex (TP-1) was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., a solid content of 44% by weight, an equilibrium moisture content at 25° C. and 60% RH of 0.6% by weight, an ionic conductivity of 4.80 mS/cm (measurement of the ionic conductivity was performed using a conductometer CM-30S manufactured by Toa Electronics Ltd. for the latex stock solution (44% by weight) at 25° C.), and the pH of 8.4.

<<Preparation of Isoprene Latex Liquid>>

Isoprene latex (TP-2) was prepared as follows.

1500 g of distilled water were poured into the polymerization vessel of a gas monomer reaction apparatus (type TAS-2J manufactured by Tiatsu Garasu Kogyo Ltd.), and the vessel was heated for 3 hours at 90° C. to make passive film over the stainless vessel surface and stainless stirring device. Thereafter, 582.28 g of distilled water deacrated by nitrogen gas for one hour, 9.49 g of surfactant "PIONIN A-43-S" (trade name, available from Takemoto Oil & Fat Co., Ltd.), 19.56 g of 1 mol/L sodium hydroxide, 0.20 g of ethylenediamine tetraacetic acid tetrasodium salt, 314.99 g of styrene, 190.87 g of isoprene, 10.43 g of acrylic acid, and 2.09 g of tert-dodecyl mercapatn were added into the pretreated reaction vessel. And then, the reaction vessel was sealed and the mixture was stirred at the stirring rate of 225 rpm, followed by elevating the inner temperature to 65° C. A solution obtained by dissolving 2.61 g of ammonium persulfate in 40 mL of water was added to the aforesaid mixture and kept for 6 hours with stirring. At the point the polymerization ratio was 90% according to the solid content measurement. Thereto a solution obtained by dissolving 5.22 g of acrylic acid in 46.98 g of water was added, and then 10 g of water and a solution obtained by dissolving 1.30 g of ammonium persulfate in 50.7 mL of water were added. After the addition, the mixture was heated to 90° C. and stirred for 3 hours. After the reaction was finished, the inner temperature of the vessel was cooled to room temperature. And then, the mixture was treated by adding 1 mol/L sodium hydroxide and ammonium hydroxide to give the molar ratio of Na+ion: $NH_4$+ion=1:5.3, and thus, the pH of the mixture was adjusted to 8.4. Thereafter, the resulting mixture was filtered with a polypropylene filter having a pore size of 1.0 Jm to remove foreign substances such as dust, and stored. 1248 g of isoprene latex (TP-2) was obtained. Upon the measurement of halogen ion by ion chromatography, concentration of chloride ion was revealed to be 3 ppm. As a result of the measurement of the concentration of the chelating agent by high performance liquid chromatography, it was revealed to be 142 ppm.

The obtained latex had a mean particle diameter of 113 nm, Tg of 15° C., a solid content of 41.3% by weight, an equilibrium moisture content under an atmosphere of 25° C. and 60RH % of 0.4% by weight, and an ionic conductivity of 5.23 mS/cm (measurement of the ionic conductivity was performed using a conductometer CM-30S manufactured by Toa Electronics Ltd. at 25° C.)

3. Preparations of Coating Solution

1) Preparation of Coating Solution for Image Forming Layer

To the dispersion of the silver salt of a fatty acid obtained as described above in an amount of 1000 g were serially added water, the organic polyhalogen compound-1 dispersion, the organic polyhalogen compound-2 dispersion, the SBR latex (TP-1) (Tg: 17° C.) liquid, the isoprene latex (TP-2) liquid, the auxiliary reducing agent-i dispersion, the dispersion of reducing agent (23) (shown in Table 1), the dispersions of Y, M, and C coupler (shown in Table 1), the dispersion of the coupler represented by formula (BC-1) (shown in Table 1), the hydrogen bonding compound-1 dispersion, the development accelerator-1 dispersion, the development accelerator-2 dispersion, the color-tone-adjusting agent-1 dispersion, the silver iodide complex-forming agent solution, the mercapto compound-1 aqueous solution, and the mercapto compound-2 aqueous solution. The coating solution for the image forming layer was prepared by adding the mixed emulsion-i for a coating solution thereto, followed by thorough mixing just prior to the coating.

2) Preparation of Coating Solution for Intermediate Layer

To 1000 g of poly(vinyl alcohol) PVA-205 (manufactured by Kuraray Co., Ltd.), 272 g of the pigment-i dispersion, 4200 mL of a 19% by weight liquid of methyl methacrylate/styrene/butyl acrylate/hydroxyethyl methacrylate/acrylic acid copolymer (mass ratio of the copolymerization of 64/9/20/5/2) latex, 27 mL of a 5% by weight aqueous solution of aerosol TO (manufactured by American Cyanamid Co.), 135 mL of a 20% by weight aqueous solution of diammonium phthalate was added water to give a total amount of 10000 g. The mixture was adjusted with sodium hydroxide to give the pH of 7.5. Accordingly, the coating solution for the intermediate layer was prepared, and was fed to a coating die to provide 9.1 mL/$m^2$.

Viscosity of the coating solution was 58 [mPa·s] which was measured with a B type viscometer at 40° C. (No. 1 rotor, 60 rpm).

3) Preparation of Coating Solution for First Layer of Surface Protective Layers 64 g of inert gelatin was dissolved in water, and thereto were added 112 g of a 19.0% by weight liquid of methyl methacrylate/styrene/butyl acrylate/hydroxyethyl methacrylate/acrylic acid copolymer (mass ratio of the copolymerization of 64/9/20/5/2) latex, 30 mL of a 15% by weight methanol solution of phthalic acid, 23 mL of a 10% by weight aqueous solution of 4-metyl phthalic acid, 28 mL of 0.5 mol/L sulfuric acid, 5 mL of a 5% by weight aqueous solution of aerosol TO (manufactured by American Cyanamid Co.), 0.5 g of phenoxyethyl alcohol, and 0.1 g of benzoisothiazolinone. Water was added to give a total amount of 750 g. Immediately before coating, 26 mL of a 4% by weight chrome alum which had been mixed with a static mixer was fed to a coating die so that the amount of the coating solution became 18.6 mL/$m^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In water was dissolved 80 g of inert gelatin and thereto were added 102 g of a 27.5% by weight liquid of methyl methacrylate/styrene/butyl acrylate/hydroxyethyl methacrylate/acrylic acid copolymer (mass ratio of the copolymerization of 64/9/20/5/2) latex, 5.4 mL of a 2% by weight solution of a fluorocarbon surfactant (F-1), 5.4 mL of a 2% by weight aqueous solution of another fluorocarbon surfactant (F-2), 23 mL of a 5% by weight aqueous solution of aerosol TO (manufactured by American Cyanamid Co.), 4 g of poly(methyl methacrylate) fine particles (mean particle diameter of 0.7 μm, distribution of volume weighted average being 30%), 21 g of poly(methyl methacrylate) fine particles (mean particle diameter of 3.6 μm, distribution of volume weighted average being 60%), 1.6 g of 4-methyl phthalic acid, 4.8 g of phthalic acid, 44 mL of 0.5 mol/L sulfuric acid, and 10 mg of benzoisothiazolinone. Water was added to give a total amount of 650 g. Immediately before coating, 445 mL of a aqueous solution containing 4% by weight chrome alum and 0.67% by weight phthalic acid were added and admixed with a static mixer to give a coating solution for the second layer of the surface protective layers, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

4. Preparations of Black and White Photothermographic Material

1) Preparations of Black and White Photothermographic Material-1 to -9

On both surfaces of the support, simultaneous overlaying coating by a slide bead coating method was subjected in order of the image forming layer, intermediate layer, first layer of the surface protective layers, and second layer of the surface protective layers, starting from the undercoated face. In this method, the temperature of the coating solution was adjusted to 31° C. for the image forming layer and intermediate layer, to 36° C. for the first layer of the surface protective layers, and to 37° C. for the second layer of the surface protective layers. The amount of coated silver was 0.57 g/m$^2$ per one side, with respect to the sum of silver'salt of a fatty acid and silver halide. This was coated on both sides of the support.

The coating amount of each compound (g/m$^2$) for the image forming layer per one side is as follows.

| | |
|---|---|
| Silver salt of a fatty acid | 1.67 |
| Organic polyhalogen compound-1 | 0.04 |
| Organic polyhalogen compound-2 | 0.10 |
| Silver iodide complex-forming agent | 0.46 |
| SBR latex | 2.08 |
| Isoprene latex | 3.12 |
| Reducing agent (23) | (see Table 1) |
| Auxiliary reducing agent-1 | (see Table 1) |
| Coupler (C-1) | (see Table 1) |
| Coupler (M-1) | (see Table 1) |
| Coupler (Y-1) | (see Table 1) |
| Coupler of formula (BC-1) | (see Table 1) |
| Hydrogen bonding compound-1 | 0.15 |
| Development accelerator-1 | 0.02 |
| Development accelerator-2 | 0.01 |
| Color-tone-adjusting agent-1 | 0.002 |
| Mercapto compound-1 | 0.001 |
| Mercapto compound-2 | 0.003 |
| Silver halide (on the basis of Ag content) | 0.17 |

Thus prepared black and white photothermographic material had a level of matting of 550 seconds. In addition, measurement of pH of the film surface gave the result of 6.0.

TABLE 1

| | Reducing Agent of Formula (I) | | Coupler of Formula (BC-1) | | Y, M, C Coupler | | |
|---|---|---|---|---|---|---|---|
| Sample No. | No. | Addition Amount (mmol/m$^2$) | No. | Addition Amount (mmol/m$^2$) | No. | Addition Amount (mmol/m$^2$) | Note |
| 1 | (23) | 1.2 | — | — | — | — | Comparative |
| 2 | (23) | 1.2 | BC-11 | 1.0 | — | — | Invention |
| 3 | (23) | 1.2 | BC-19 | 1.0 | — | — | Invention |
| 4 | (23) | 1.2 | BC-11 | 0.8 | Y-1 | 0.10 | Invention |
| | | | | | M-1 | 0.05 | |
| | | | | | C-1 | 0.05 | |
| 5 | (23) | 1.2 | BC-19 | 0.6 | Y-1 | 0.2 | Invention |
| | | | | | M-1 | 0.1 | |
| | | | | | C-1 | 0.1 | |
| 6 | (23) | 1.2 | BC-20 | 1.0 | Y-1 | 0.1 | Invention |
| | | | | | M-1 | 0.05 | |
| | | | | | C-1 | 0.05 | |
| 7 | (23) | 1.2 | BC-21 | 0.5 | Y-1 | 0.3 | Invention |
| | | | | | M-1 | 0.1 | |
| | | | | | C-1 | 0.1 | |
| 8 | (23) | 1.2 | BC-22 | 0.25 | Y-1 | 0.45 | Invention |
| | | | | | M-1 | 0.15 | |
| | | | | | C-1 | 0.15 | |
| 9 | (23) | 1.2 | BC-23 | 0.1 | Y-1 | 0.6 | Invention |
| | | | | | M-1 | 0.2 | |
| | | | | | C-1 | 0.2 | |

Chemical structures of the compounds used in Examples of the invention are shown below.

Tellurium sensitizer C

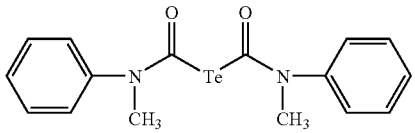

Compound 1 that is One-electron-oxidized to Provide a One-electron Oxidation Product which Releases One or More Electrons

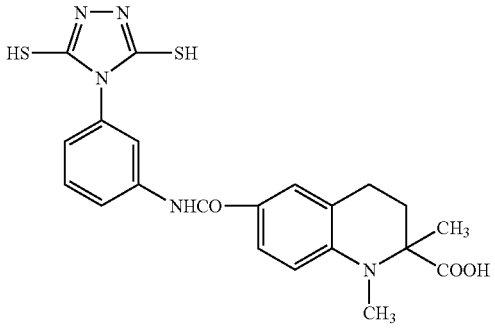

Compound 2 that is One-electron-oxidized to Provide a One-electron Oxidation Product which Releases one or More Electrons

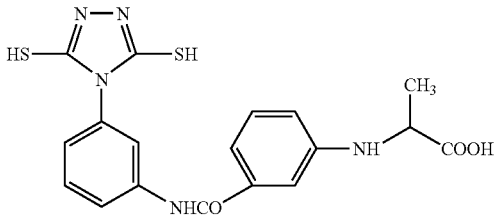

Compound 3 that is One-electron-oxidized to Provide a One-electron Oxidation Product which Releases One or More electrons

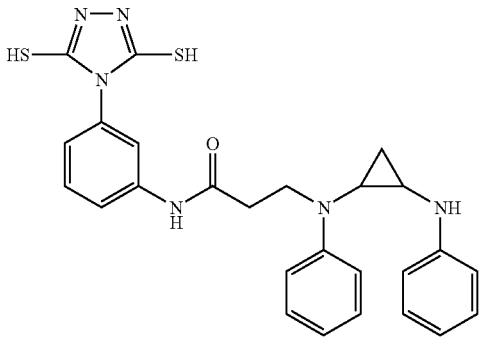

Compound 1 Having Adsorptive Group and Reducing Group

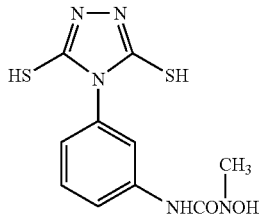

Compound 2 Having Adsorptive Group and Reducing Group

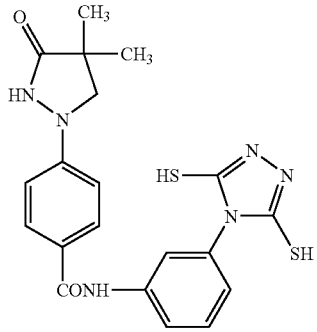

Auxiliary reducing agent-1

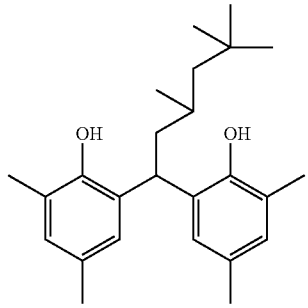

Hydrogen bonding compound-1

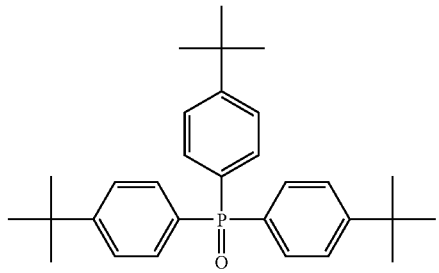

Organic polyhalogen compound-1

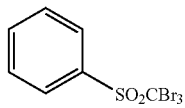

-continued

Organic polyhalogen compound-2

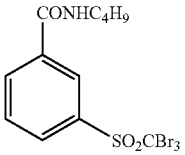

Mercapto compound-1

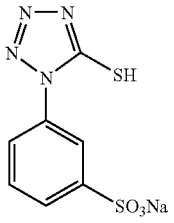

Mercapto compound-2

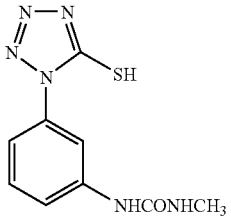

Development accelerator-1

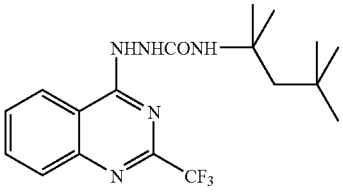

Development accelerator-2

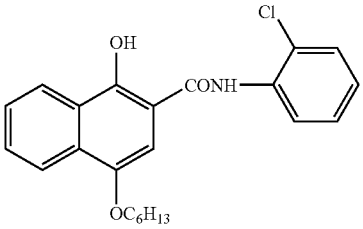

Color-tone-adjusting agent-1

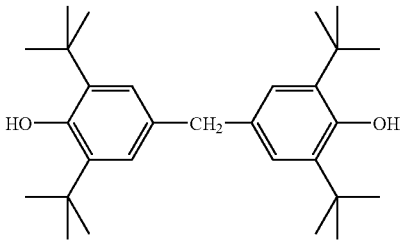

-continued (F-1)

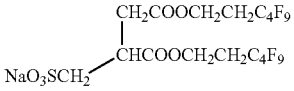

(F-2)

Mixture of

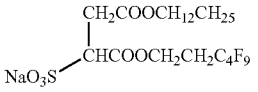

and

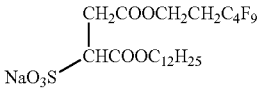

5. Evaluation of Performance

1) Preparation

The obtained sample was cut into a half-cut size, and was wrapped with the following packaging material under an environment of 25° C. and 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1} m^{-2} day^{-1}$;

vapor permeability at 25° C.: 0.10 $g \cdot atm^{-1} m^{-2} day^{-}$.

2) Imagewise Exposure and Thermal Development

Two sheets of X-ray regular screen HI-SCREEN-B3 ($CaWO_4$ was used as fluorescent substance, the emission peak wavelength of 425 nm) produced by Fuji Photo Film Co., Ltd. were used, and the assembly for image formation was provided by inserting the sample between them. This assembly was subjected to X-ray exposure for 0.05 seconds, and then X-ray sensitometry was performed. The X-ray apparatus used was DRX-3724HD (trade name) produced by Toshiba Corp., and a tungsten target tube was used. X-ray emitted by a pulse generator operated at three phase voltage of 80 kVp and penetrated through a filter comprising 7 cm thickness of water having the absorption ability almost the same as human body was used as the light source. Changing the exposure value of X-ray by a distance method, the sample was subjected to exposure with a step wedge tablet having a width of 0.15 in terms of log E. After exposure, the exposed sample was subjected to thermal development with the condition mentioned below.

The thermal developing portion of Fuji Medical Dry Laser Imager FM-DPL was modified so that it can heat from both sides, and by another modification the transportation rollers in the thermal developing portion were changed to the heating drum so that the sheet of film could be conveyed. The temperature of four panel heaters were set to 112° C.-118° C.-120° C.-120° C., and the temperature of the heating drum was set to 120° C. By increasing the speed of transportation, the total time period for thermal development was set to be 14 seconds.

3) Evaluation of Photographic Properties

Visual density of the obtained sample was measured.

<<Fog>>

Fog is expressed in terms of a density of the unexposed part.

<<Sensitivity>>

Sensitivity is expressed in terms of the inverse of the X-ray exposure value giving a density of fog+1.0. The sensitivities are shown in relative value, detecting the sensitivity of a standard sample to be 100.

<<Maximum Density (Dmax)>>

Maximum density is expressed in terms of a saturated density with an increase of the exposure value.

4) Image Tone

The image tones in the low density area (the portion having an approximate optical density of 0.3 or less), the middle density area (the portion having an approximate optical density of from 0.5 to 1.0), and the high density area (Dmax portion) were sensory evaluated.

<Evaluation Criteria>

○: Blue-black image tone and a preferable color tone.

Δ: A Warm black image tone to natural black image tone, and within the practically allowable range.

x: Brownish black tone to apparently warm black tone, and outside of the practically allowable range.

5) Evaluation of Raw Stock Storability

The samples wrapped in the packaging material described above were stored under an environment of 45° C. for a period of 20 days. Thereafter after opening the packaging, the samples stored were evaluated on the photographic performance.

○: Slightly change in color tone is seen, and a preferable level.

Δ: Apparent change in color tone is seen, but within the practically allowable range.

x: Remarkable change in color tone is seen, and outside of the practically allowable range.

6) Evaluation of Image Storability

The thermal developed samples were stored under an illumination of 1000 lux of a fluorescent lamp at 25° C. over a period of 14 days. The image storability was evaluated by the change in color tone.

○: Slightly change in color tone is seen, and a preferable level.

Δ: Apparent change in color tone is seen, but within the practically allowable range.

x: Remarkable change in color tone is seen, and outside of the practically allowable range.

7) Results

The obtained results are shown in Table 2.

The samples of the present invention exhibit high image density and images of preferable color tone. In addition, improvement in image storability and raw stock storability is attained thereby.

TABLE 2

| | Photographic Properties | | | | | Raw Stock Storability | | | | Image Storability | | |
|---|---|---|---|---|---|---|---|---|---|---|---|---|
| Sample No. | fog | S | Dmax | Color Tone in Low Density Area | Color Tone in Middle to High Density Area | Δ fog | Δ Dmax | Color Tone in Low Density Area | Color Tone in Middle to High Density Area | Color Tone in Low Density Area | Color Tone in Middle to High Density Area | Note |
| 1 | 0.26 | 100 | 0.82 | x | x | 0.24 | −0.35 | x | x | x | x | Comparative |
| 2 | 0.21 | 185 | 2.91 | ○ | Δ | 0.05 | −0.09 | Δ | Δ | x | ○ | Invention |
| 3 | 0.22 | 170 | 2.83 | ○ | Δ | 0.06 | −0.07 | Δ | Δ | x | ○ | Invention |
| 4 | 0.18 | 205 | 3.15 | ○ | ○ | 0.04 | −0.03 | ○ | ○ | ○ | ○ | Invention |
| 5 | 0.18 | 200 | 3.21 | ○ | ○ | 0.03 | −0.05 | ○ | ○ | ○ | ○ | Invention |
| 6 | 0.20 | 220 | 3.35 | ○ | Δ | 0.06 | 0.02 | ○ | Δ | Δ | ○ | Invention |
| 7 | 0.18 | 210 | 3.09 | ○ | ○ | 0.04 | −0.04 | ○ | ○ | ○ | ○ | Invention |
| 8 | 0.19 | 210 | 3.11 | ○ | ○ | 0.04 | −0.05 | ○ | ○ | ○ | ○ | Invention |
| 9 | 0.19 | 205 | 3.25 | Δ | ○ | 0.05 | −0.03 | Δ | ○ | Δ | ○ | Invention |

Example 2

Black and white photothermographic material-11 to -19 were prepared in a similar manner to the process in the preparations of sample Nos. 1, 3, and 5 of Example 1, except that the coating amounts of the coating solution for the image forming layer were changed to make the total amount of coated silver being the amounts shown in Table 3.

Evaluation was performed similar to Example 1, and the obtained results are shown in Table 3.

Samples of the present invention exhibit high image density similar to the comparative samples while reducing the amount of coated silver and further exhibit excellent performance in image tone and storage stability.

TABLE 3

| | | | Photographic Properties | | | | | Raw Stock Storability | | | | Image Storability | | |
|---|---|---|---|---|---|---|---|---|---|---|---|---|---|---|
| Sample No. | Coating Solution No. | Amount of Coated Silver per One Side ($g/m^2$) | fog | S | Dmax | Color Tone in Low Density Area | Color Tone in Middle to High Density Area | Δ fog | Δ Dmax | Color Tone in Low Density Area | Color Tone in Middle to High Density Area | Color Tone in Low Density Area | Color Tone in Middle to High Density Area | Note |
| 1 | 1 | 0.57 | 0.26 | 100 | 0.82 | x | x | 0.24 | −0.35 | x | x | x | x | Comparative |
| 11 | 1 | 0.45 | 0.25 | 65 | 0.66 | x | x | 0.22 | −0.28 | x | x | x | x | Comparative |

TABLE 3-continued

| | | | Photographic Properties | | | | | Raw Stock Storability | | | | Image Storability | | |
|---|---|---|---|---|---|---|---|---|---|---|---|---|---|---|
| Sample No. | Coating Solution No. | Amount of Coated Silver per One Side ($g/m^2$) | fog | S | Dmax | Color Tone in Low Density Area | Color Tone in Middle to High Density Area | Δ fog | Δ Dmax | Color Tone in Low Density Area | Color Tone in Middle to High Density Area | Color Tone in Low Density Area | Color Tone in Middle to High Density Area | Note |
| 12 | 1 | 0.35 | 0.24 | 40 | 0.48 | x | x | 0.20 | −0.22 | x | x | x | x | Comparative |
| 13 | 1 | 0.25 | 0.23 | 20 | 0.33 | x | x | 0.12 | 0.08 | x | x | x | x | Comparative |
| 3 | 3 | 0.57 | 0.22 | 170 | 2.83 | ○ | Δ | 0.06 | −0.07 | Δ | Δ | x | ○ | Invention |
| 14 | 3 | 0.45 | 0.18 | 150 | 2.65 | ○ | ○ | 0.04 | −0.06 | ○ | Δ | Δ | ○ | Invention |
| 15 | 3 | 0.35 | 0.17 | 135 | 2.48 | ○ | ○ | 0.03 | −0.06 | ○ | ○ | Δ | ○ | Invention |
| 16 | 3 | 0.25 | 0.16 | 120 | 2.37 | ○ | ○ | 0.03 | −0.05 | ○ | ○ | Δ | ○ | Invention |
| 5 | 5 | 0.57 | 0.18 | 200 | 3.21 | ○ | ○ | 0.03 | −0.05 | ○ | ○ | ○ | ○ | Invention |
| 17 | 5 | 0.45 | 0.17 | 170 | 3.16 | ○ | ○ | 0.03 | −0.03 | ○ | ○ | ○ | ○ | Invention |
| 18 | 5 | 0.35 | 0.16 | 155 | 3.08 | ○ | ○ | 0.02 | −0.02 | ○ | ○ | ○ | ○ | Invention |
| 19 | 5 | 0.25 | 0.16 | 140 | 3.02 | ○ | ○ | 0.02 | −0.02 | ○ | ○ | ○ | ○ | Invention |

What is claimed is:

1. A black and white photothermographic material comprising, on at least one side of a support, an image forming layer comprising at least a photosensitive silver halide, a silver salt of an aliphatic carboxylic acid having 10 to 30 carbon atoms, a reducing agent for silver ions, and a binder of which 50% by weight or more is a polymer latex containing a monomer component represented by the following formula (M) in a range of from 10% by weight to 70% by weight:

$$CH_2{=}CR^{01}{-}CR^{02}{=}CH_2 \qquad \text{Formula (M)}$$

wherein $R^{01}$ and $R^{02}$ each independently represent a hydrogen atom, an alkyl group having 1 to 6 carbon atoms, a halogen atom, or a cyano group, wherein the black and white photothermographic material comprises a compound represented by the following formula (I) as the reducing agent, and further comprises an auxiliary reducing agent represented by the following formula (R) and a coupler which is represented by the following formula (BC-1) and performs a coupling reaction with an oxidation product of the compound represented by formula (I) to form a dye:

Formula (I)

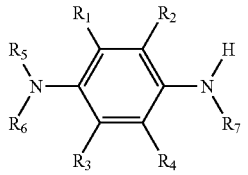

wherein $R_1$, $R_2$, $R_3$ and $R_4$ each independently represent a hydrogen atom or a substituent; $R_5$ and $R_6$ each independently represent an alkyl group, an aryl group, a heterocyclic group, an acyl group, or a sulfonyl group; members in at least one combination of $R_1$ and $R_2$, $R_3$ and $R_4$, $R_5$ and $R_6$, $R_2$ and $R_5$, and $R_4$ and $R_6$ may bond to each other to form a 5-, 6-, or 7-membered ring; $R_7$ represents $R_{11}$—O—CO—, $R_{12}$—CO—CO—, $R_{13}$—NH—CO—, $R_{14}$—$SO_2$—, $R_{15}$—W—C($R_{16}$)($R_{17}$)—, $R_{19}$—$SO_2$NHCO—, $R_{20}$—CONHCO—, $R_{21}$—$SO_2$NH$SO_2$—, $R_{22}$—CONH$SO_2$—, or $(M)_{1/n}$ $OSO_2$—; $R_{11}$, $R_{12}$, $R_{13}$, $R_{14}$, $R_{19}$, $R_{20}$, $R_{21}$, and $R_{22}$ each independently represent an alkyl group, an aryl group, or a heterocyclic group; $R_{15}$ represents a hydrogen atom or a block group; W represents an oxygen atom, a sulfur atom, or —N($R_{18}$)—; $R_{16}$, $R_{17}$ and $R_{18}$ each independently represent a hydrogen atom or an alkyl group; and M represents a cation having a valency of n;

Formula (BC-1)

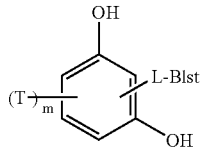

wherein L represents a divalent linking group; Blst represents a ballast group which causes a coupler molecule to have diffusion resistance; T represents a substituent which leaves upon coupling reaction; and m represents an integer of from 0 to 3;

Formula (R)

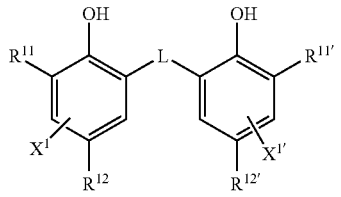

wherein $R^{11}$ and $R^{11'}$ each independently represent an alkyl group having 1 to 20 carbon atoms; $R^{12}$ and $R^{12'}$ each independently represent a hydrogen atom or a group substituting for a hydrogen atom on a benzene ring; L represents an —S—group or a —$CHR^{13}$— group; $R^{13}$ represents a hydrogen atom or an alkyl group having 1 to 20 carbon atoms; and $X^1$ and $X^{1'}$ each independently represent a hydrogen atom or a group substituting for a hydrogen atom on a benzene ring.

2. The black and white photothermographic material according to claim 1, wherein the compound represented by formula (BC-1) is a compound represented by the following formula (BC-2):

Formula (BC-2)

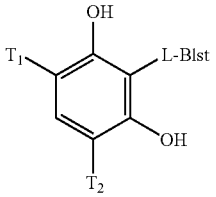

wherein L and Blst each have the same meaning as in formula (BC-1); and $T_1$ and $T_2$ each independently represent a hydrogen atom or a substituent which leaves upon coupling reaction.

3. The black and white photothermographic material according to claim 1, wherein, in formula (R), $R^{11}$ and $R^{11'}$ each independently represent a secondary or tertiary alkyl group.

4. The black and white photothermographic material according to claim 1, wherein, in formula (M), both of $R^{01}$ and $R^{02}$ represent a hydrogen atom, or one of $R^{01}$ or $R^{02}$ represents a hydrogen atom and the other represents a methyl group.

5. The black and white photothermographic material according to claim 1, wherein the group represented by L-Blst in formula (BC-1) is a group selected from the group consisting of —$COR_{1b}$, —$SO_2R_{2b}$, —$COOR_{3b}$, —$NHCOR_{4b}$, —$CQNHR_{5b}$, —$CON(R_{6b})(R_{7b})$, —$COSO_2R_{8b}$, —$NHCONHR_{9b}$, —$NHSO_2R_{10b}$, and —$NHR_{11b}$; and $R_{1b}$ to $R^{11b}$ each represent a ballast group.

6. The black and white photothermographic material according to claim 2, wherein the group represented by L-Blst in formula (BC-2) is a group selected from the group consisting of —$COR_{1b}$, —$SO_2R_{2b}$, —$COOR_{3b}$, —$NHCOR_{4b}$, —$CONHR_{5b}$, —$CON(R_{6b})(R_{7b})$, —$COSO_2R_{8b}$, —$NHCONHR_{9b}$, —$NHSO_2R_{10b}$, and —$NHR_{11b}$; and $R_{1b}$ to $R_{11b}$ each represent a ballast group.

7. The black and white photothermographic material according to claim 5, wherein the group represented by L-Blst in formula (BC-1) is —$CONHR_{5b}$.

8. The black and white photothermographic material according to claim 6, wherein the group represented by L-Blst in formula (BC-2) is —$CONHR_{5b}$.

9. The black and white photothermographic material according to claim 1, wherein the leaving group represented by T in formula (BC-1) represents a hydrogen atom, a halogen atom, an alkoxy group, an aryloxy group, an alkylthio group, an arylthio group, an acyloxy group, a carbamoyloxy group, an imide group, a methylol group, or a heterocyclic group.

10. The black and white photothermographic material according to claim 2, wherein the leaving groups represented by $T_1$ and $T_2$ in formula (BC-2) each independently represent a hydrogen atom, a halogen atom, an alkoxy group, an aryloxy group, an alkylthio group, an arylthio group, an acyloxy group, a carbamoyloxy group, an imide group, a methylol group, or a heterocyclic group.

11. The black and white photothermographic material according to claim 1, wherein the reducing agent is a compound represented by the following formula (II):

Formula (II)

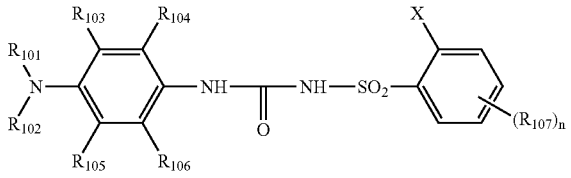

wherein $R_{101}$ and $R_{102}$ each independently represent a substituted or unsubstituted alkyl group, aryl group, heterocyclic group, acyl group, alkylsulfonyl group, or arylsulfonyl group; $R_{103}$, $R_{104}$, $R_{105}$, $R_{106}$, and $R_{107}$ each independently represent a hydrogen atom or a substituent; members in at least one combination of $R_{101}$ and $R_{102}$, $R_{103}$ and $R_{104}$, $R_{105}$ and $R_{106}$, and $R_{107}$ and X may bond to each other to form a 5-, 6-, or 7-membered ring; X represents a halogen atom or a substituent having a heteroatom through which the substituent bonds to the benzene ring; n represents an integer of from 0 to 4; and when n represents 2 or more, a plurality of $R_{107}$ may be the same or different from one another and may bond to each other to form a 5-, 6-, or 7- membered ring.

12. The black and white photothermographic material according to claim 1, wherein the reducing agent is a compound represented by the following formula (III):

Formula (III)

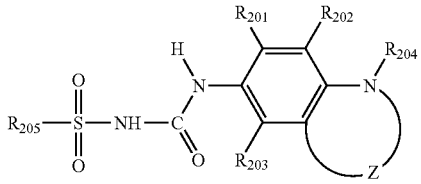

wherein $R_{201}$, $R_{202}$, and $R_{203}$ each independently represent a hydrogen atom or a substituent; $R_{204}$ represents an alkyl group, an aryl group, or a heterocyclic group; members in at least one combination of $R_{201}$ and $R_{202}$, and $R_{202}$ and $R_{204}$ may bond to each other to form a 5-, 6-, or 7-membered ring; Z represents a non-metallic atomic group for forming a 5-, 6-, or 7-membered ring together with a nitrogen atom and two carbon atoms in a benzene ring; and $R_{205}$ represents an alkyl group, an aryl group, or a heterocyclic group.

13. The black and white photothermographic material according to claim 12, wherein $R_{205}$ in formula (III) is a group represented by the following formula Formula (IV)

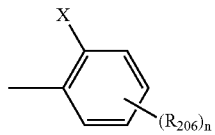

wherein X represents a halogen atom or a group which substitutes for a hydrogen atom on a benzene ring through a heteroatom; $R_{206}$ represents a substituent; n represents an integer of from 0 to 4; and when n represents 2 or more, a plurality of $R_{206}$ may be the same or different from one another, and two adjacent groups thereamong may bond to each other to form a 5-, 6-, or 7-membered carbon ring or heterocycle.

14. The black and white photothermographic material according to claim 1, wherein the black and white photothermographic material further comprises at least one compound represented by a formula selected from the group consisting of the following formulae (C1), (C-2), (C-3), (M-1), (M-2), (M-3), (Y-1), (Y-2), and (Y-3):

Formula (C-1)

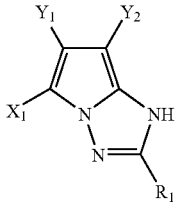

wherein $X_1$ represents a hydrogen atom or a leaving group; $Y_1$ and $Y_2$ each independently represent an electron-attracting substituent; and $R_1$ represents an alkyl group, an aryl group, or a heterocyclic group;

Formula (C-2)

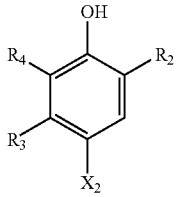

wherein $X_2$ represents a hydrogen atom or a leaving group; $R_2$ represents an acylamino group, a ureido group, or a urethane group; $R_3$ represents a hydrogen atom, an alkyl group, or an acylamino group; $R_4$ represents a hydrogen atom or a substituent; and $R_3$ and $R_4$ may link together to form a ring;

Formula (C-3)

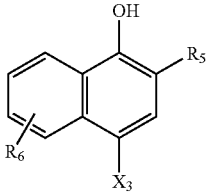

wherein $X_3$ represents a hydrogen atom or a leaving group; $R_5$ represents a carbamoyl group or a sulfamoyl group; and $R_6$ represents a hydrogen atom or a substituent;

Formula (M-1)

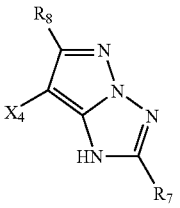

wherein $X_4$ represents a hydrogen atom or a leaving group; $R_7$ represents an alkyl group, an aryl group, or a heterocyclic group; and $R_8$ represents a substituent;

Formula (M-2)

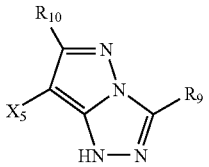

wherein $X_5$ represents a hydrogen atom or a leaving group; $R_9$ represents an alkyl group, an aryl group, or a heterocyclic group; and $R_{10}$ represents a sub substituent;

Formula (M-3)

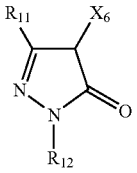

wherein $X_6$ represents a hydrogen atom or a leaving group; $R_{11}$ represents an alkyl group, an aryl group, an acylamino group, or an anilino group; and $R_{12}$ represents an alkyl group, an aryl group, or a heterocyclic group;

Formula (Y-1)

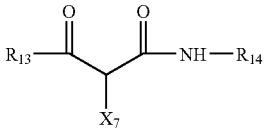

wherein $X_7$ represents a hydrogen atom or a leaving group; $R_{13}$ represents an alkyl group, an aryl group, or an indolenyl group; and $R_{14}$ represents an aryl group or a heterocyclic group;

Formula (Y-2)

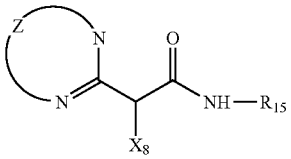

wherein $X_8$ represents a hydrogen atom or a leaving group; Z represents a bivalent group necessary for forming a 5- to 7-membered ring; and $R_{15}$ represents an aryl group or a heterocyclic group;

Formula (Y-3)

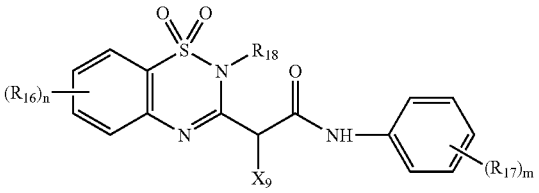

wherein $X_9$ represents a hydrogen atom or a leaving group; $R_{16}$, $R_{17}$, and $R_{18}$ each independently represent a substituent; n represents an integer of from 0 to 4; m represents an integer of from 0 to 5; when n represents 2 or more, a plurality of $R_{16}$ may be the same or different from one another; and when m represents 2 or more, a plurality of $R_{17}$ may be the same or different from one another.

15. The black and white photothermographic material according to claim 14, wherein the black and white photothermographic material comprises two or more compounds selected from among three compounds including: one compound selected from the group consisting of compounds consisting of represented by formula (C-1), (C-2), and (C-3); one compound selected from the group consisting of compounds represented by formula (M-1), (M-2), and (M-3); and one compound selected from the group consisting of compounds represented by formulae (Y-1), (Y-2), and (Y-3).

16. The black and white photothermographic material according to claim 1, wherein the photosensitive silver halide has an average silver iodide content of 40 mol % or higher.

17. The black and white photothermographic material according to claim 16, wherein the average silver iodide content of the photosensitive silver halide is 80 mol % or higher.

18. The black and white photothermographic material according to claim 17, wherein the average silver iodide content of the photosensitive silver halide is 90 mol % or higher.

19. The black and white photothermographic material according to claim 16, wherein the photosensitive silver halide comprises tabular grains.

20. The black and white photothermographic material according to claim 1, wherein a total amount of coated silver including the silver halide and the silver salt of an aliphatic carboxylic acid is 0.05 $g/m^2$ to 3.0 $g/m^2$, and a coating amount of the silver halide is 0.5 mol % to 100 mol% based on the silver salt of an aliphatic carboxylic acid.

21. The black and white photothermographic material according to claim 20, wherein the total amount of coated silver including the silver halide and the silver salt of an aliphatic carboxylic acid is 0.2 $g/m^2$ to 1.2 $g/m^2$.

22. The black and white photothermographic material according to claim 20, wherein a coating amount of the silver halide is 5 mol % to 50 mol % based on the silver salt of an aliphatic carboxylic acid.

* * * * *